US009658598B2

(12) United States Patent
Ching

(10) Patent No.: US 9,658,598 B2
(45) Date of Patent: May 23, 2017

(54) HAIRSPRING FOR A TIME PIECE AND HAIRSPRING DESIGN FOR CONCENTRICITY

(71) Applicant: Master Dynamic Limited, Shatin (HK)

(72) Inventor: Ho Ching, Cheung Sha Wan (HK)

(73) Assignee: MASTER DYNAMIC LIMITED, Shatin, New Territories (HK)

( * ) Notice: Subject to any disclaimer, the term of this patent is extended or adjusted under 35 U.S.C. 154(b) by 207 days.

(21) Appl. No.: 13/944,554

(22) Filed: Jul. 17, 2013

(65) Prior Publication Data

US 2014/0022873 A1 Jan. 23, 2014

(30) Foreign Application Priority Data

Jul. 17, 2012 (HK) ..... 12106962.7
Jul. 17, 2012 (HK) ..... 12106963.6

(51) Int. Cl.
*G04B 17/06* (2006.01)

(52) U.S. Cl.
CPC ..... *G04B 17/066* (2013.01); *G04B 17/06* (2013.01); *Y10T 29/49581* (2015.01)

(58) Field of Classification Search
CPC ..... G04B 17/06; G04B 17/066; G04B 17/227
See application file for complete search history.

(56) References Cited

U.S. PATENT DOCUMENTS

2005/0281137 A1* 12/2005 Bourgeois ..... F16F 1/021 368/175
2006/0262652 A1* 11/2006 Musy ..... F16F 1/10 368/175

(Continued)

FOREIGN PATENT DOCUMENTS

| | | | |
|---|---|---|---|
| DE | 10 2009 048733 | A1 | 4/2011 |
| EP | 1 473 604 | A1 | 11/2003 |
| EP | 2 233 989 | A1 | 9/2010 |

OTHER PUBLICATIONS

Search Report issued on Nov. 15, 2012, by the Hong Kong Patent Office for Application No. 12106963.6.

(Continued)

*Primary Examiner* — Amy Cohen Johnson
*Assistant Examiner* — Jason Collins
(74) *Attorney, Agent, or Firm* — Buchanan Ingersoll & Rooney PC

(57) ABSTRACT

A method of increasing concentricity in use of a spiral hairspring mechanical timepiece; the hairspring having an inner terminal end portion for engagement with a collet, an outer terminal end portion for engagement with a stud, a first limb portion extending from the inner terminal end portion towards the outer terminal end portion, and a stiffening portion positioned at the outer turn of the hairspring and having a cross-sectional second moment of area different to that of the first limb portion such that bending stiffness of the stiffening portion has a greater bending stiffness than the single limb portion. The method includes modifying cross-sectional second moments of an area of the first limb portion and the stiffening portion by minimizing a cost function throughout the amplitude of the rotation of hairspring in use, the cost function being correlated to the net concentricity of the hairspring.

13 Claims, 40 Drawing Sheets

(56) References Cited

U.S. PATENT DOCUMENTS

| | | | | |
|---|---|---|---|---|
| 2010/0290320 | A1* | 11/2010 | Gygax | G04B 1/145 368/177 |
| 2011/0069591 | A1* | 3/2011 | Daout | G04B 17/066 368/175 |
| 2011/0222377 | A1* | 9/2011 | Ching | G04B 17/066 368/175 |
| 2012/0008467 | A1* | 1/2012 | Helfer | G04B 17/066 368/171 |
| 2012/0106303 | A1* | 5/2012 | Von Gunten | F16F 1/10 368/175 |
| 2013/0176834 | A1* | 7/2013 | Helfer | G04B 17/066 368/171 |

OTHER PUBLICATIONS

Search Report issued on Dec. 5, 2012, by the Hong Kong Patent Office for Application No. 12106962.7.

* cited by examiner

HAIRSPRING FOR A TIME PIECE AND HAIRSPRING DESIGN FOR CONCENTRICITY

FIELD OF THE INVENTION

The invention concerns a new design for a hairspring of a mechanical timepiece. More particularly, the present invention relates to a hairspring and a method of design thereof for increased concentricity during the operation of a mechanical timepiece.

BACKGROUND OF THE INVENTION

A hairspring is a key component in a mechanical timepiece. A hairspring is one of the two main components of an oscillator of a timepiece, the other being the balance wheel. The oscillator provides the means of time regulation via its simple harmonic motion.

A balance wheel acts as the inertial element, and is engaged with the inner terminal of a spiral-shaped hairspring. The spiral geometry of a hairspring is generally provided in the form of an Archimedean spiral, generally having a constant pitch. The outer terminal of the hairspring is generally fixedly attached to a fixed stud.

Ideally, the hairspring provides a restoring torque to the balance wheel that is proportional to the wheel's displacement from an equilibrium position, and equations of motion may be utilised to describe a linear second-order system thereof. The equilibrium position of an oscillator is defined as the angular position of the balance wheel such that when the balance wheel is static, that is when the net torque applied by the hairspring to the balance wheel is zero. The resulting oscillator is isochronous, this meaning its natural frequency is independent of its amplitude.

Being isochronous is an important property for an oscillator used in a timepiece as it requires regular torque input from an escapement to compensate for dissipative effects of friction. The torque provided by the escapement may not be constant due to a number of factors, which directly affects the oscillator amplitude. As such, an isochronous oscillator provides a more reliable and stable time regulation.

Typically, the spiral turnings of a hairspring for a timepiece are maintained as concentric as possible when the balance wheel rotates about its equilibrium position for reasons including:

(i) a hairspring that is not concentric does not have its centre of mass located close to the axis of rotation. As the balance wheel rotates, the center of mass may wander in such a way as to generate a radial force that is compensated by bearings, resulting in excessive friction;

(ii) A hairspring that is not concentric also has a geometry that deviates from an Archimedean spiral during operation, which results in a nonlinear second-order system that is not isochronous; and (iii) In some cases, a hairspring that is not concentric may significantly distort its spiral geometry such that the adjacent turnings collide and damage each other, as well resulting is a system that is not isochronous.

Within the prior art, hairspring concentricity may be improved by modifying the geometry of the inner and outer terminal curves based on Phillips and Lossier mathematical models for hairspring design.

Breguet has implementing such theories in its Breguet over-coil for the outer terminal. The over-coil uses a modified outermost turning which is raised and curved inwardly. However, this method can only maintain partial concentricity, and production the required shape in the outermost turning increases manufacturing difficulties and costs.

Another method of the prior art to increase hairspring concentricity is to selectively stiffen sections of the hairspring strip first proposed by Emile and Gaston Michel in the 1958 article entitled "*Spiraux plats concentriques sans courbes"ly* (Concentric flat hairsprings without curves), published de by Societe Suisse Chronometrie.

The authors discovered via trial and error that hairspring concentricity may be improved by stiffening a section of the hairspring using an angle strip. Difficulties with such a hairspring include difficulty in mass production, and such a hairspring remains an academic curiosity.

Also within the prior art, Patek Philippe stiffened a hairspring section in its Spiromax hairspring using a strip of variable width to achieve the stiffening effect. Patek Philippe also developed and patented a design methodology (patent number EP 03009603.6) by calculating the location of the center of mass when the hairspring is relaxed. The stiffening is achieved design by a widening of the outer side on the outermost turning of the hairspring.

To maintain a hairspring as isochronous, hairspring design requires insensitivity to temperature variations. The Young's modulus of a material which its stiffness typically varies slightly with temperature.

In a hairspring, the Young's modulus determines the spring constant and ultimately the natural frequency of the oscillator. Any variation of the hairspring's Young's modulus with temperature will negatively impact the oscillator's ability to reliably regulate time.

A problem of the Young's modulus's sensitivity to temperature in modern hairsprings has been widely addressed by the use of Nivarox in the manufacture of hairsprings. Nivarox is a metallic alloy having a Young's modulus that is extremely low, but not zero, in respect of sensitivity to temperature variations.

The advent of micro-fabrication and the use of silicon in the watch industry has over the past decade introduced new methods to design and manufacture of hairsprings with improved isochronism. Such technology allows the manufacture of hairspring based on variations of the strip width to selectively modify the spring's bending stiffness along its entire arc length.

Further, such technology allows the prospect of achieving a hairspring whose Young's modulus is completely insensitive to temperature variations. The process of de-sensitizing the hairspring's Young's modulus with respect to temperature variation is defined as thermo-compensation.

Manufacture of a hairspring having a variable strip width is only practically possible utilising micro-fabrication technology due to its ability to manufacture any planar component to high precision.

Hairspring concentricity may be increased utilising micro-fabrication techniques based on theory, numerical simulation, or experimentation. The Patek Philippe Spiromax is an example of a silicon hairspring with a section of increased strip width in the outermost turning near the outer terminal, placed and sized to increase hairspring concentricity.

Micro-fabrication technology may also allow application of a thin coat of silicon dioxide on a silicon hairspring for thermo-compensation purposes. The Young's modulus of silicon decreases with rise in temperature while that of silicon dioxide tends to increase.

Therefore, by the precise application of silicon dioxide coating of the correct thickness onto a silicon bulk, it is possible to produce a composite hairspring where the thermal sensitivities of the Young's modulus of the two materials substantially cancel each other. This may result in a hairspring with an overall Young's modulus that is theoretically insensitive to temperature variations.

OBJECT OF THE INVENTION

Accordingly, it is an object of the present invention to provide a hairspring which overcomes or at least substantially ameliorates at least some of the deficiencies as exhibited by those of the prior art.

SUMMARY OF THE INVENTION

In a first aspect, the present invention provides a method of increasing concentricity in use of a spiral hairspring mechanical timepiece; the hairspring having an inner terminal end portion for engagement with a collet and an outer terminal end portion for engagement with a stud, a first limb portion extending from the inner terminal end portion towards the outer terminal end portion, and a stiffening portion positioned at the outer turn of the hairspring and having a cross-sectional second moment of area different to that of the first limb portion; such that the bending stiffness of the stiffened portion has a greater bending stiffness than that of the single limb portion; wherein said method including the steps of:

modifying the cross-sectional second moments of area of first limb portion and the stiffening portion by way of minimization of a cost function throughout the amplitude of the rotation of hairspring in use, wherein the cost function is correlated to the net concentricity of the hairspring.

The cost function may the integral of the magnitude of the stud reaction force over the entire range of the amplitude of the rotation of hairspring in use or the maximum value of the magnitude of the stud reaction force over the entire range of the amplitude of the rotation of hairspring in use, The cost function may also be the integral of the magnitude of the hairspring's center of mass location, relative to the hairspring's center of mass location when the balance wheel angle is zero over the entire range of the amplitude of the rotation of hairspring in use, or the maximum value of the magnitude of the hairspring's center of mass location, relative to the hairspring center of mass location when the amplitude of rotation is zero, over the entire range of the amplitude of the rotation of hairspring in use.

Preferably, the cross-section second moments of area for a modified first portion and stiffening portion of the hairspring are based on the position location along the hairspring strip, the arc length of the modified portions of the hairspring, and a function that determines the cross-section second moment of area variation along the modified portions of the hairspring.

Preferably, the cross-section second moment of area variation is substantially constant.

The cross-section second moment of area variation may be based on a polynomial function, a trigonometric function, or a discontinuous function of two or more piecewise continuous functions.

The optimization algorithm used may be based on the gradient descent method requiring the computation of the gradient of the cost function with respect to the design parameters.

In a second aspect, the present invention provides a spiral hairspring for mechanical timepiece having an inner terminal end portion for engagement with a collet and an outer terminal end portion for engagement with a stud, a first limb portion extending from the inner terminal end portion towards the outer terminal end portion, and a stiffening portion positioned at the outer turn of the hairspring and having a cross-sectional second moment of area different to that of the first limb portion; wherein the cross-sectional second moments of area of the first portion and the stiffening portion is determined by the method of the first aspect.

Preferably, the single limb portion and the two or more spaced apart limb portions of the stiffening portion are of rectangular cross-section, and have the same width as each other and the same height as each other.

Preferably the single limb portion and the stiffening portion are formed from a first material, and further comprising an outer coating layer formed from a second material.

Preferably, the first material has a first Young's Modulus and second material has a second Young's modulus, the first and second Young's Moduli having opposite temperature dependencies, and the single limb portion and the stiffening portion and the thickness of the outer coating layer are sized such that the elastic properties of the hairspring are desensitized to temperature variations.

Preferably, the first material is silicon and the second material is silicon dioxide.

The single limb section may be of a substantially constant pitch, and one of the limb portions of the stiffening portion is of said pitch. The radially innermost limb portion is of said pitch.

The single limb section is preferably of a substantially constant pitch, and two adjacent limb portions of the stiffening portion are substantially equidistant to the path of the said pitch.

Preferably, the spacing between two adjacent limb portions of the stiffening portion is substantially constant.

A stiffening portion may be disposed between two single limb portions. The single limb portions and the innermost limb portion of the stiffening portion may be of the same pitch.

The outermost limb portion of the stiffening portion may be of the same pitch as one adjacent single limb portion, and the innermost limb portion of the stiffening portion is of the same pitch as the adjacent limb portion of the stiffening portion.

The stiffening portion may be disposed at the outer terminal portion of the hairspring, and each one of the limb portions of the stiffening portion have a terminal end.

The adjacent single limb portion is preferably of substantially constant pitch, and one of the limb portions of the stiffening portion is of said pitch. Preferably, the innermost limb portions of the stiffening portion is of said pitch.

The outer limb portions of the stiffening portion may substantially shorter than the adjacent inner limb portion of the stiffening portion. Alternatively, an outer one of the limb portion of the stiffening portion is substantially longer than the adjacent inner limb portion of the stiffening portion.

The stiffening portion may comprises less than one half of a spiral turn.

Adjacent limb portions of the stiffening portion may be interconnected intermediate the ends of the stiffening portion.

The single limb portion and the two or more spaced apart limb portions of the stiffening portion are preferably substantially coplanar.

The present patent proposes hairspring design based on one or more stiffened section such that the entire operating range of the oscillator is considered, typically for a balance wheel angle from −330 to +330 degrees.

The metric for concentricity can be the variation in the position of the center of mass or the reaction force at the stud over the entire operating range. This metric is used as the cost function for an automatic optimization algorithm which systematically varies the strip section parameters to achieve the maximum possible concentricity for a given hairspring geometry.

In a first further, the present invention provides a spiral hairspring for a mechanical timepiece, said hairspring comprising:

an inner terminal end portion and an outer terminal end portion, a single limb portion extending from the inner terminal end portion towards the outer terminal end portion; and a stiffening portion formed by two or more spaced apart limb portions positioned at the outer turn of the hairspring such that the bending stiffness of the stiffened portion has a greater bending stiffness than that of the single limb portion;

wherein the stiffened portion of the hairspring has a stiffness so as to increase concentricity of the turns about an axis of rotation during compression and expansion of the hairspring during oscillatory motion about the axis of rotation.

Preferably, the single limb portion and the two or more spaced apart limb portions of the stiffening portion are of rectangular cross-section, and have the same width as each other and the same height as each other.

Preferably, the single limb portion and the stiffening portion are formed from a first material, and further comprising an outer coating layer formed from a second material.

Preferably the first material has a first Young's Modulus and second material has a second Young's modulus, the first and second Young's Moduli having opposite temperature dependencies, and the single limb portion and the stiffening portion and the thickness of the outer coating layer are sized such that the elastic properties of the hairspring are desensitized to temperature variations.

In a preferred embodiment, the first material is silicon and the second material is silicon dioxide.

The single limb section may be of a substantially constant pitch, and one of the limb portions of the stiffening portion may be of said pitch. The radially innermost limb portion may be of said pitch.

The single limb section may be of a substantially constant pitch, and two adjacent limb portions of the stiffening portion are preferably substantially equidistant to the path of the said pitch.

Preferably, the spacing between two adjacent limb portions of the stiffening portion is substantially constant.

A stiffening portion may be disposed between two single limb portions. Preferably, the single limb portions and the innermost limb portion of the stiffening portion are of the same pitch. The outermost limb portion of the stiffening portion may of the same pitch as one adjacent single limb portion, and the innermost limb portion of the stiffening portion may be of the same pitch as the adjacent limb portion of the stiffening portion.

Preferably, the stiffening portion is disposed at the outer terminal portion of the hairspring, and each one of the limb portions of the stiffening portion have a terminal end. Preferably the adjacent single limb portion is of substantially constant pitch, and one of the limb portions of the stiffening portion is of said pitch. Preferably, the innermost limb portions of the stiffening portion is of said pitch.

An outer limb portion of the stiffening portion may be substantially shorter than the adjacent inner limb portion of the stiffening portion. Alternatively, an outer one of the limb portion of the stiffening portion is substantially longer than the adjacent inner limb portion of the stiffening portion.

Preferably, the stiffening portion comprises less than one half of a spiral turn.

The adjacent limb portions of the stiffening portion may be interconnected intermediate the ends of the stiffening portion.

The single limb portion and the two or more spaced apart limb portions of the stiffening portion are preferably substantially coplanar.

In a third aspect, the present invention provides a spiral hairspring for a mechanical timepiece, said hairspring comprising:

an inner terminal end portion and an outer terminal end portion, a single limb portion extending from the inner terminal end portion towards the outer terminal end portion; and a stiffening portion formed by two or more spaced apart limb portions positioned at the outer turn of the hairspring such that the bending stiffness of the stiffened portion has a greater bending stiffness than that of the single limb portion;

wherein the stiffened portion of the hairspring has a stiffness so as to increase concentricity of the turns about an axis of rotation during compression and expansion of the hairspring during oscillatory motion about the axis of rotation.

Preferably, the single limb portion and the two or more spaced apart limb portions of the stiffening portion are of rectangular cross-section, and have the same width as each other and the same height as each other.

Preferably, the single limb portion and the stiffening portion are formed from a first material, and further comprising an outer coating layer formed from a second material.

Preferably the first material has a first Young's Modulus and second material has a second Young's modulus, the first and second Young's Moduli having opposite temperature dependencies, and the single limb portion and the stiffening portion and the thickness of the outer coating layer are sized such that the elastic properties of the hairspring are desensitized to temperature variations.

In a preferred embodiment, the first material is silicon and the second material is silicon dioxide.

The single limb section may be of a substantially constant pitch, and one of the limb portions of the stiffening portion may be of said pitch. The radially innermost limb portion may be of said pitch.

The single limb section may be of a substantially constant pitch, and two adjacent limb portions of the stiffening portion are preferably substantially equidistant to the path of the said pitch.

Preferably, the spacing between two adjacent limb portions of the stiffening portion is substantially constant.

A stiffening portion may be disposed between two single limb portions. Preferably, the single limb portions and the innermost limb portion of the stiffening portion are of the same pitch. The outermost limb portion of the stiffening portion may of the same pitch as one adjacent single limb portion, and the innermost limb portion of the stiffening portion may be of the same pitch as the adjacent limb portion of the stiffening portion.

Preferably, the stiffening portion is disposed at the outer terminal portion of the hairspring, and each one of the limb portions of the stiffening portion have a terminal end. Preferably the adjacent single limb portion is of substantially constant pitch, and one of the limb portions of the stiffening portion is of said pitch. Preferably, the innermost limb portions of the stiffening portion is of said pitch.

An outer limb portion of the stiffening portion may be substantially shorter than the adjacent inner limb portion of the stiffening portion. Alternatively, an outer one of the limb portion of the stiffening portion is substantially longer than the adjacent inner limb portion of the stiffening portion.

Preferably, the stiffening portion comprises less than one half of a spiral turn.

The adjacent limb portions of the stiffening portion may be interconnected intermediate the ends of the stiffening portion.

The single limb portion and the two or more spaced apart limb portions of the stiffening portion are preferably substantially coplanar.

In the present invention, the stiffening portion, if appropriately sized and positioned, can be used to improve the hairspring concentricity.

The present invention allows substantially complete thermo-compensation of a silicon hairspring with a silicon dioxide coating because each side-by-side branch of a multi-strip spiral section can maintain the same width as the other branches of the other spiral sections.

The present invention allows for ease of manufacture so as to achieve the temperature compensation effect, as the silicon dioxide thickness required for total thermo-compensation varies according to the width of the silicon strip, and current manufacturing technology only permits the coating of silicon dioxide of uniform thickness.

The present invention allows substantially complete thermo-compensation of a silicon hairspring with a silicon dioxide coating because each side-by-side branch of a multi-strip spiral section can maintain the same width as the other branches of the other spiral sections.

The present invention allows for ease of manufacture so as to achieve the temperature compensation effect, as the silicon dioxide thickness required for total thermo-compensation varies according to the width of the silicon strip, and current manufacturing technology only permits the coating of silicon dioxide of uniform thickness.

BRIEF DESCRIPTION OF THE DRAWINGS

Preferred embodiments of the present invention will be explained in further detail below by way of examples and with reference to the accompanying illustrative drawings, in which:—

DETAILED DESCRIPTION OF THE PREFERRED EMBODIMENTS

Figure 1:
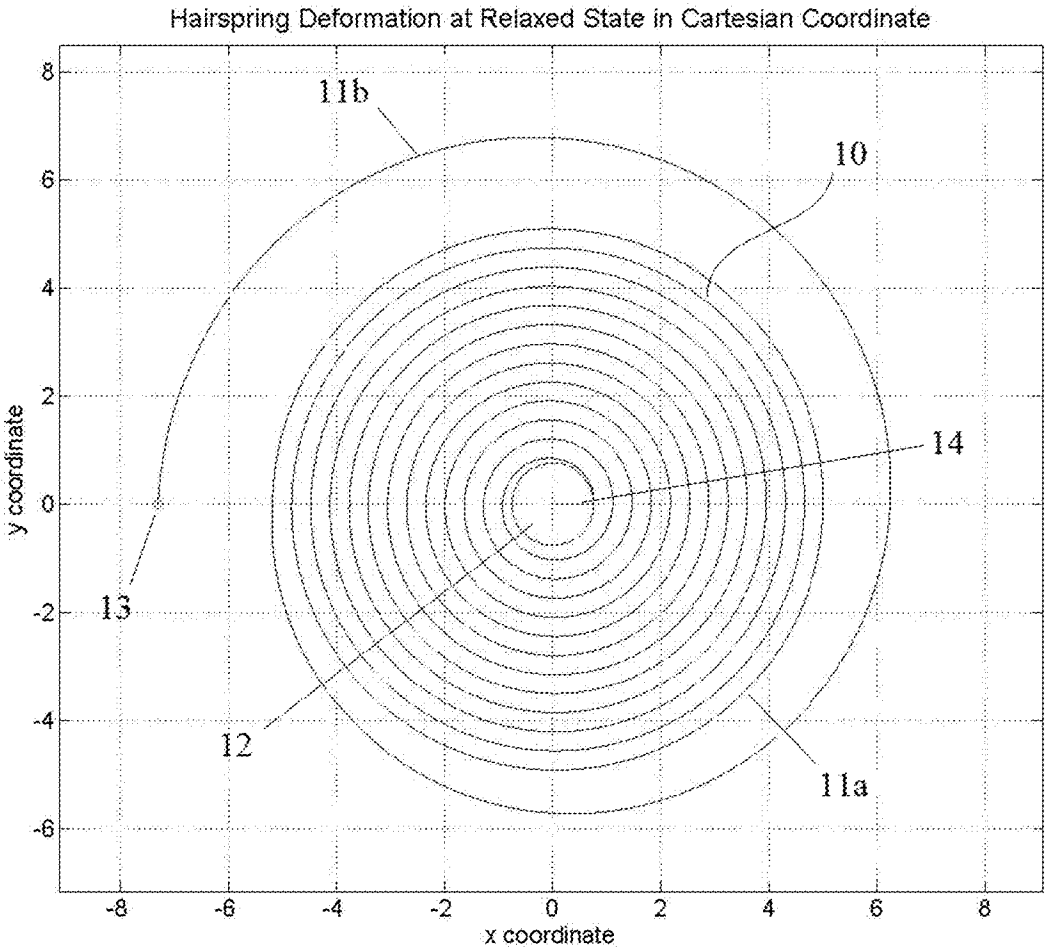
FIG. 1 shows a diagrammatic representation of a traditional hairspring at a relaxed state; of a hairspring with all except the outermost turning consisting of the Archimedes spiral with a constant pitch.

Referring to FIG. 1, for illustrative and explanatory purposes a simplified schematic diagram of traditional hairspring 10 at its relaxed state having a total of 13.5 turnings is shown.

The hairspring turnings consist of two sections namely the main body section 11*a* and outer section 11*b*. The main body section 11*a* forms an Archimedes spiral having constant pitch with its inner terminal connected to a collet 12. The collet 12 is in turn rigidly connected to a balance wheel (not shown). The outer section 11*b* has a significantly increased pitch to allow room for the stud 13 placement. All portions of 11*a* and 11*b* have a constant cross section.

The line 14 presents the connection point between the collet 12 and hairspring main body section 11*a* which allows the reader to better track the collet 12 rotation angle.

As will be appreciated by those skilled in the art, the traditional hairspring 10 is only an example of the many possible hairspring shape, but this example would be used for reference in the rest of this document.

Figure 2:
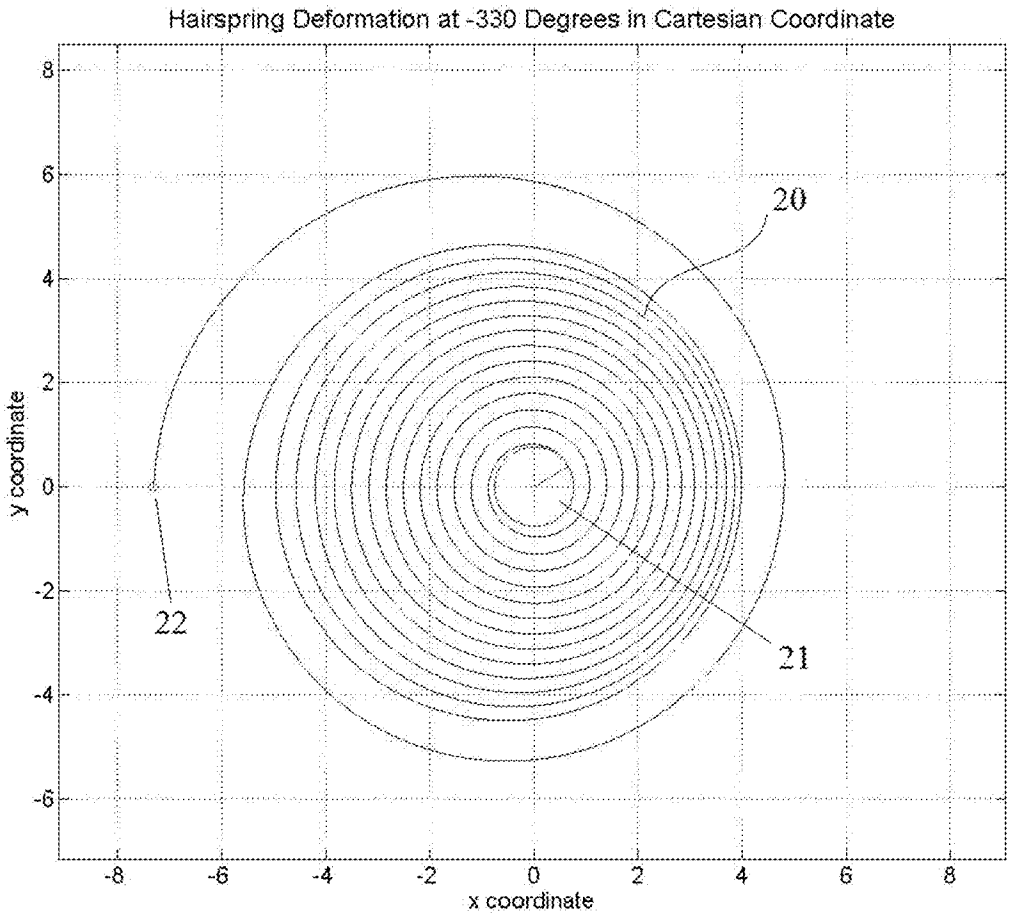
FIG. 2 shows a diagrammatic representation of traditional hairspring of FIG. 1 with a balance wheel angle at −330 degrees.

Referring to FIG. 2, the traditional hairspring 10 of FIG. 1 is shown as being in one direction and represented as hairspring 20, which is under contractive deformation whereby collet 21 has rotated 330 degrees clockwise, which is a typical oscillation amplitude. As will be observed and understood by those skilled in the art, the overall size of the hairspring footprint has decreased, but more importantly the deformation is not concentric with the pitch on the stud 22 side being much greater than that on the opposite side.

Figure 3:
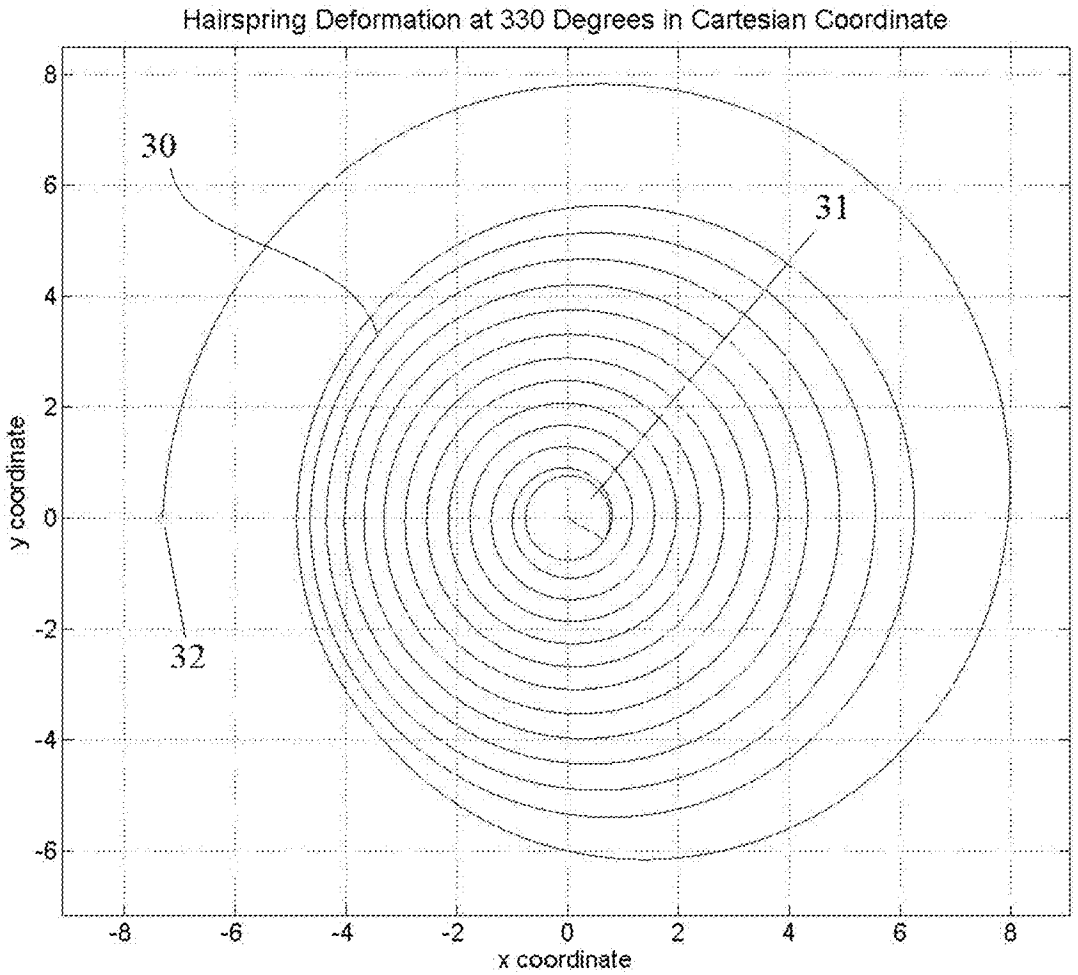
FIG. 3 shows a diagrammatic representation of traditional hairspring of FIG. 1 with a balance wheel angle at +330 degrees.

Referring to FIG. 3, the traditional hairspring 10 of FIG. 1 is shown as being deformed in an opposite direction to that as shown in FIG. 2, and is represented by hairspring 30. The hairspring 30 is under expansive deformation where the collet 31 has rotated 330 degrees counter-clockwise. As will be observed, the size of the overall hairspring footprint has increased, but more importantly the deformation is also not concentric with the pitch on the stud 32 side being much smaller than that on the opposite side.

The lack of concentricity shown in FIG. 2 and FIG. 3 results in extra friction as the balance staff bearings (not shown in FIG. 2 and FIG. 3) has to compensate for the centrifugal force produced by the motion of the center of mass.

Such loss of concentricity also produces a hairspring of changing geometry that results in a varying spring constant, causing the oscillator to become anisochronous.

Furthermore, in some cases, the pitch over certain areas of the hairspring may become negative under deformation, away from the stud 22 in hairspring 20 and toward the stud 32 in hairspring 30, implying contact between adjacent turnings with subsequent damage.

Figure 4:
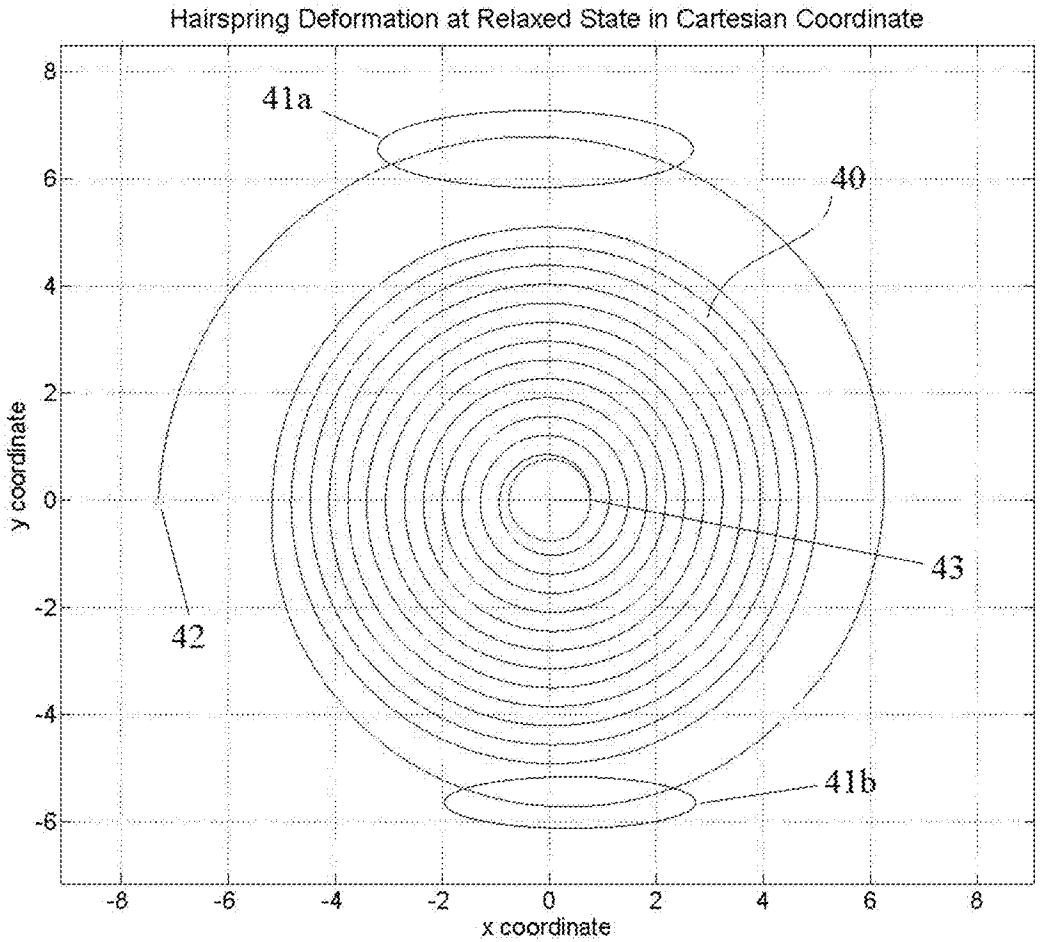
FIG. 4 shows a schematic representation of a hairspring according to the present invention, having two possible modified sections of variable cross-section second moment of area at approximately 90 and 270 degrees from the outer terminal.

Referring to FIG. 4, there is shown a schematic representation of an embodiment of a hairspring 40 according to the present invention, having modified sections 41*a* and 41*b* as an example.

Hairspring isochronism can be improved by modifying the bending stiffness of selected sections of the hairspring strip. One manner in which to achieve this is by varying the strip cross section, and the micro-fabrication technology increases ease of manufacture by modifying the hairspring strip width. A hairspring can have one or more distinct modified sections.

According to the present invention, to create an automatic optimization algorithm for maximum hairspring concentricity, the first step is to clearly define the design parameters we can vary to achieve optimal results.

In the embodiment of FIG. 4, each modified section 41*a* or 41*b* requires at least three design parameters to define the geometry of the modified section: the modified second moment of area $I_a$, the arc length $L_a$ of the modified section, and the location $\theta_a$ of the modified section.

The parameter $I_a$ can be defined as a ratio compared to the second moment of area of the rest of the hairspring strip. The parameter $L_a$ can be defined as the length of the modified section or as the angular span in polar coordinates. The parameter $\theta_a$ can be measured relative to the stud 42 or the collet connection 43 locations as the arc distance or as the angular distance in polar coordinate.

The number of parameters may be greater than three if the modified second moment of area $I_a$ is a complex function of the modified section arc length or angular span.

The functions in question may be continuous functions such as polynomial or trigonometric functions, or a discontinuous combination of piecewise continuous functions. There exist no theoretical upper limit to the number of distinct modified sections. The second moment of area of the modified sections may have either an increased or decreased second moment of area in comparison to that of the rest of the hairspring strip.

Figure 5:
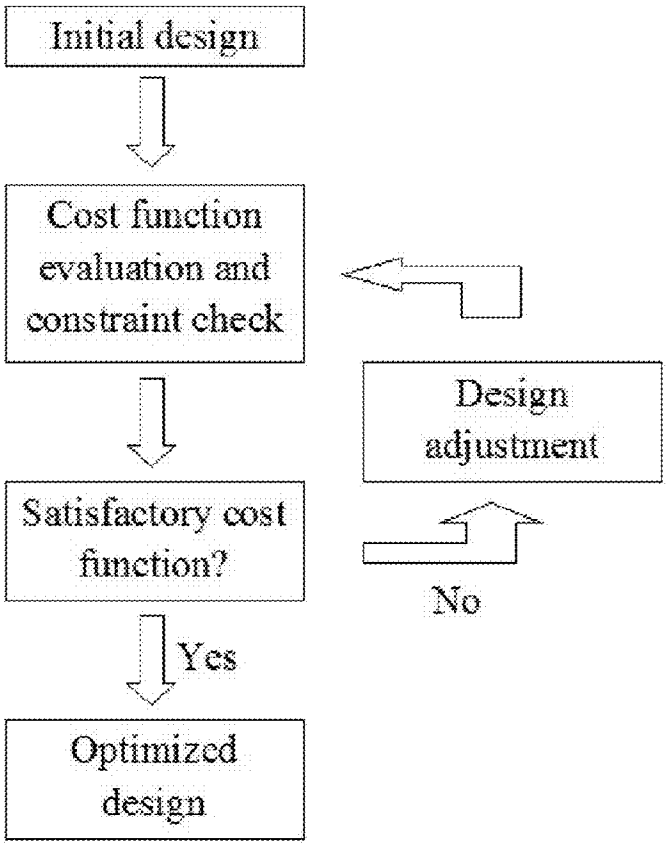
FIG. 5 shows a flow chart of an automatic optimization algorithm according to the present invention, for maximizing hairspring concentricity.

Referring to FIG. 5, there is shown an optimization routine flow chart in accordance with the present invention.

An automatic optimization algorithm can be designed to maximize the hairspring concentricity by varying the aforementioned design parameters that defines the geometry of the modified section or sections.

At its core, a typical optimization algorithm adjusts the design or system parameters so as to minimize or maximize a predefined cost function, which may be subject to certain constraints.

The cost function may be computed via a computer model of the mechanism in question using the design parameters as inputs. The algorithm then assesses whether the cost function is satisfactory. If not, the algorithm will adjust the design parameters based on a predefined set of laws; the new design parameters are used as inputs for the computer model to compute a new cost function.

The cycle is then repeated until the algorithm determines that the cost function is satisfactory with its corresponding optimized design parameters. This routine can be used to optimize the hairspring modified sections for maximum concentricity.

In addition to the aforementioned design parameters for the hairspring modified sections, the optimization algorithm requires a well-defined cost function that reflects the level of hairspring concentricity.

One possible measure is the degree of drift in the hairspring center of mass over the entire oscillator operating range. The drift of the hairspring center of mass is defined as the hairspring center of mass location at a given collet rotation angle $\alpha$ relative to its location at $\alpha$ equals to zero.

$$X(\alpha) = \frac{\int_0^L A(s)[x(s,\alpha) - x(s,0)]ds}{\int_0^L A(s)ds} \tag{1}$$

$$Y(\alpha) = \frac{\int_0^L A(s)[y(s,\alpha) - y(s,0)]ds}{\int_0^L A(s)ds} \tag{2}$$

The variable s is the arc position along the hairspring strip. A(s) is the cross-section area at arc position s. The variables $x(s,\alpha)$ and $y(s,\alpha)$ define the x and y positions of the strip at arc position s and collet angle $\alpha$.

The term L is the total arc length of the hairspring. $X(\alpha)$ and $Y(\alpha)$ are the drifts of the center of mass in the x and y directions, respectively, relative to the center of mass of the relaxed hairspring. Eq. 1 and 2 only determine the drift of the center of mass at a particular collet angle $\alpha$.

A single metric J that reflects the center of mass drift over the entire oscillator operating range can be defined by taking the integral of the magnitude of the drift from $\alpha_{cw}$ to $\alpha_{ccw}$ where $\alpha_{cw}$ and $\alpha_{ccw}$ typically equal −330 and 330 degrees, respectively.

$$J = \frac{\int_{\alpha_{ccw}}^{\alpha_{cw}} [X^2(\alpha) + Y^2(\alpha)]d\alpha}{|\alpha_{cw} - \alpha_{ccw}|} \tag{3}$$

The cost function J can be described as the average drift in the hairspring center of mass, the minimization of which is correlated to the maximization of the hairspring concentricity.

It is generally impractical to compute the Eq. 3 as an integral as computer simulation of the hairspring deformation for a single collet angle $\alpha$ may take several hours.

However, it is possible to approximate the integral by applying the trapezoid rule of integration or another numerical integration method over a finite number of $\alpha$.

$$J_{approx} = \frac{1}{\alpha_N - \alpha_1} \sum_{i=1}^{N-1} \frac{[X^2(\alpha_i) + Y^2(\alpha_i)] + [X^2(\alpha_{i+1}) + Y^2(\alpha_{i+1})]}{2(\alpha_{i+1} - \alpha_i)} \tag{4}$$

In Eq. 4, the collet angle $\alpha$ is discretized over N evenly-spaced values, meaning only N simulations are required to compute an approximate value for $J_{approx}$. A large value for N implies a more accurate approximation for the cost function.

As an alternative to the integral of the center of mass drift over the collet angle $\alpha$, the minimization of the maximum value of center of mass drift magnitude can also serve to maximize the hairspring concentricity.

$$J = \max_{\alpha}[X^2(\alpha) + Y^2(\alpha)] \tag{5}$$

Eq. 5 essentially turns the optimization problem into a type of mini-max problem which in this context may be simpler to implement.

Another well-defined cost function that reflects the level of hairspring concentricity is the magnitude of the reaction force at the stud. The reaction force at the stud can be computed via a computer simulation of the hairspring for a certain collet angle $\alpha$. A single metric J can also be applied that integrates the magnitude of the stud reaction force over $\alpha_{cw}$ and $\alpha_{ccw}$.

$$J = \frac{\int_{\alpha_{ccw}}^{\alpha_{cw}} [R_x^2(\alpha) + R_y^2(\alpha)]d\alpha}{\alpha_{cw} - \alpha_{ccw}} \tag{6}$$

The variables $R_x(\alpha)$ and $R_y(\alpha)$ are the stud reaction forces in the x and y directions, respectively. This cost function can also be described as the average stud reaction force, the minimization of which is equivalent to the maximization of the hairspring concentricity.

The cost function from Eq. (6) can also be approximated by discretizing $\alpha$ into N evenly-spaced values and then using the trapezoid rule to approximate the integral.

$$J_{approx} = \frac{1}{\alpha_N - \alpha_1} \sum_{i=1}^{N-1} \frac{[R_x^2(\alpha_i) + R_y^2(\alpha_i)] + [R_x^2(\alpha_{i+1}) + R_y^2(\alpha_{i+1})]}{2(\alpha_{i+1} - \alpha_i)} \tag{7}$$

The mini-max alternative to the integral can also be applied as a metric for hairspring concentricity.

$$J = \max_{\alpha}[R_x^2(\alpha) + R_y^2(\alpha)] \tag{8}$$

In essence, both the center of mass drift and the stud reaction force can be used to determine the level of hairspring concentricity in the automatic optimization algorithm.

To minimize the aforementioned cost functions and thus maximize the hairspring concentricity, a search algorithm needs to efficiently adjust the design parameters $I_a$, $L_a$, $\theta_a$, $I_b$, $L_b$, $\theta_b$, etc. to achieve optimization.

The suffixes a and b stand for the first and second modified sections with additional possible modified sections.

Of the many algorithms available for this purpose, the gradient descent method is known to be one of the most efficient and popular.

When applied to the hairspring automatic optimization algorithm, the gradient descent method computes the gradient of one of the aforementioned cost function J.

$$\nabla J = \left[ \frac{\partial J}{\partial I_a} \quad \frac{\partial J}{\partial L_a} \quad \frac{\partial J}{\partial \theta_a} \quad \frac{\partial J}{\partial I_b} \quad \frac{\partial J}{\partial L_b} \quad \frac{\partial J}{\partial \theta_b} \quad \cdots \right] \tag{9}$$

The design parameters are then modified by taking a step in the direction opposite to the gradient defined in Eq. 9 in each iteration. Assuming the design parameters as defined by a vector as follows:

$$z=[I_a L_a \theta_a I_b L_b \theta_b \ldots] \tag{10}$$

Then the update rule for the design parameters is defined by the following equation:

$$z_{n+1} = z_n - \gamma \frac{\nabla J}{|\nabla J|} \tag{11}$$

The subscript in the design parameter vector is the iteration number, and the variable □ is the step size.

This update rule will cause the cost function to gradually approach a local minimum after given sufficient iterations. The step size □ can be adjusted in the middle of the optimization routine depending on the proximity to the local minimum.

It is typically impossible to derive an explicit solution to the cost function gradient ∇J because the cost function J itself is the result of numerical simulation of the hairspring.

It is possible however to approximate the cost function gradient using numerical differentiation techniques. However, optimization time will increase dramatically because the simulation needs to be run several times for each iteration to perform numerical differentiations.

The gradient descent method requires an initial guess of the design parameters at the start of the optimization routine. An initial guess that is sufficiently close to the solution can drastically reduce the optimization time.

One possible method to obtain a good estimate of the initial guess is to perform a coarse brute-force search over a reasonable range of the design parameters. An independent optimization algorithm in its own right, the brute-force search computes the cost function over the range of design parameters to find the minimum cost function.

To produce a reasonably precise result, the brute-force search alone requires an impractically large number of hairspring simulations. However, a coarse preliminary scan of the design parameter range using the brute-force search can produce a good initial guess that can be further refined using the gradient descent method. The result is a net overall decrease in optimization time over the use of either individual optimization algorithm alone.

Other automatic optimization algorithms can be used to optimize the hairspring design for concentricity, including but not limited to genetic algorithm, memetic algorithm, and simulated annealing. All optimization algorithms will generally work with the aforementioned cost function and design parameters. While each of the other algorithms has their strengths and weakness, most are more difficult to implement than the gradient descent method.

Figure 6:
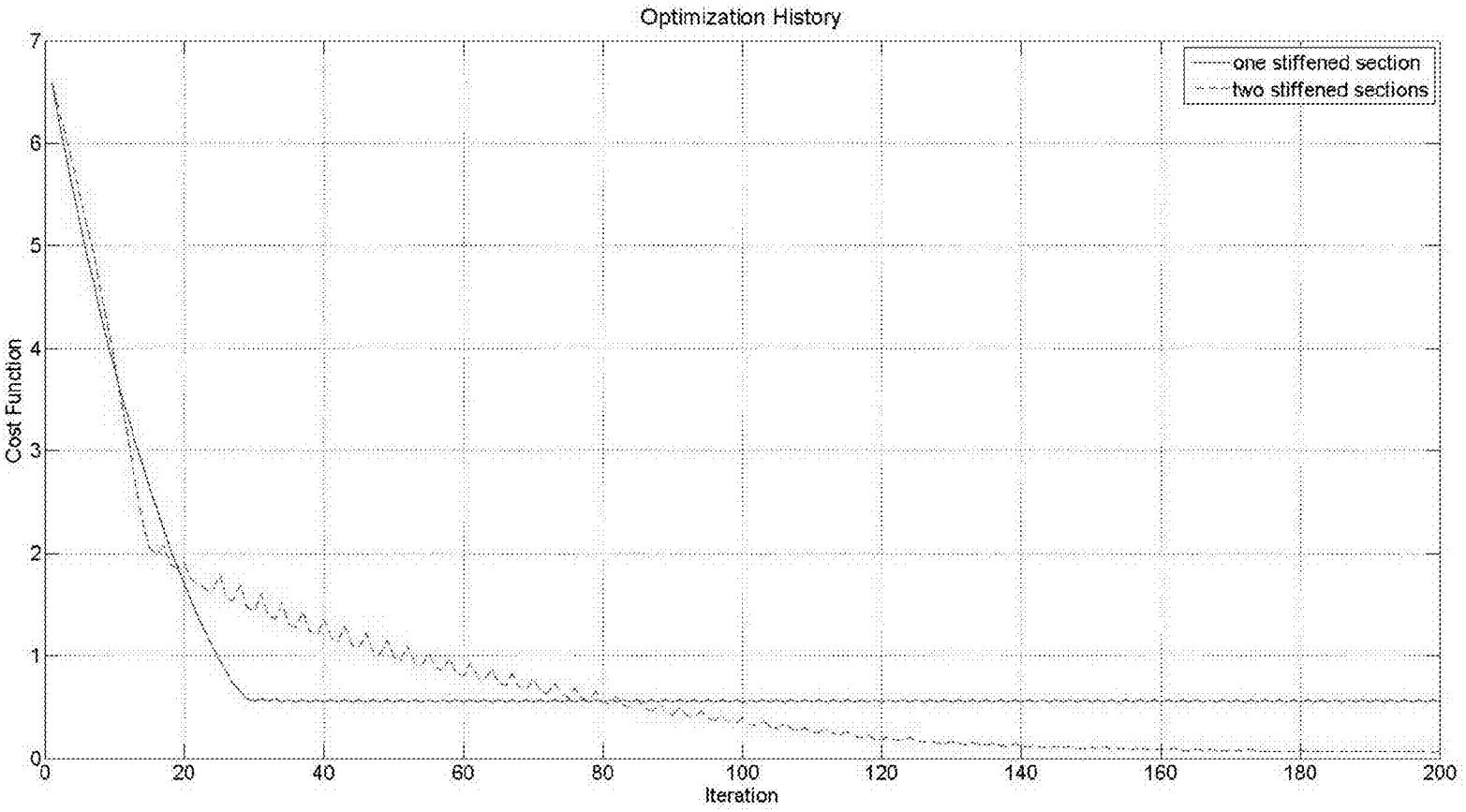
FIG. 6 shows the cost function history versus optimization iteration according to the present invention, for hairspring concentricity with one and two modified sections.

Referring to FIG. 6, there is shown the result of the optimization history of the gradient descent method for hairspring concentricity. The x-axis and y-axis are the iteration number and cost function history, respectively.

In this case, the cost function is defined as the integral of the stud reaction force over collet angle α from −330 to +330 degrees, the nominal operating range of a typical oscillator.

One curve shows the optimization history of a hairspring with a single stiffened section in the outermost turning, and the other curve shows that with two stiffened sections also in the outermost turning.

Both curves are shown to eventually settle at a local minimum in the cost function, and the design with two stiffened sections dramatically outperforming the design with one stiffened section.

Figure 7:
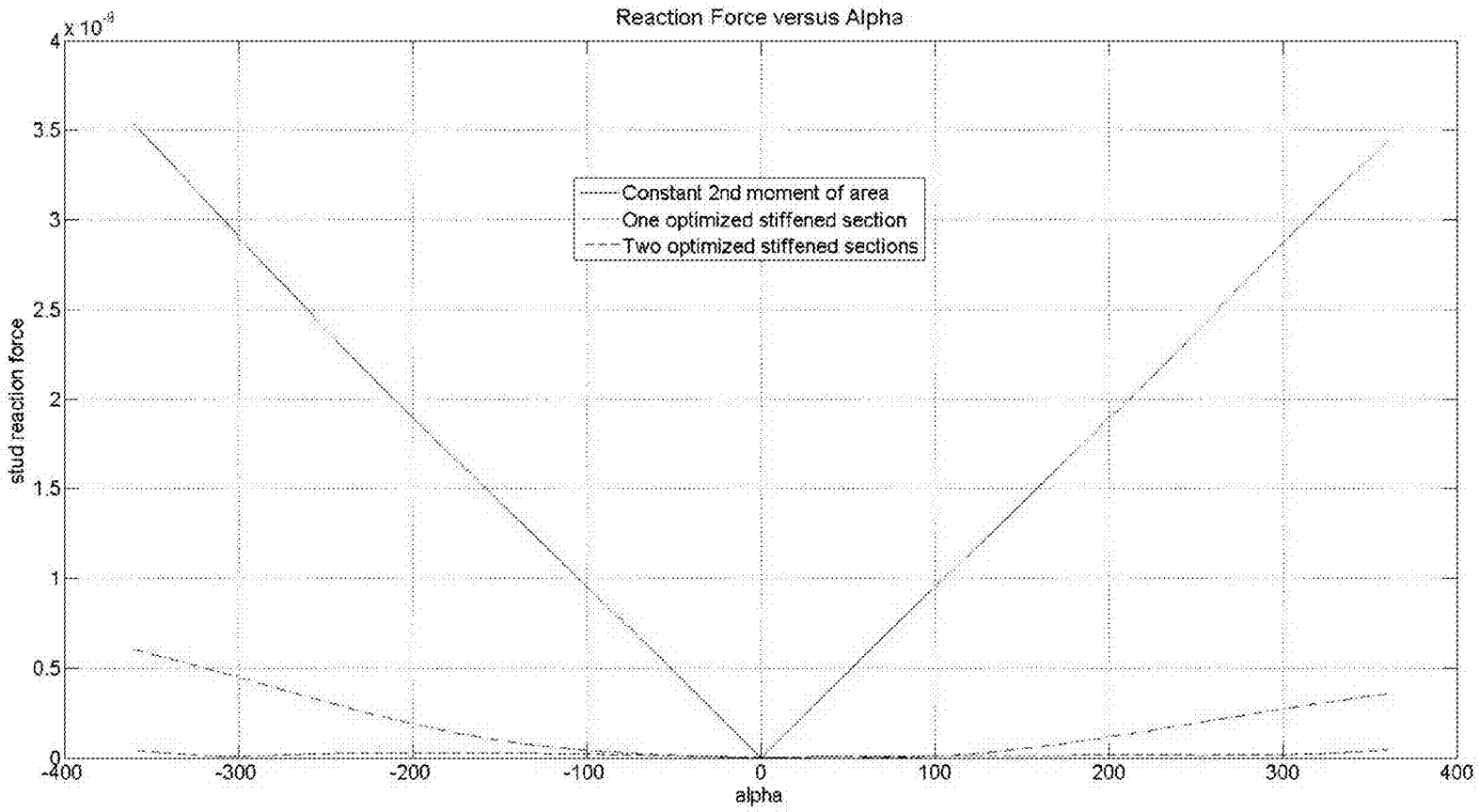
FIG. 7 shows the reaction force history versus balance wheel angle with one and two modified sections.

Referring to FIG. 7, there is shown the stud reaction force magnitude variation over collet angle α for a hairspring:

(i) without any stiffened section, (ii) with one optimized stiffened section, and (iii) two optimized stiffened sections.

Figure 8:
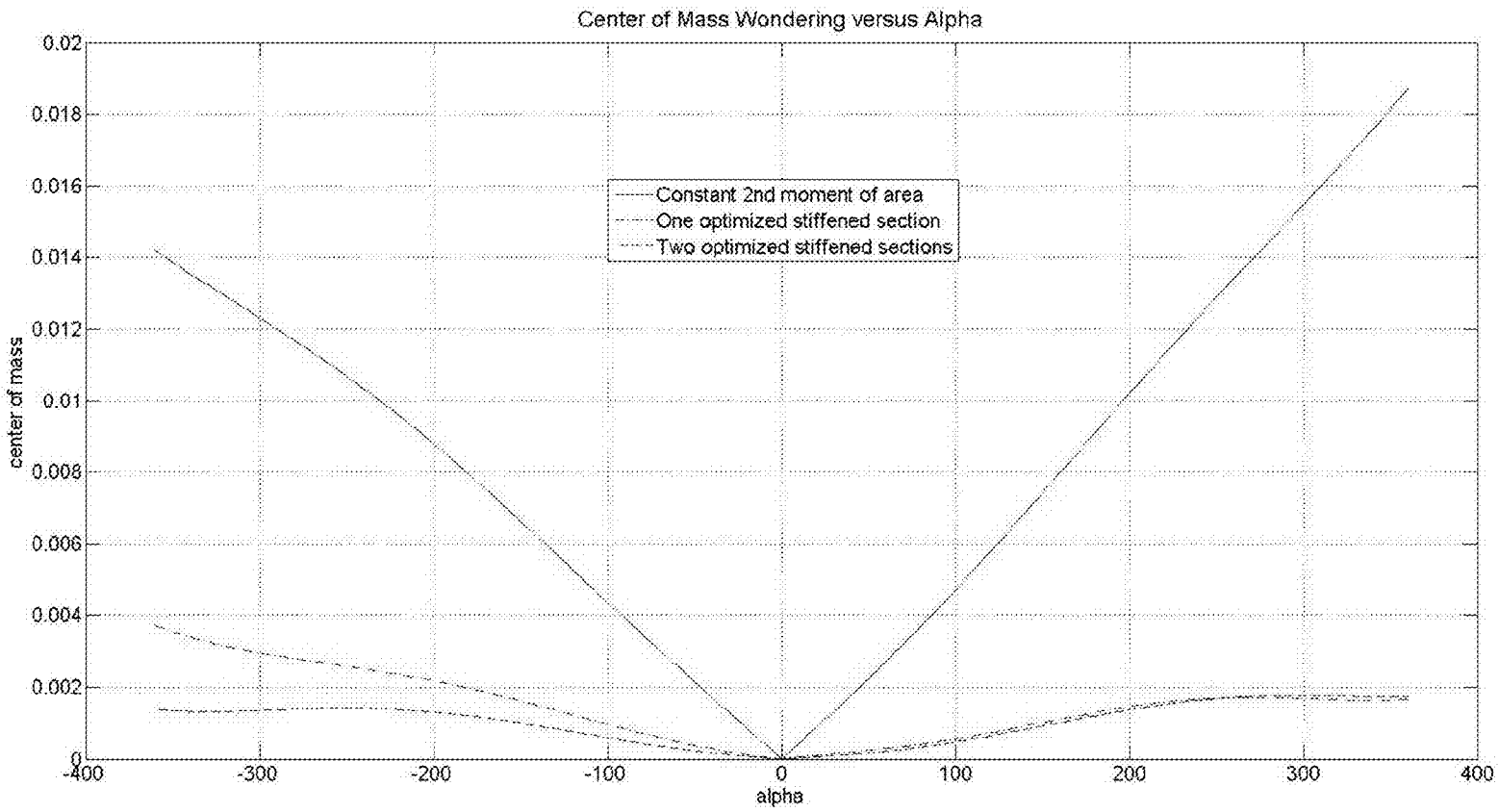
FIG. 8 shows the centre of mass variation versus balance wheel angle with one and two modified sections.

As will be seen from FIG. 8, the reaction force at the stud for the optimized section hairsprings (ii) and (iii) is significantly lower than a hairspring having a constant second moment of area (i).

Furthermore, the results demonstrate that utilizing "two" optimized stiffened sections than the stud reaction force is extremely low between −330 and +330 degree, the typical amplitude of oscillation in a mechanical timepiece.

Referring to FIG. 8, there is shown the magnitude of the center of mass drift variation over α for the same three hairspring designs.

The plots consistently demonstrate that the stud reaction force and center of mass drift magnitudes are reduced by the automatic optimization algorithm for nearly all values of α. The hairspring with two optimized stiffened sections yields the best results due to the greater degree of freedom in design.

Figure 9:
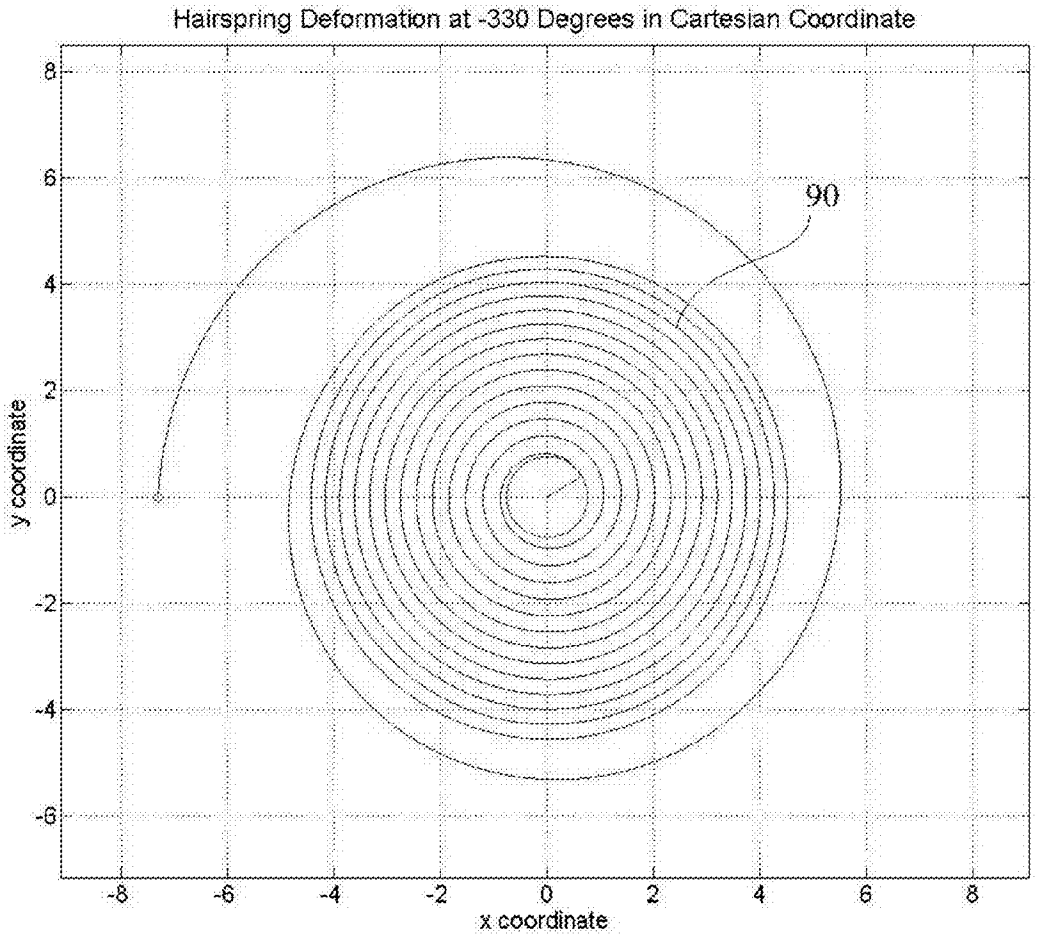
FIG. 9 shows the deformation of the hairspring with one modified section with the balance wheel angle at −330 degrees.
Figure 10:
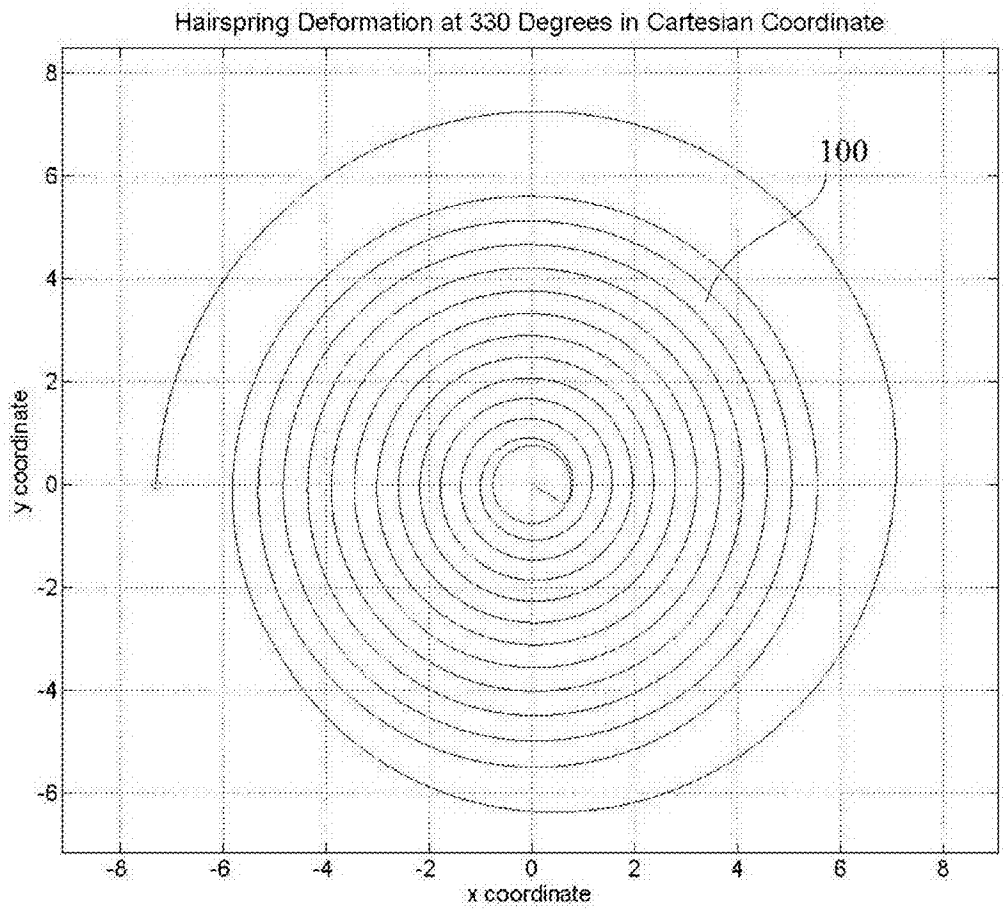
FIG. 10 shows the deformation of the hairspring with one modified section with the balance wheel angle +330 degrees.

With reference to FIG. 9 and FIG. 10, there is demonstrated improvement in concentricity of the hairspring 90, 100 respectively, via the automatic optimization algorithm according to the present invention, whereby the deformation geometry of the hairspring with one optimized stiffened section is shown.

The hairsprings 90 and 100 have their collets rotated by 330 degrees clockwise and counter-clockwise, respectively. The enhanced concentricity is visually noticeable and clearly demonstrated when compared to those of FIG. 2 and FIG. 3.

Figure 11:
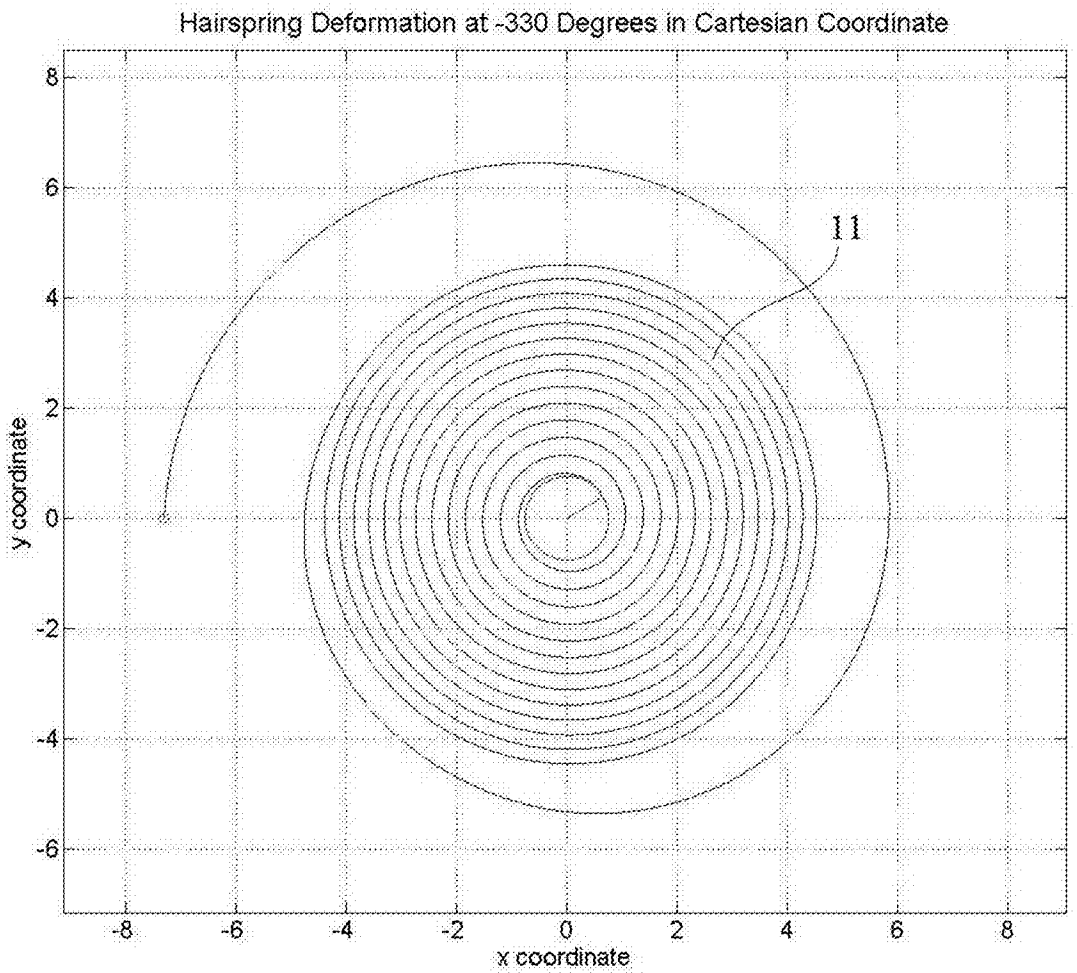
FIG. 11 shows the deformation of the hairspring with two modified sections with the balance wheel angle at −330 degrees.
Figure 12:
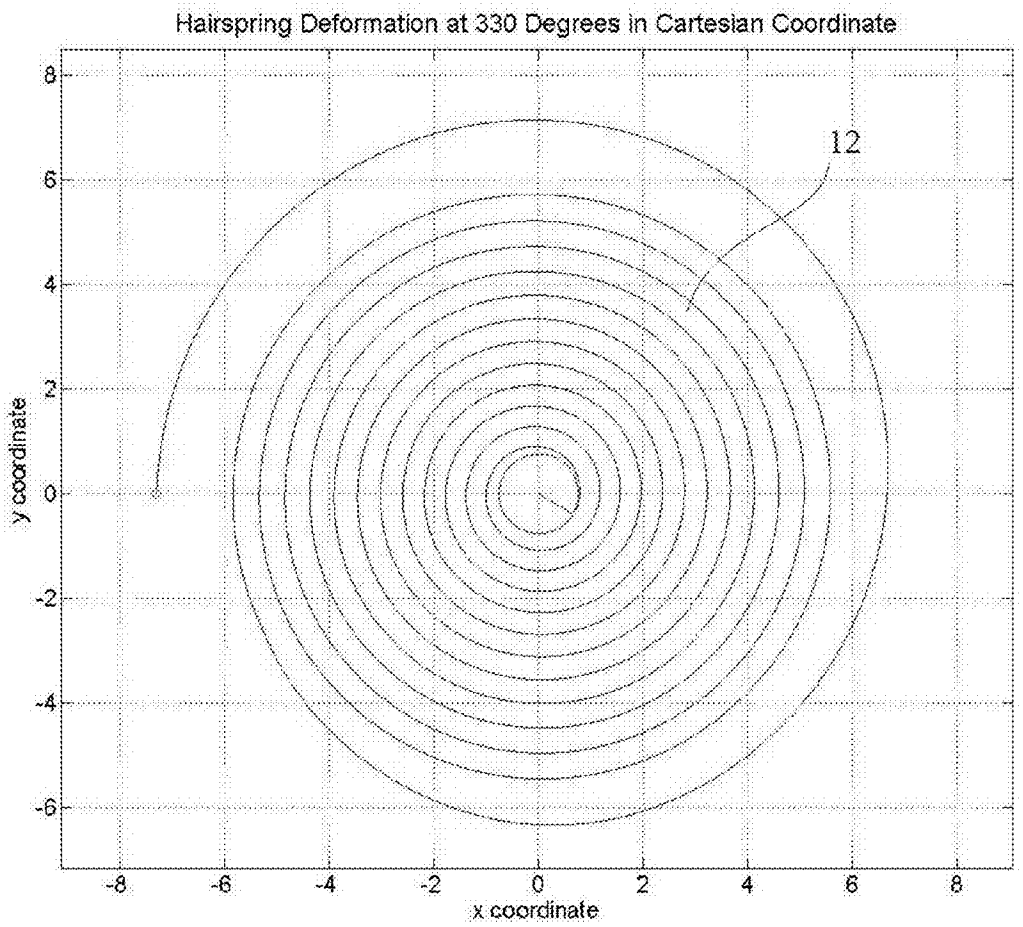
FIG. 12 shows the deformation of the hairspring with two modified sections with the balance wheel angle at +330 degrees.

FIG. 11 and FIG. 12 show the deformation geometry of the hairspring 110, 120, with two optimized stiffened sections. The hairsprings 110 and 120 have their collets rotated by 330 degrees clockwise and counter-clockwise, respectively. The concentricity is a further improvement over the hairspring with one optimized stiffened section shown in comparison with those of FIG. 9 and FIG. 10.

The increased concentricity achieved by the aforementioned automatic optimization algorithm allows the implementation of a novel type of hairspring with multiple arms.

Figure 13:
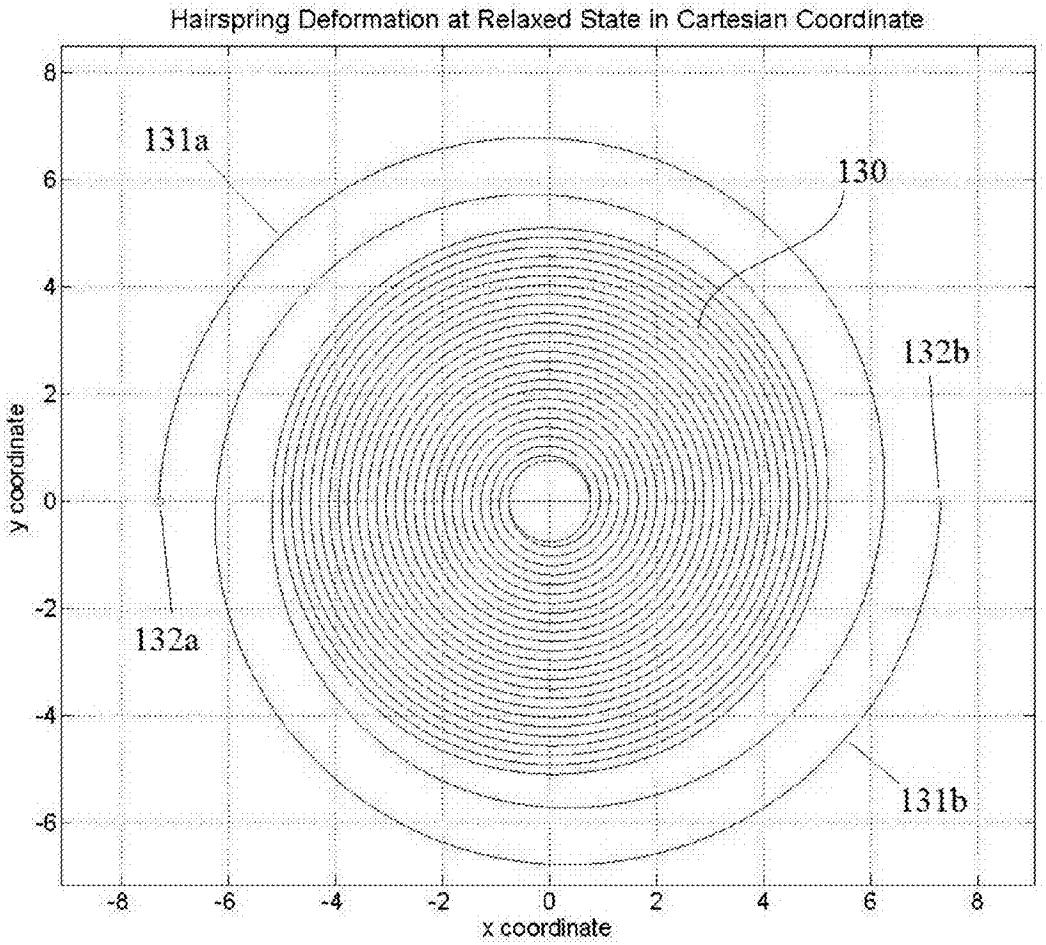
FIG. 13 shows an embodiment of a double-arm hairspring made possible with the improved concentricity with the modified section(s)

Referring now to FIG. 13, an example of a multi-arm hairspring 130 with two arms 131*a* and 131*b* is shown.

The two arms 131*a* and 131*b* extend from a central collet 132. The arms 131*a* and 131*b* terminate at outer terminals 132*a* and 132*b*, respectively. The dual-arm hairspring 130 is axially-symmetric with arm 131*a* being identical to arm 131*b*.

Figure 14:
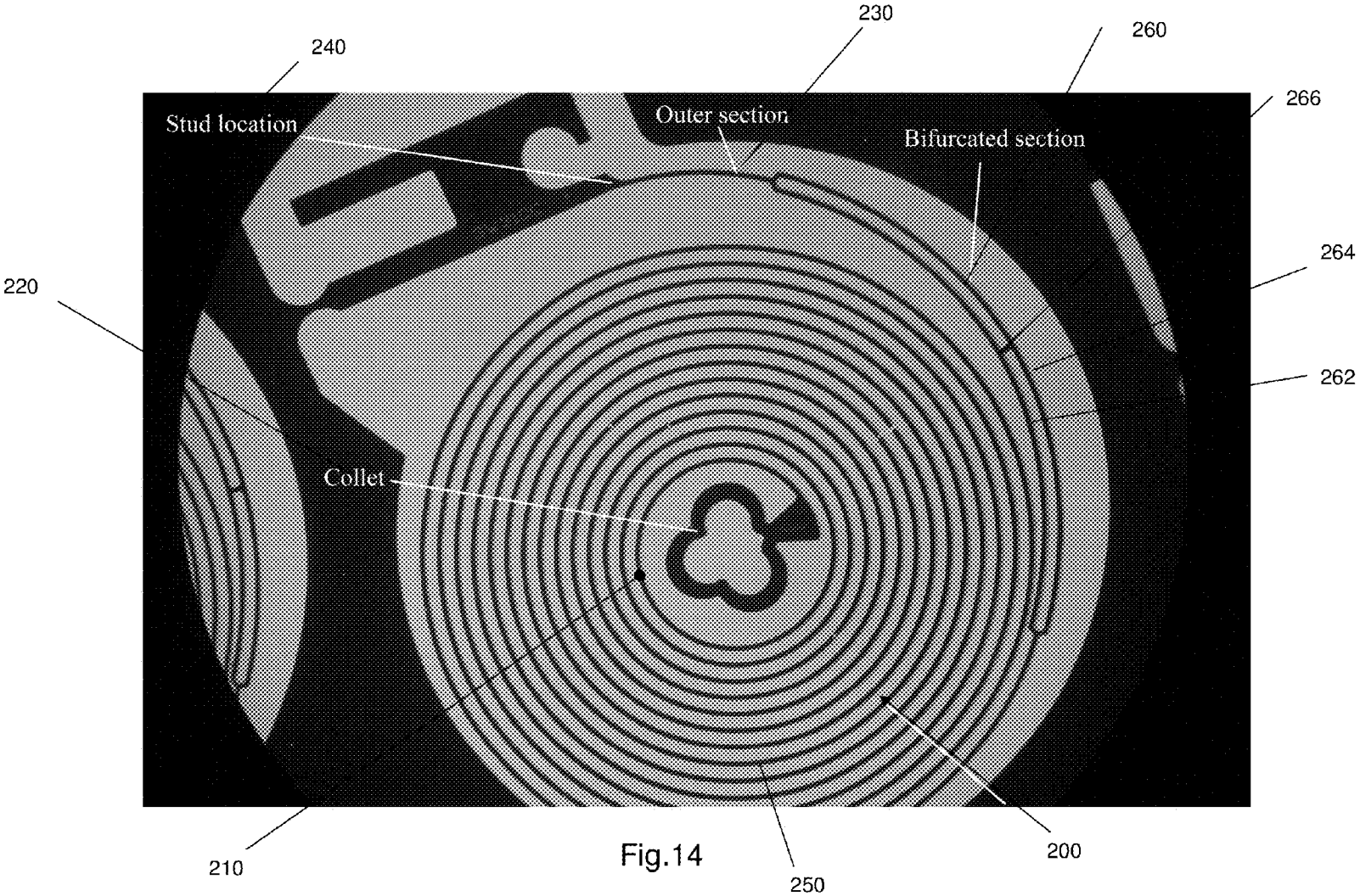
FIG. 14 shows a photographic representation of an exemplarily embodiment of a hairspring according to the present invention.

Referring to FIG. 14, there is shown a photographic representation of an embodiment of a hairspring 200 according to the present invention, suitable for optimization according to the present invention. The hairspring 200 includes an inner terminal portion 210 for engagement with a collet 220 and an outer terminal portion 230 for engagement with a start 240, a first limb portion 250 extending from the inner terminal end portion 210 towards the outer terminal portion 230, and a stiffening portion 260 positioned at the outer turn of the hairspring 200.

In this embodiment, the stiffening portion is a bifurcated section including an inner limb 262 and outer limb 264, and a strut extending therebetween 266.

The stiffening portion 260 is stiffened by increasing the $2^{nd}$ moment of area by utilizing the spaced apart to bifurcated limbs 262, 264, which collectively increase the $2^{nd}$ moment of area in this portion of the spring.

As will be appreciated and understood by those skilled in the art, the $2^{nd}$ moment of area of the bifurcated section, by way of the two limbs 262 and 264 being spaced apart, increases the bending stiffness accordingly.

As will be noted, the cross-sectional dimensions of the first limb portion and the stiffening portion are both the same, and as such, the first limb portion and each of the two limbs of the stiffening portion, 262 and 264, each have the same cross-sectional area.

As such, as the first limb portion and the stiffening portion are formed from the same material and have the same cross-sectional area, and in view of the Young's Modulus being constant due to the hairspring being formed from a single piece of material, the temperature effect on various portions of the hairspring is the same in respect of alteration of Young's Modulus as a function of change in temperature.

The hairspring 200 in the present embodiment is formed by micro-fabrication techniques, which allow for high dimensional accuracy in the production of such items or articles.

The micro-fabrication technique in respect of the present embodiment allows for temperature desensitization, by using a first material having a first Young's Modulus for the formation of the hairspring and a second material as a coating material having a second Young's Modulus, the first and second Young's Moduli having opposite temperature dependencies and as such, the outer coating layer may be suitably sized and have a thickness such that elastic properties of the hairspring are desensitized to temperature variation.

Suitable materials for forming the hairspring according to the present embodiment are silicon, with a silicon dioxide layer.

In order to increase concentricity, and reduce changes in mass effect during expansion and contraction of the hairspring, the stiffening portion is included in the hairspring.

Furthermore, the dimensions of the stiffening portion may be optimized according to the method of the present invention, so as to provide a suitable stiffness such that deformation of the spring is minimized during rotation, wandering mass is reduced. This may be achieved by utilizing a minimization of a cost function as described above in relation to the present invention.

It can be shown that given certain conditions, the 2nd moment of area of the bifurcated section can be designed to be equivalent to that of a stiffened section with increased width.

For example, a hairspring whose nominal width and height are bo and h, respectively. Compare two hairspring sections. One section has a single strip of increased width n times that of the b0. The other section has two bifurcated strips, each of the same width as the nominal value b0 and separated by a distance d as measured from the centerline of each strip.

Assuming d remains constant for the entirety of the bifurcated section, it is possible to use parallel-axis theorem to set d such that the 2nd moment of area with respected to z-axis for both widened and bifurcated sections are identical. The resultant d is computed as follows:

$$d = b_0\sqrt{\frac{n^3 - 2}{6}} \tag{12}$$

Note that if n equals to 2, the bifurcated strips come into contact and becomes a widened strip.

The optimization algorithm may be readily adapted for both the widened and bifurcated sections. In case of the former, the section width is used as one of the design parameters to be varied in the optimization algorithm. In case of the later, the bifurcated strip distance is used as one of the design parameters to be varied. Note that the two methods can be used interchangeably by using Eq. (12).

Note, further details and explanation of the hairspring of the present invention, of which the hairspring 200 is an embodiment thereof, is described further below in reference to FIGS. 20 to 29.

Figure 15:
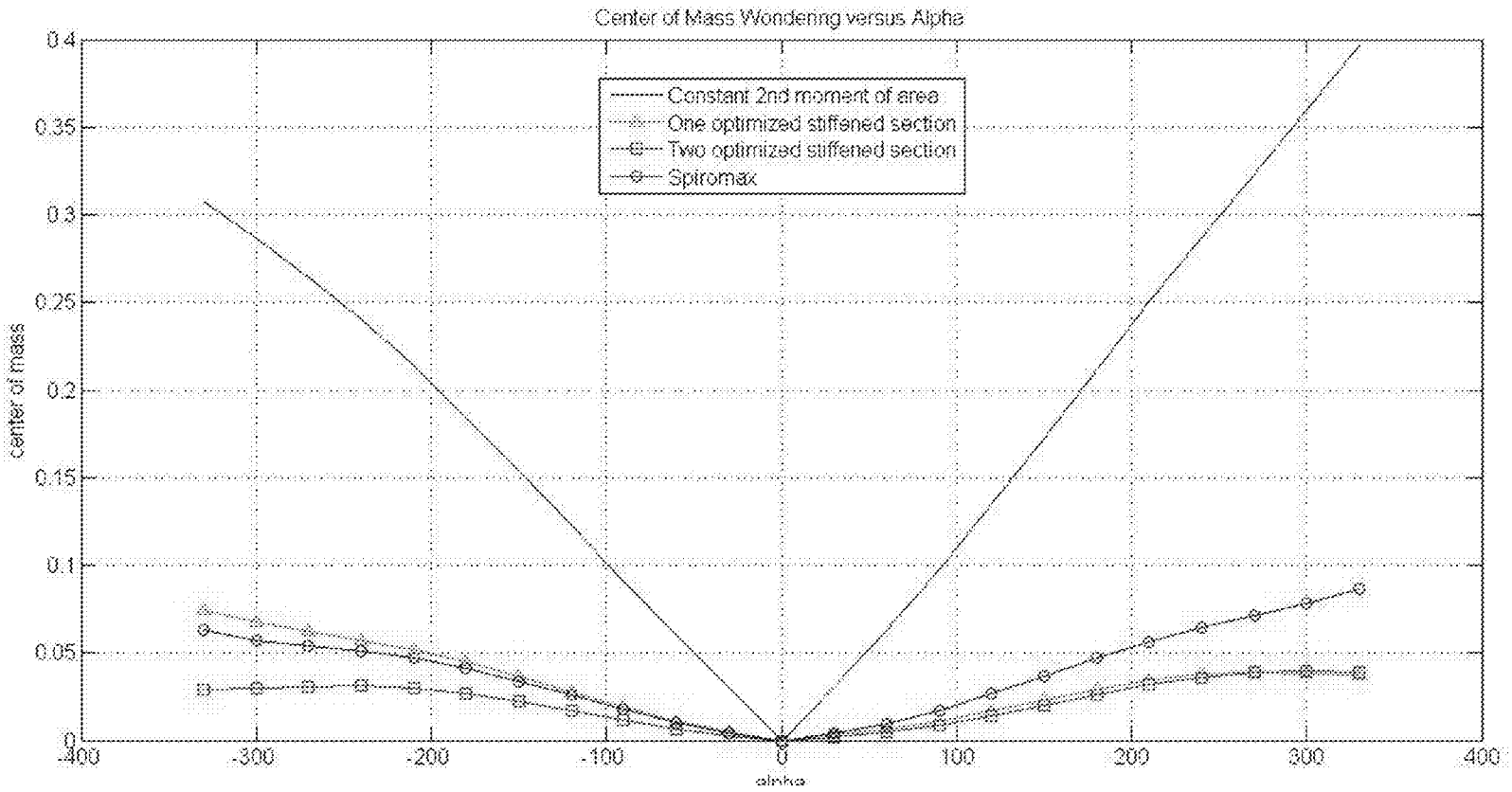
FIG. 15 shows a comparison for wandering centre of mass with respect to the embodiment of FIG. 14.

Referring to FIG. 15, the centre of wandering mass as a function of rotation between −300 and 300 degrees, the typical range of a hairspring, is shown whereby a comparison is made between one optimized stiffened section, two optimized stiffened sections and a Spiromax hairspring according to the prior art.

As will be seen, a two-section optimized stiffened section in accordance with the present invention has a reduced centre of wandering mass in comparison with both a one optimized stiffened position and the Spiromax hairspring.

Figure 16:
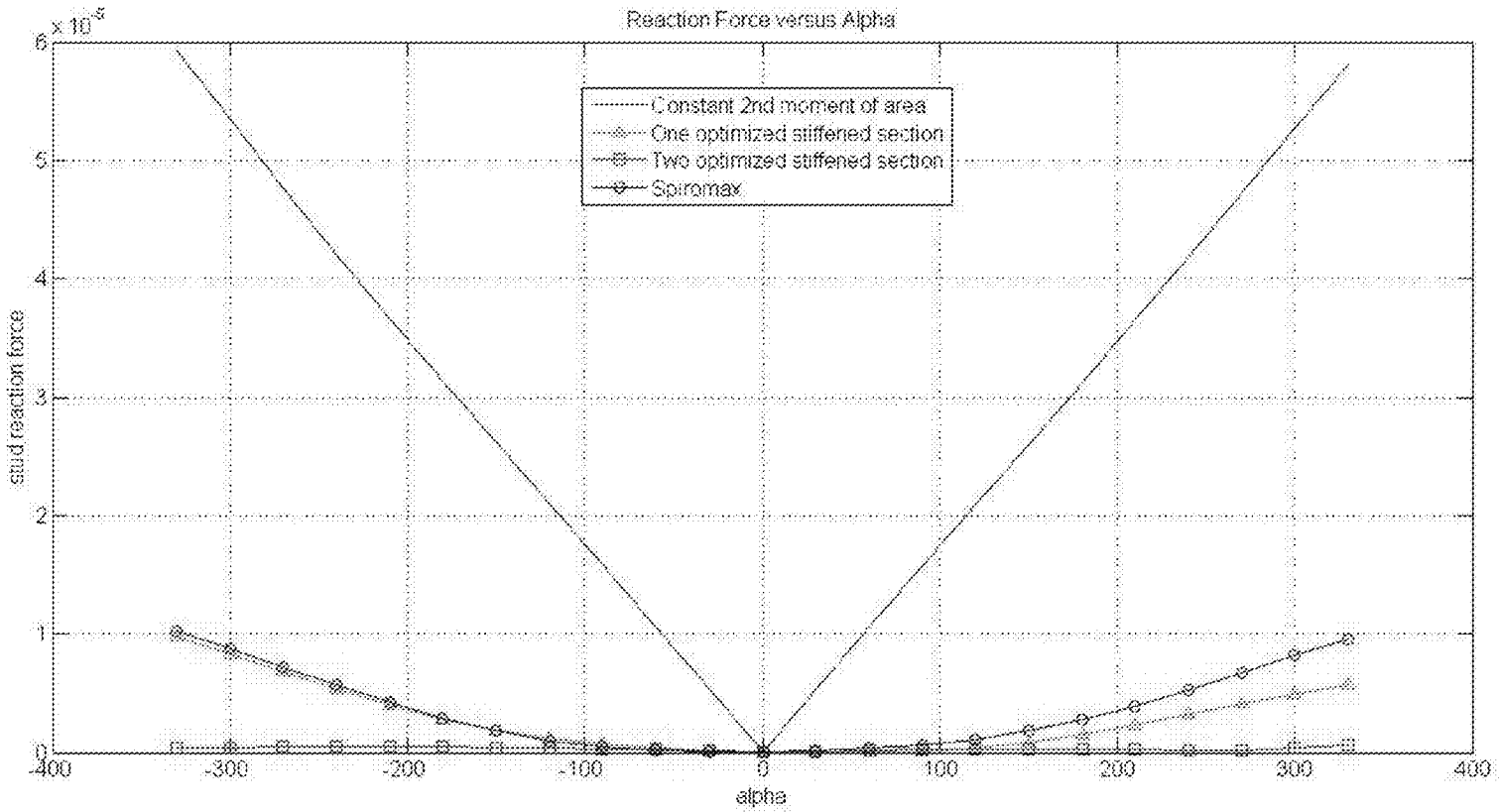
FIG. 16 shows a comparison for stud reaction force with respect to the embodiment of FIG. 14.

Referring to FIG. 16, there is shown a comparison between the reaction force at the start of hairsprings throughout their general range of motion between −330 and 330 degrees whereby a constant 2nd moment of area, a one optimized stiffened portion, a two optimized stiffened portion and Spiromax hairspring is made.

As will be noted, a single optimized stiffened section hairspring for which the stiffness is optimized according to the present invention, has a lower stud reaction force than that of the Spiromax hairspring.

Importantly, however, it is demonstrated that a hairspring having two optimized stiffened portions in accordance with the present invention has a substantially lower stud reaction force, this reaction force being almost zero, in comparison with the other hairspring.

The stud reaction force is indicative of the reaction force at the bearings of the collet, and as will be understood by those skilled in the art, this reduces friction and wear at the collect, and hence increases longevity.

As will be appreciated by those skilled in the art, a hairspring having two optimized stiffened portions according to the present invention results in a hairspring having lower wandering mass and very low reaction force at the stud.

As such, the concentricity of such a hairspring according to the present invention, throughout its angular motion, is increased, thus providing an improved isochronous hairspring for a timepiece accordingly.

Figure 17:
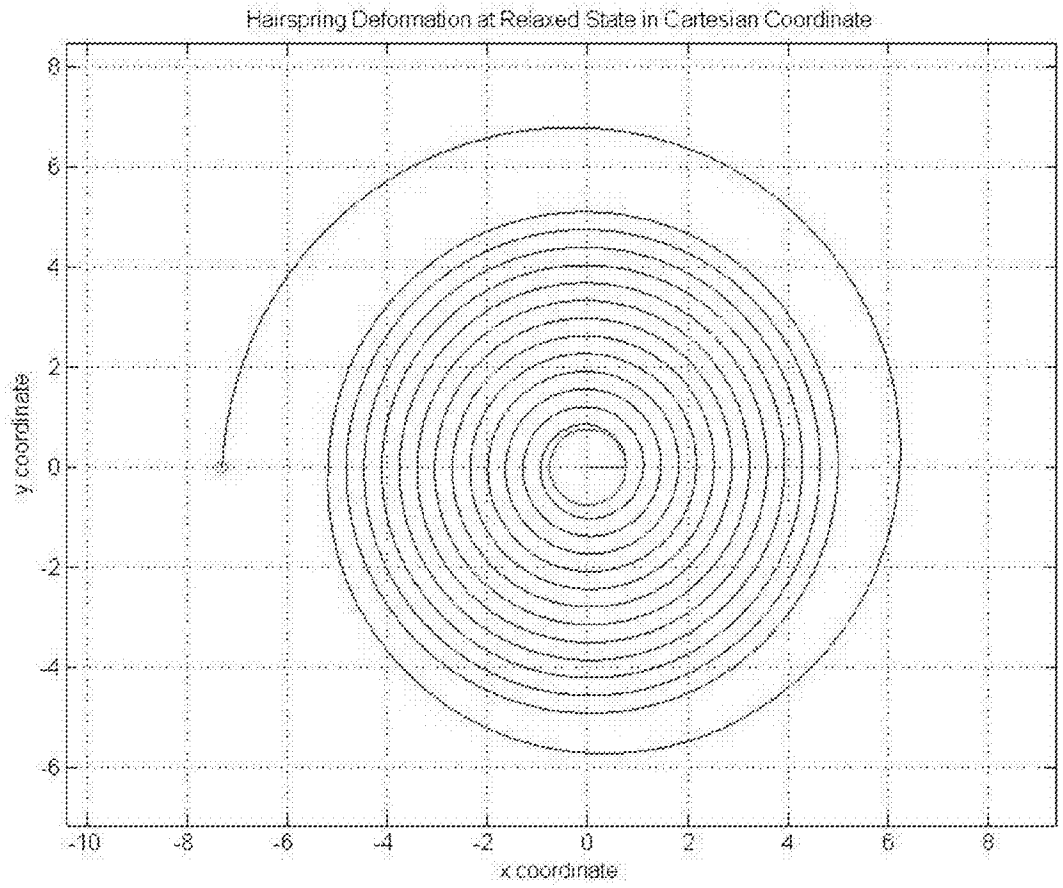
FIG. 17 shows an example of the deformation of an optimised Spiromax hairspring at zero degrees.
Figure 18:
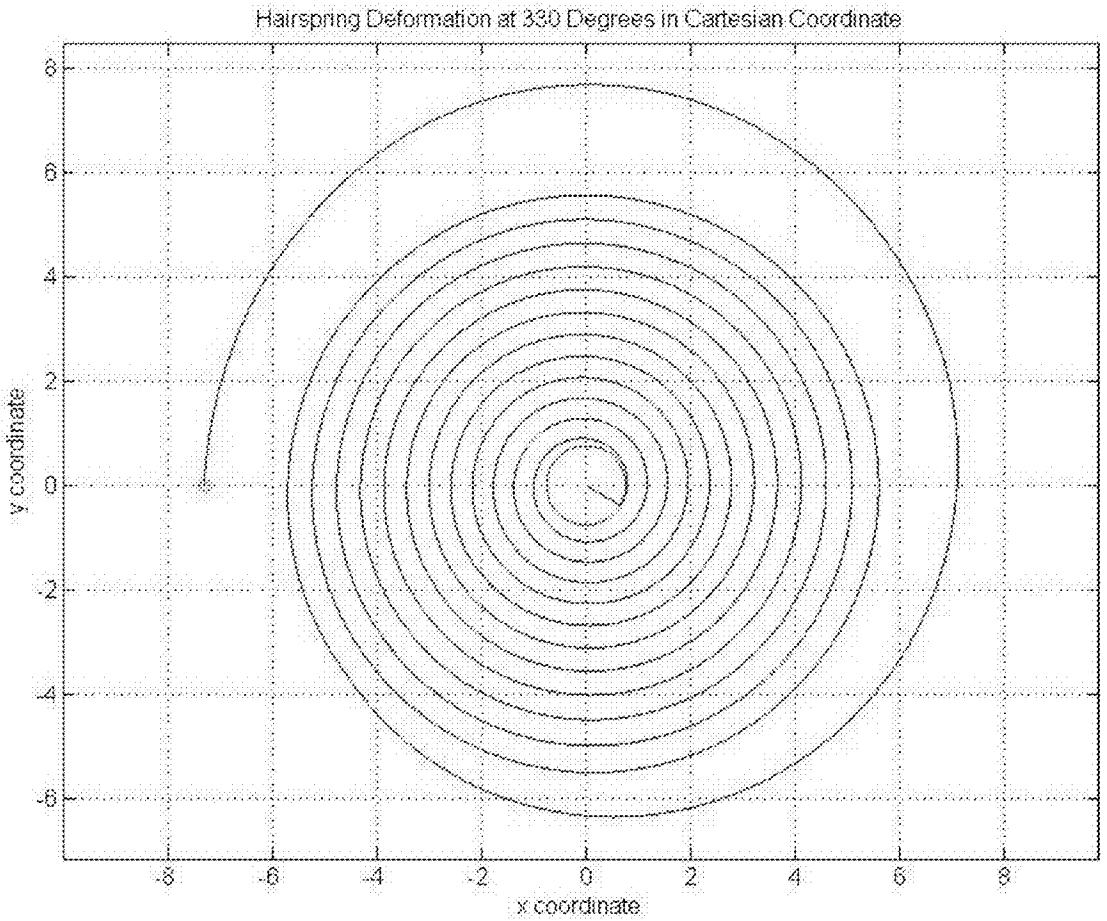
FIG. 18 shows an example of the deformation of an optimised Spiromax hairspring at −330 degrees.
Figure 19:
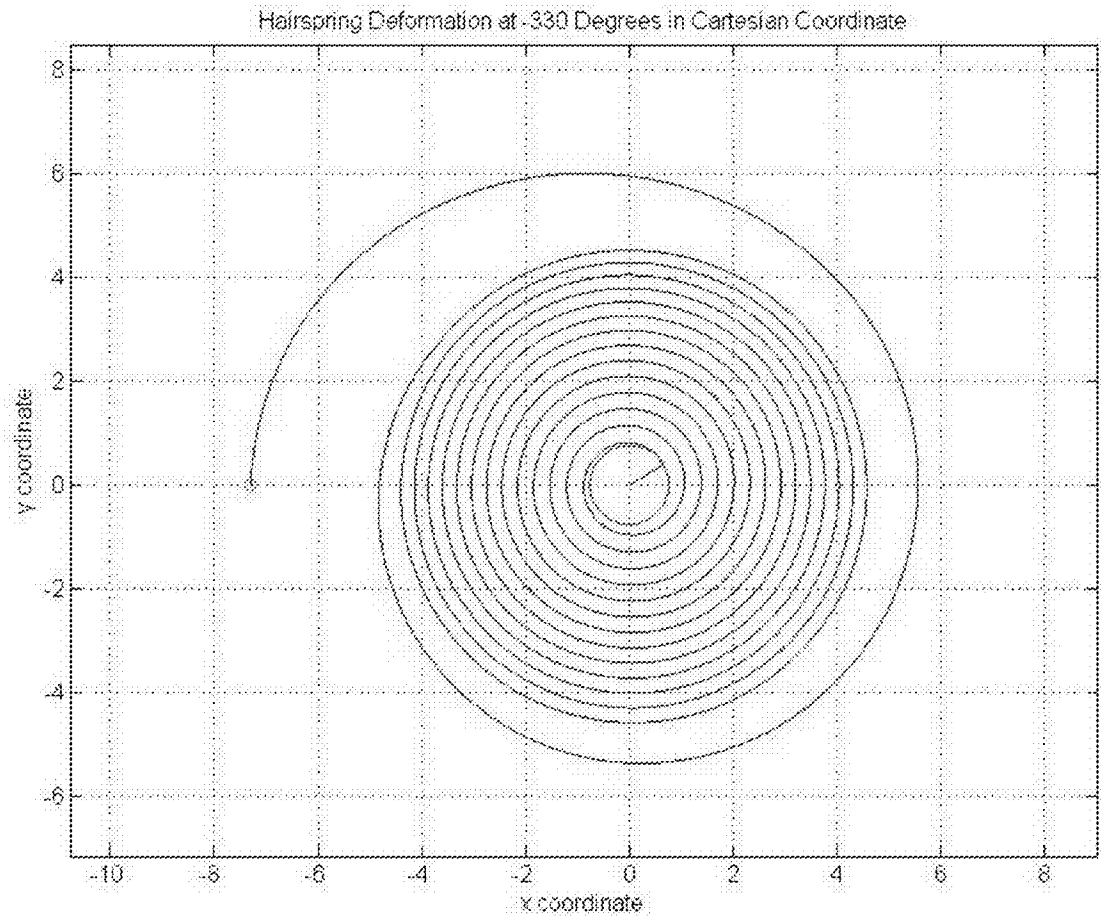
FIG. 19 shows an example of the deformation of an optimised Spiromax hairspring at +300 degrees.

Referring to FIGS. 17, 18 and 19, there is shown the deformation of a Spiraomax type hairspring at 0 degrees −330 degrees and +330 degrees respectively. As will be noted, there exists distortion between the windings, demonstrating wandering of mass, which reduces concentricity throughout use as well as increases reaction force at the collet and the stud, thus resulting in a hairspring with inferior isochronous properties to that of a hairspring in accordance with the present invention, whereby the stiffened portion is an optimized stiffened portion, in particular in comparison to a hairspring having two optimized stiffened portions.

Although designs of hairsprings with three or more arms are more complex to implement, they are theoretically possible with sufficient hairspring concentricity. The axially-symmetric layout of the multi-arm hairspring can further improve isochronism because any radial force imparted by one arm on the collet is neutralized by the net radial force imparted by the other arms. If the effect of gravity is neglected, the balance staff bearings theoretically do not experience any radial force, resulting in an oscillator that is essentially free of bearing friction.

However, a multi-arm hairspring is only feasible with highly concentric designs because traditional hairspring arms tend to move into each other during deformation, increasing the possibility of collision between adjacent arms even for very small balance wheel angle.

The present invention provides a hairspring for a timepiece which may be produced with high dimensional and mechanical accuracy, by use of micro-fabrication techniques.

The hairspring according to the present invention provides increased concentricity by providing a stiffening position which reduces wandering of the mass of the hairspring about the axis of rotation during use, such reduction in wandering reduces radial inertial effects of the hairspring due to acceleration and motion, thus reducing radial forces at the central bearing.

Furthermore, being temperature desensitized, the hairspring according to the present invention provides increased isochronousity.

This has the effect of increasing the isochronousity of the hairspring and oscillator mechanism, thus providing a hairspring of greater position for timekeeping purposes.

Furthermore, reduction in radial forces also reduces friction on the bearing located at the centre of the oscillator assembly, which also increases isochronousity as frictional forces impact upon the motion of the oscillator, as well as reducing wear and damage to the bearing.

This results in a hairspring oscillator mechanism having increased longevity, as well as requiring less servicing and maintenance due to the wear of components. Increasing concentricity during motion results in an increase in isochronousity due to reduction in a non-linear second-order system, as well as reducing the tendency for turnings of a hairspring to engage with each other during compression and expansion of the hairspring, engagement of intermediate turns with adjacent turns of the hairspring and collision alters the mechanical properties of the hairspring, which has significant adverse effect on the isochronousity.

Furthermore, collision and impact of adjacent intermediate turnings may result in damage and potential failure to the hairspring, again reducing reliability of the hairspring as well as increasing costs due to maintenance and repair.

Referring to the hairspring 200 above as described with reference to FIG. 14, this aspect of the invention of which the hairspring 200 is an embodiment thereof, is described further below in reference to FIG. 20 to FIG. 29.

In order to describe the manner in which features of the present invention behave, an explanation utilizing solid mechanics theory, in particular utilizing the statics of a cantilever beam using the Euler-Bernoulli beam formula is provided with reference to FIGS. 20 to 23*c*.

Although this formula and accompanying theory is strictly-speaking based on a straight cantilever beam model, the formula also provides reasonably accurate results for spiral-shaped hairspring with slender strips because the vast majority of a typical hairspring's restoring torque comes from the bending of its strip.

For this reason, the Euler-Bernoulli beam formula is widely used in the watch industry to estimate the hairspring bending stiffness.

Figure 20:
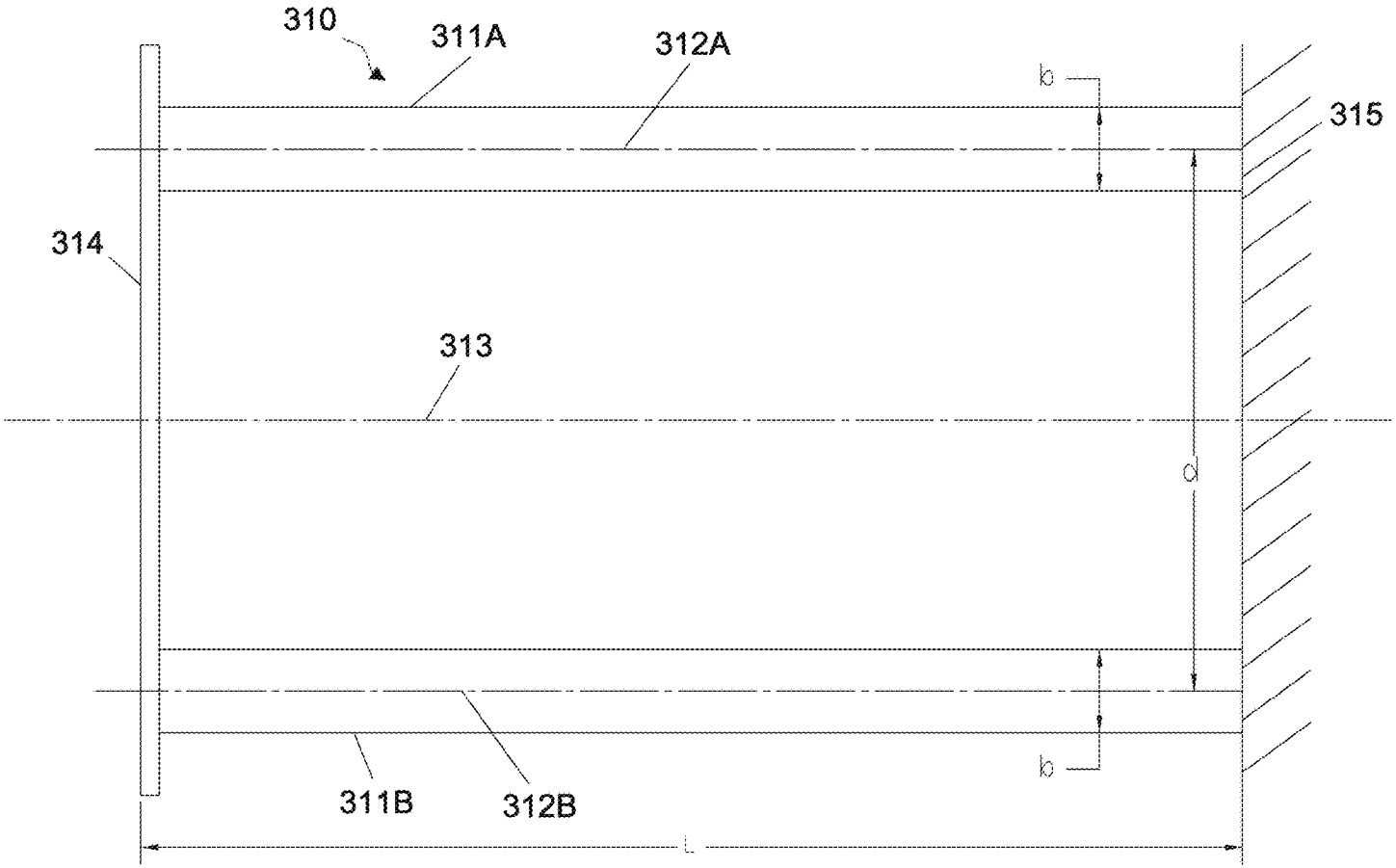
FIG. 20 shows a cantilever structure having two beams connected in a side-by-side configuration illustratively.

Referring to FIG. 20, there is shown a cantilever structure 310 comprised of two beams 311A, 311B connected side-by-side in parallel. It must be emphasized that the term "parallel" is utilized throughout the specification, this term is understood to extend to elements of a structure connected in a side-by-side layout, which is not necessarily parallel in the strict geometric definition.

An analysis of this cantilever structure 310 demonstrates its effect on the structure's bending stiffness, defined as the ratio between the applied moment and a beam's resultant deflection.

The right end of the cantilever structure 310 has a clamped boundary condition 315, resisting displacement and rotation. The left end of the cantilever structure 310 is free but has a plate 314 affixed to both beams 311A, 311B to ensure that they bend together and cannot translate or rotate with respect to each other. The two beams 311A, 311B each have a length of L, width of b, and height of h. The two beams 311A, 311B are also separated by a constant distance of d when measured from their centerlines 312A, 312B. The cantilever structure 310 also has a neutral axis 313, which in this case is equidistant between the beam centerlines 312A, 312B.

The cantilever structure 310 has a higher bending stiffness when compared to a single cantilever beam of the same length and cross-section as each of the beams 311A, 311B due to the two following reasons:

(i) the cantilever structure 310 has a larger cross-section area than a single beam; and (ii) the two beams 312A, 312B of the cantilever structure 310 are located further away from the neutral axis 313, thereby increasing the second moment of area and hence providing a greater bending stillness.

The bending stiffness $k_1$ of a single beam 311A, 311B can be computed using the Euler-Bernoulli beam formula as follows with the Young's modulus denoted by E.

$$k_1 = \frac{Ehb^3}{12L} \tag{13}$$

The distance d is redefined to be nb where n is the ratio d:b for simplification of equation. In contrast, the bending stiffness $k_2$ of the cantilever structure 310 can be computed by further using the parallel axis theorem as follows:

$$k_2 = \frac{Ehb^3}{2L}\left(\frac{1}{3} + n^2\right) \tag{14}$$

Assuming the cantilever structure 310 is planar, the value of n must be greater than 1 or the two beams 311A, 311B will overlap.

As will be appreciated by those skilled in the art, the minimum feasible value of $k_2$ always greater than $k_1$ for a planar cantilever structure 310. In fact, the minimum feasible value of $k_2$, defined as $k_{2,min}$, is eight times the value of $k_1$.

In accordance with the present invention, it will be understood by those skilled in the art that it is possible to set $k_1<k_2<k_{2,min}$ by adjusting the strip length L which may be implemented using existing micro-fabrication technology.

Equations (13) and (14) show the effectiveness of increasing the cantilever structure's 310 bending stiffness by arranging two beams 311A, 311B in a side-by-side arrangement.

The parallel axis theorem may also be applied to a cantilever structure 310 having more than two beams 311A, 311B in a side-by-side layout and yield the same conclusion.

The same conclusion can also be drawn from cantilever structure 310 with side-by-side beams 311A, 311B even when the beam distance d is not constant, although the derivation of the structure's 310 bending stiffness will be more complex and require techniques such as calculus for computation.

To illustrate the merit of the side-by-side strip design in thermo-compensation, the effect on the Young's modulus of a silicon dioxide coating on a silicon beam is described and illustrated with reference to FIGS. 21*a* and 21*b*. This illustrational analysis only takes into consideration of the sensitivity of the Young's modulus to temperature variations and does not include the effect of thermal expansion.

As the effect of temperature on Young's Modulus is a few orders of magnitude greater than that of the thermal expansion effects, utilising only thermal effects on Young's modulus is considered to yield this reasonably robust and substantially the same results.

Figure 21A:
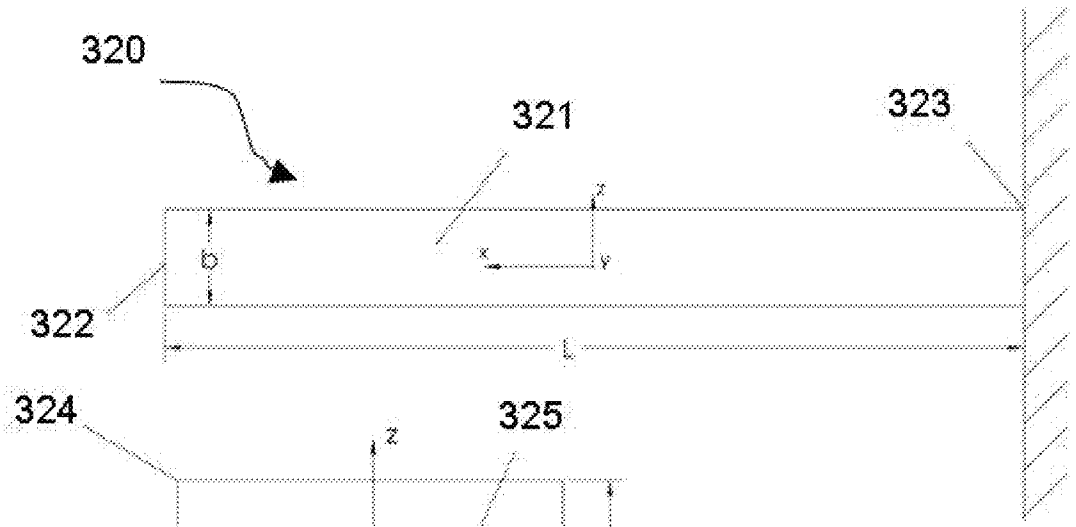
FIG. 21*a* shows a cantilever structure having a single beam having a uniform cross-section.
Figure 21B:
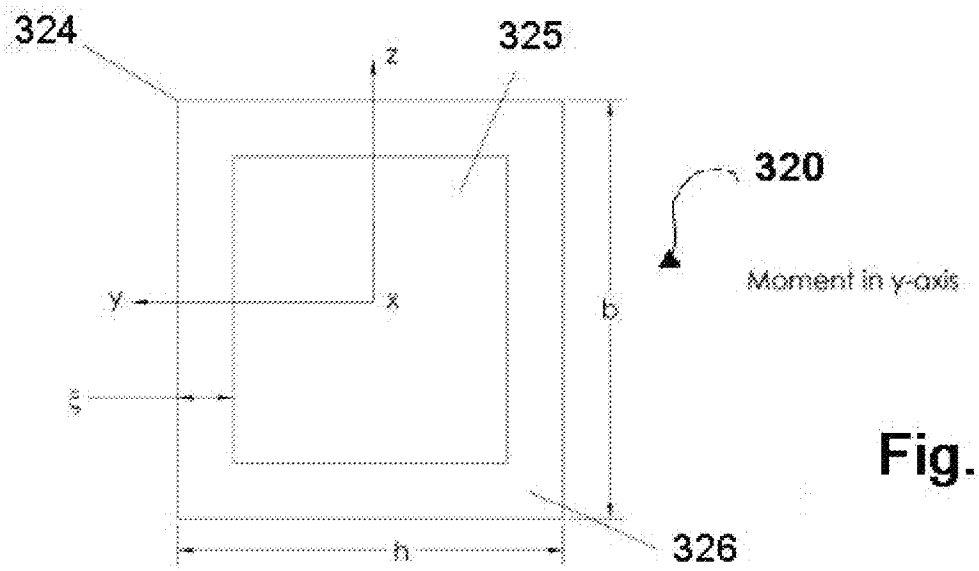
FIG. 21*b* shows a cross-sectional view of the cantilever structure as depicted in FIG. 21*a;*

Referring to FIGS. 21*a* and 21*b*, there is shown a cantilever structure 320 having a single beam 321 of uniform cross-section with all reference coordinates based on the right-hand rule of solid mechanics. The beam 321 has a width of b, height of h, and length of L. The left end 322 is free, and the right end 323 is clamped. The cross-section 324 of the beam 321 shows a silicon core 325 with a silicon dioxide coating 326 of thickness ζ.

The Young's moduli of silicon and silicon dioxide can be approximated by a linear function with respect to temperature change given as follows:

$$E_{Si}(\Delta T)=E_{Si,0}(1+e_{Si}\Delta T) \tag{15}$$

$$E_{SiO_2}(\Delta T)=E_{SiO_2,0}(1+e_{SiO_2}\Delta T) \tag{16}$$

In Equations (15) and (16), $E_{Si,0}$, $E_{SiO2,0}$, $e_{Si}$, and $e_{SiO2}$ are all constants, and ΔT is the temperature change. The constants $E_{Si,0}$, $E_{SiO2,0}$, $e_{Si}$, and $e_{SiO2}$ have a numerical value of approximately 148 GPa, 72.4 GPa, −60 ppm/K, and 215 ppm/K at room temperature, respectively.

The constants $e_{Si}$ and $e_{SiO2}$ have the opposite sign, and this indicates that the Young's modulus of silicon decreases with temperature rise while that of silicon dioxide increases.

Assuming the cantilever structure 20 in FIGS. 21*a* and 21*b* is subjected to a moment in the y-axis, the equivalent Young's modulus of the composite beam 321 can be computed as follows:

$$E_{eq}(\Delta T) = [E_{Si}(\Delta T) - E_{SiO_2}(\Delta T)]\left(1 - \frac{2\varsigma}{b}\right)^3\left(1 - \frac{2\varsigma}{h}\right) + E_{SiO_2}(\Delta T) \tag{17}$$

Differentiating with respect to ΔT and substituting Equations (15) and (16), Equation (5) becomes as follows:

$$\frac{dE_{eq}(\Delta T)}{d\Delta T} = (E_{Si,0}e_{Si} - E_{SiO_2,0}e_{SiO_2})\left(1 - \frac{2\varsigma}{b}\right)^3\left(1 - \frac{2\varsigma}{h}\right) + E_{SiO_2,0}e_{SiO_2} \tag{18}$$

Equation (18) describes the sensitivity of the $E_{eq}$ with respect to ΔT, and to achieve total thermo-compensation, it needs to be set to zero by varying ζ.

For a wide range of aspect ratio, defined as b:h, the optimal ζ:b ratio is fairly stable at approximately 6% for a cross-section with a silicon core and silicon dioxide coating. The results demonstrate that total thermo-compensation is theoretically feasible for a silicon hairspring of uniform cross-section via a coating of silicon dioxide.

The same conclusion cannot be drawn for a hairspring of variable cross-section. This can be proven by a simple cantilever beam example with two distinct cross-sections.

Figure 22A:
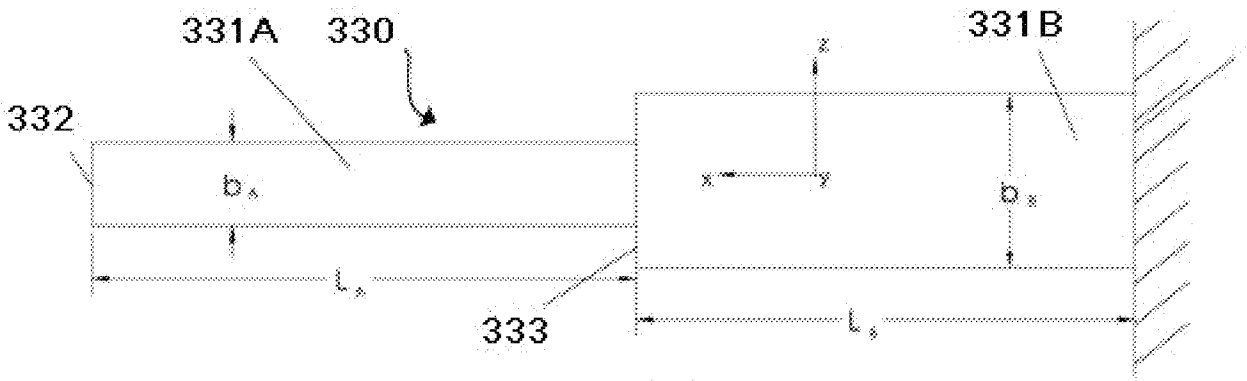
FIG. 22*a* shows a cantilever structure having two beams of different cross-section connected in a series arrangement.
Figure 22C:
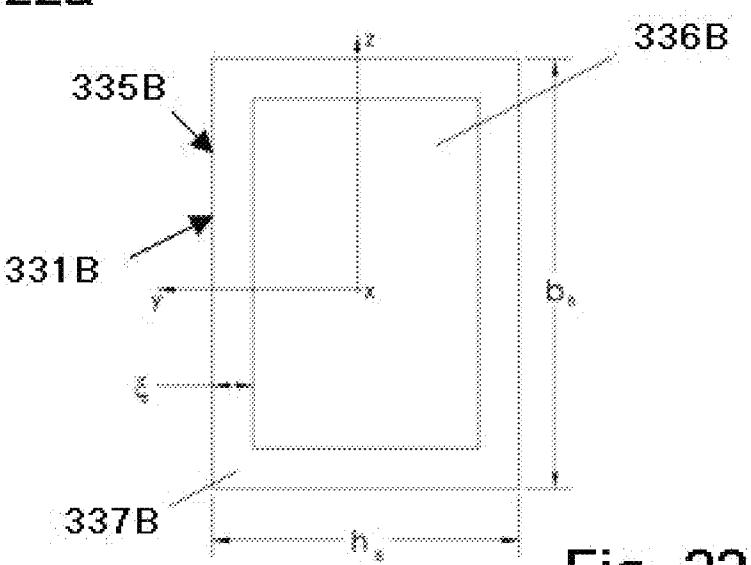
FIG. 22*c* shows a cross-sectional view of the cantilever structure as depicted in FIG. 21*a* through the second of the two beams.
Figure 22B:
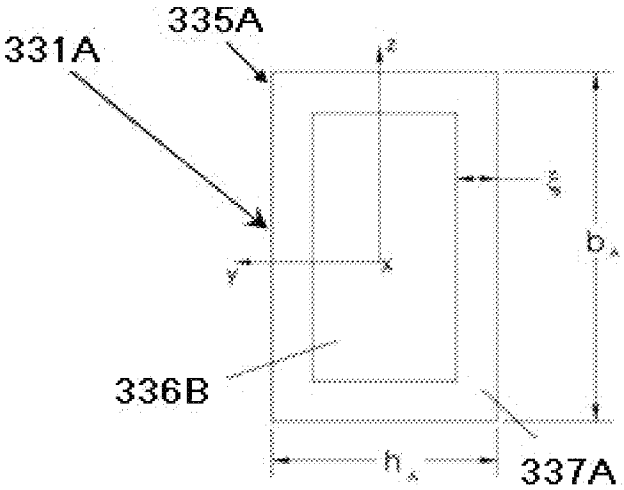
FIG. 22*b* shows a cross-sectional view of the cantilever structure as depicted in FIG. 22*a* through the first of the two beams.

Referring to FIGS. 22*a*, 22*b* and 22*c*, there is shown a cantilever structure 330 having two beams 331A, 331B of different cross-sections 334A, 334B, in series. All reference coordinates are based on the right-hand rule according to established solid mechanics.

The beam 331A has a free end 332 at its left end and is engaged with a beam 331B at its right end 333. The beam 331B is attached to beam 331A at its left end 333 and has a clamped boundary condition 334 at its right end. The beam 331A has a width of $b_A$, a height of $h_A$, and a length of $L_A$, and the beam 331B has a width of $b_B$, a height of $h_B$, and a length of $L_B$.

The cross-section 335A of the beam 331A shows a silicon core 336A with a silicon dioxide coating 337A of thickness ζ, and the cross-section 335B of the beam 331B shows a silicon core 336B with a silicon dioxide coating 337B also of thickness ζ. Both cross-sections 335A, 335B have the same silicon dioxide coating thickness as current micro-fabrication technology cannot achieve variable coating thickness on the same component.

Assuming the cantilever structure 330 is subjected to a moment in the y-axis, the equivalent Young's modulus of each of the beams 331A, 331B can be computed as follows:

$$E_{eq,A}(\Delta T)=E_{A,0}(\zeta)[1+e_A(\zeta)\Delta T] \tag{19}$$

$$E_{eq,B}(\Delta T)=E_{B,0}(\zeta)[1+e_B(\zeta)\Delta T] \tag{20}$$

It is noted that $E_{eq,A}(\Delta T)$ and $E_{eq,B}(\Delta T)$ corresponds to the equivalent Young's moduli for beams 331A and 331B, respectively. The terms $E_{A,0}(\zeta)$, $E_{B,0}(\zeta)$, $e_A(\zeta)$, and $e_B(\zeta)$ can be expanded according to Equation (15), (16), and (17) as follows:

$$E_{A,0}(\zeta) = \left(1 - \frac{2\zeta}{b_A}\right)^3\left(1 - \frac{2\zeta}{h_A}\right)(E_{Si,0} - E_{SiO_2,0}) + E_{SiO_2,0} \tag{21}$$

$$E_{B,0}(\zeta)=\left(1-\frac{2\zeta}{b_B}\right)^3\left(1-\frac{2\zeta}{h_B}\right)(E_{Si,0}-E_{SiO_2,0})+E_{SiO_2,0} \tag{22}$$

$$e_A(\zeta)=\frac{\left(1-\frac{2\zeta}{b_A}\right)^3\left(1-\frac{2\zeta}{h_A}\right)(E_{Si,0}e_{Si}-E_{SiO_2,0}e_{SiO_2})+E_{SiO_2,0}e_{SiO_2}}{\left(1-\frac{2\zeta}{b_A}\right)^3\left(1-\frac{2\zeta}{h_A}\right)(E_{Si,0}-E_{SiO_2,0})+E_{SiO_2,0}} \tag{23}$$

$$e_B(\zeta)=\frac{\left(1-\frac{2\zeta}{b_B}\right)^3\left(1-\frac{2\zeta}{h_B}\right)(E_{Si,0}e_{Si}-E_{SiO_2,0}e_{SiO_2})+E_{SiO_2,0}e_{SiO_2}}{\left(1-\frac{2\zeta}{b_B}\right)^3\left(1-\frac{2\zeta}{h_B}\right)(E_{Si,0}-E_{SiO_2,0})+E_{SiO_2,0}} \tag{24}$$

The bending stiffness of each of the beams 331A, 331B can be computed using the Euler-Bernoulli beam formula as follows:

$$K_A(\Delta T)=K_{A,0}(\zeta)[1+e_A(\zeta)\Delta T] \tag{25}$$

$$K_B(\Delta T)=K_{B,0}(\zeta)[1+e_B(\zeta)\Delta T] \tag{26}$$

Note that $K_A(\Delta T)$ and $K_B(\Delta T)$ are the bending stiffness of the beams 331A and 331B, respectively. The terms $K_{A,0}(\zeta)$, $K_{B,0}(\zeta)$, $k_A(\zeta)$, and $k_B(\zeta)$ can be expanded as follows:

$$K_{A,0}(\zeta)=\frac{E_{A,0}(\zeta)b_A^3h_A}{12L_A} \tag{27}$$

$$K_{B,0}(\zeta)=\frac{E_{B,0}(\zeta)b_B^3h_B}{12L_B} \tag{28}$$

As the two beams 331A, 331B are connected in series, their equivalent stiffness may be computed as follows:

$$K_{eq}(\Delta T)=\frac{K_A(\Delta T)K_B(\Delta T)}{K_A(\Delta T)+K_B(\Delta T)}=\frac{K_{A,0}(\zeta)K_{B,0}(\zeta)[1+e_A(\zeta)\Delta T][1+e_B(\zeta)\Delta T]}{K_{A,0}(\zeta)[1+e_A(\zeta)\Delta T]+K_{B,0}(\zeta)[1+e_B(\zeta)\Delta T]} \tag{29}$$

Differentiating with respect to ΔT and substituting Equations (25) and (26), Equation (17) becomes as follows"

$$\frac{dK_{eq}(\Delta T)}{d\Delta T}=\frac{N_2(\zeta)\Delta T^2+N_1(\zeta)\Delta T+N_0(\zeta)}{D_2(\zeta)\Delta T^2+D_1(\zeta)\Delta T+D_0(\zeta)} \tag{30}$$

Equation (30) describes the sensitivity of the $K_{eg}$ with respect to ΔT, and the coefficients $N_2$, $N_1$, $N_0$, $D_2$, $D_1$, and $D_0$ are defined as follows.

$$N_2(\zeta)=K_{A,0}K_{B,0}e_A(\zeta)e_B(\zeta)[K_{A,0}e_A(\zeta)+K_{B,0}e_B(\zeta)] \tag{31}$$

$$N_1(\zeta)=2K_{A,0}K_{B,0}e_A(\zeta)e_B(\zeta)(K_{A,0}+K_{B,0}) \tag{32}$$

$$N_0(\zeta)=K_{A,0}K_{B,0}\,[K_{A,0}e_B(\zeta)+K_{B,0}e_A(\zeta)] \tag{33}$$

$$D_2(\zeta)=[K_{A,0}e_A(\zeta)+K_{B,0}e_B(\zeta)]^2 \tag{34}$$

$$D_1(\zeta)=2\{K_{A,0}^2e_A(\zeta)+K_{A,0}K_{B,0}[e_A(\zeta)+e_B(\zeta)]+K_{B,0}^2e_B(\zeta)\} \tag{35}$$

$$D_0(\zeta)=(K_{A,0}+K_{B,0})^2 \tag{36}$$

To achieve total thermo-compensation, the silicon dioxide coating thickness must be set such that Equation (30) becomes zero for all values of ΔT. Assuming the denominator of Equation (30) is non-zero, it becomes only necessary to set the numerator of Equation (30) to zero for all values of ΔT.

However, the numerator of Equation (30) is a quadratic function of ΔT, meaning the numerator can equal to zero for only two values of ΔT. Equation (30) proves that total thermo-compensation is impossible for a cantilever structure 330 with two beams 331A, 331B of different cross-section, in series.

A similar analysis performed on a cantilever structure with discretely or continuously variable cross-section will yield the same conclusion, proving that total thermo-compensation is theoretically impossible for a silicon hairspring of variable cross-section.

In contrast, total thermo-compensation is theoretically feasible for a hairspring with side-by-side strips.

Figures 23A, 23B:
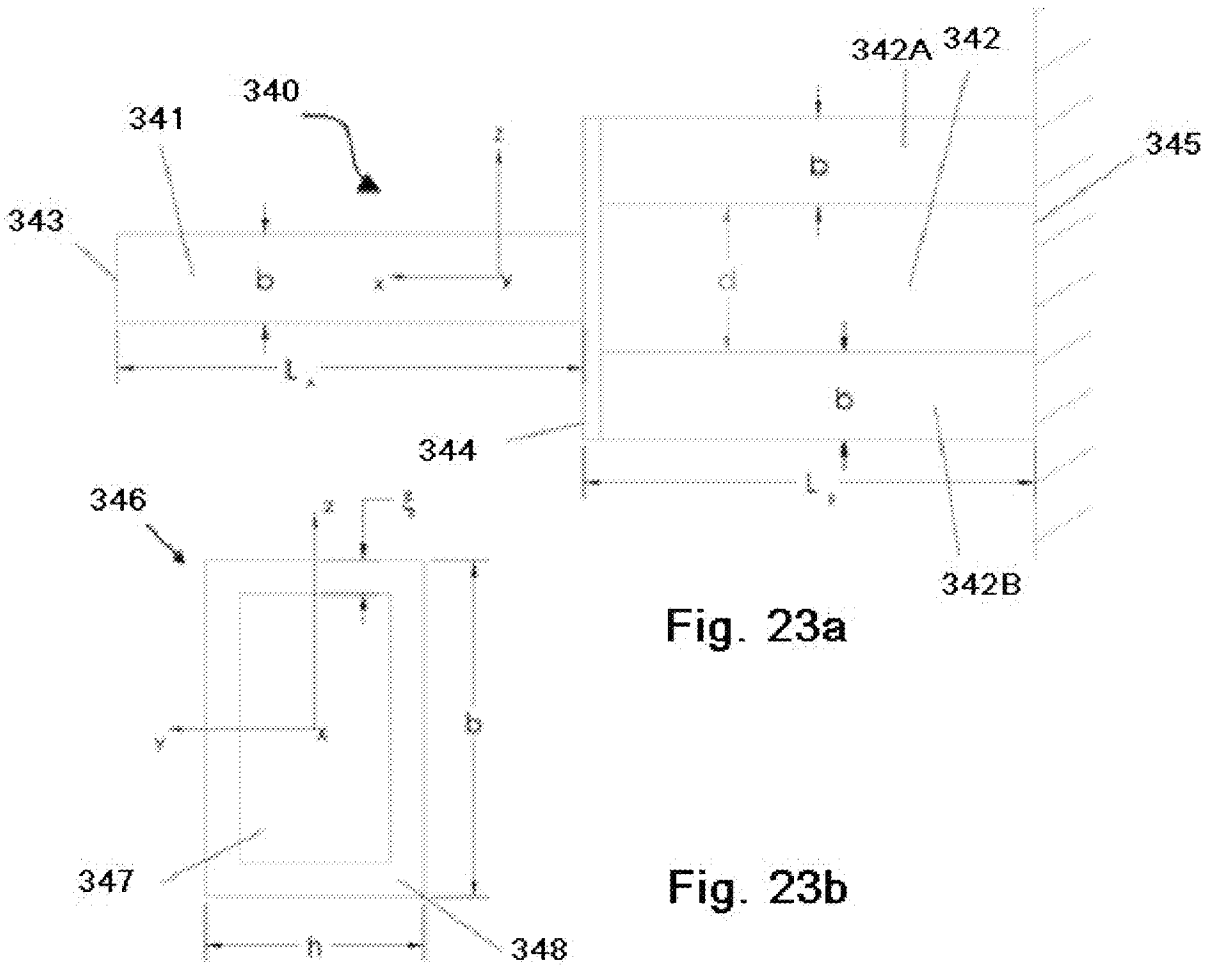
FIG. 23*a* shows a cantilever structure having two beam sections connected in series whereby one section consists of two beams connected in a side-by-side layout and the other section consists of a single beam.
FIG. 23*b* shows a cross-sectional view of the cantilever structure as depicted in FIG. 23*a* through any of the beams.

Referring to FIGS. 23*a* and 23*b*, there is shown a cantilever structure 340 having two beam sections 341, 342, in series. Beam section 342 has two beams 342A, 342B connected in a side-by-side layout. All reference coordinates are based on the right-hand rule.

The beam 341 has a free end 343 at its left end and is attached to beam section 342 at its right end 344. The beam section 342 has two beams 342A, 342B connected in a side-by-side layout, and the entire beam section 342 is attached to beam 341 at its left end and has a clamped boundary condition 345 at its right end. All the beams 341,342A, 342B have the same cross-section 346 with a width of b, height of h, and a silicon dioxide coating of thickness ζ. Beam 341 has length of $L_A$, and beams 342A, 342B have a length of $L_B$.

The beam section 342 has a higher bending stiffness than beam 341 due to the side-by-side arrangement. By adjusting the beam section 341, 342 lengths $L_A$ and $L_B$ and the distance d between the beams 342A and 342B, it is possible to design the cantilever structure 340 such that it has the same equivalent bending stiffness as the cantilever structure 330 in FIGS. 22*a* and 22*b*.

However, as each beam 341, 342A, 342B has the same cross-section geometry, the silicon dioxide coating thickness to beam width ratio ζ:b is the same for all the beams 341, 342A, 342B. Total thermo-compensation for any one beam section 341, 342 means the same for the other beam section. This proves that total thermo-compensation for a silicon hairspring accordingly to the present invention with side-by-side strips, is theoretically feasible.

Figure 24:
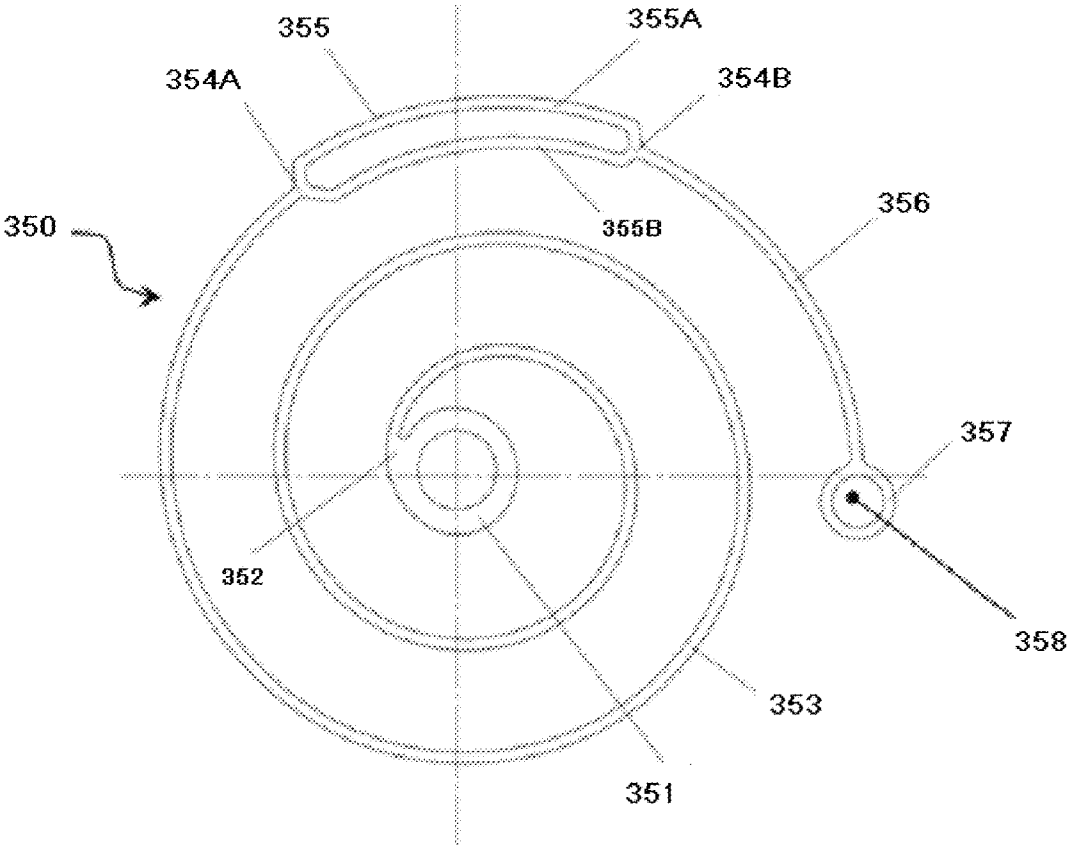
FIG. 24 shows a first embodiment of a hairspring according to the present invention.

Referring to FIG. 24, there is shown a first embodiment of a hairspring 350 according to the present invention having a multi-strip spiral section 355 side-by-side branches 355A, 355B of a rectangular section, with a single outer terminal 357 connected to a stud 358.

The hairspring 350 consists of a collet 351 at the centre. The inner primary strip 353 spirals outward from the inner terminal 352 attached to the collet 351 until hairspring section 355 where it splits into two side-by-side branches 355A, 355B at point 354A.

The two branches 355A, 355B re-converge at point 354B into a single outer primary strip 356 until it reaches the outer terminal 357 which is fixed and clamped. The hairspring section 355 with the side-by-side branches 355A, 355B has a larger bending stiffness than the inner primary strip 353 and the outer primary strip 356. An automatic design optimization algorithm such as gradient method can maximize the hairspring 350 concentricity by using the length and placement of section 355 and the distance between branches 355A and 355B.

To further provide for variance of design parameters, the distance between the branches 355A and 355B may be varied along the length of section 355. The branches 355A, 355B may, for example, diverge and converge, it being understood that the available space may be constrained to permit the spiral spring to contract and expand without adjacent turnings touching each other, and without the spring contacting other elements of the escapement.

It will be understood that therefore, the hairspring 355 of the present embodiment, can be of any size and shape and placed anywhere with sufficient clearance depending on the initial hairspring geometry.

However, side-by-side branches 355A, 355B having a substantially constant separation distance are generally preferable so as to provide ease of calculation and optimization of spring characteristics.

Figure 25:
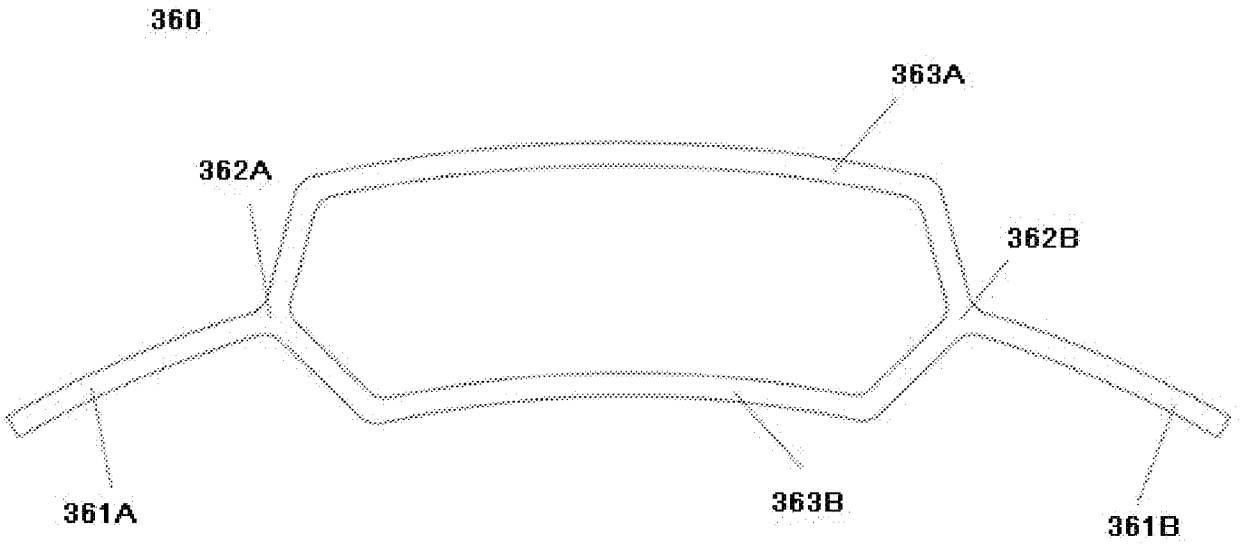
FIG. 25 shows a multi-strip spiral section arrangement of a further embodiment of a hairspring according to the present invention.
Figure 26:
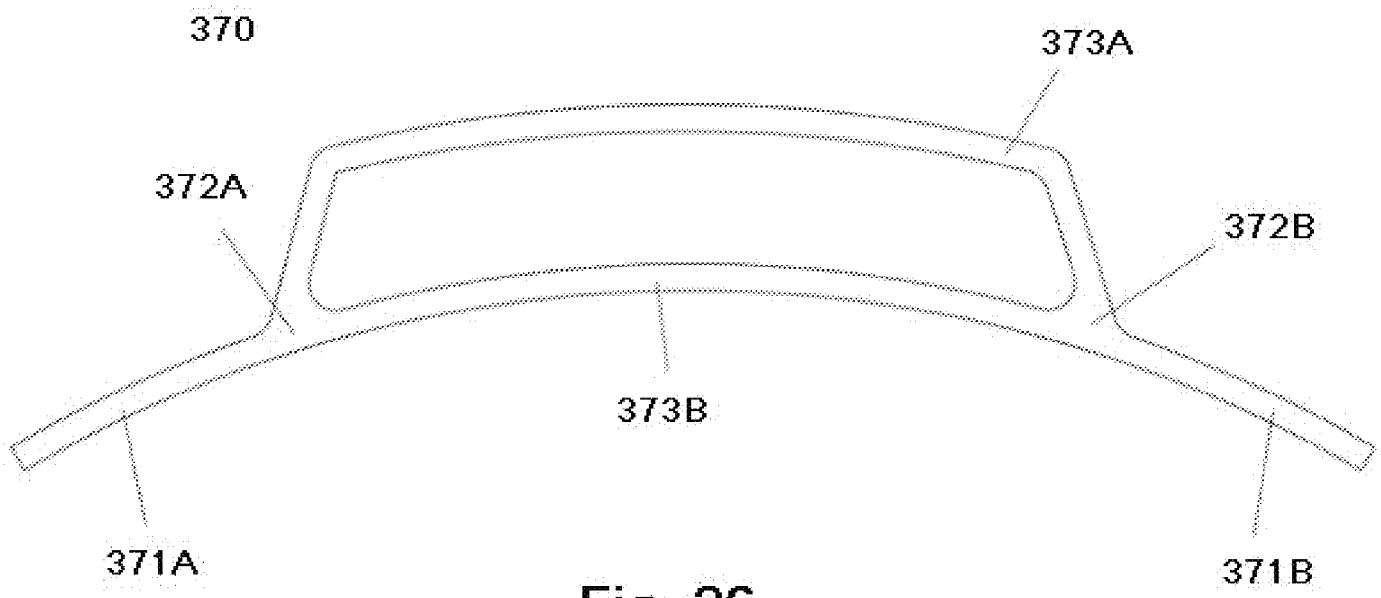
FIG. 26 shows a multi-strip spiral section arrangement of another embodiment of a hairspring according to the present invention.
Figure 27:
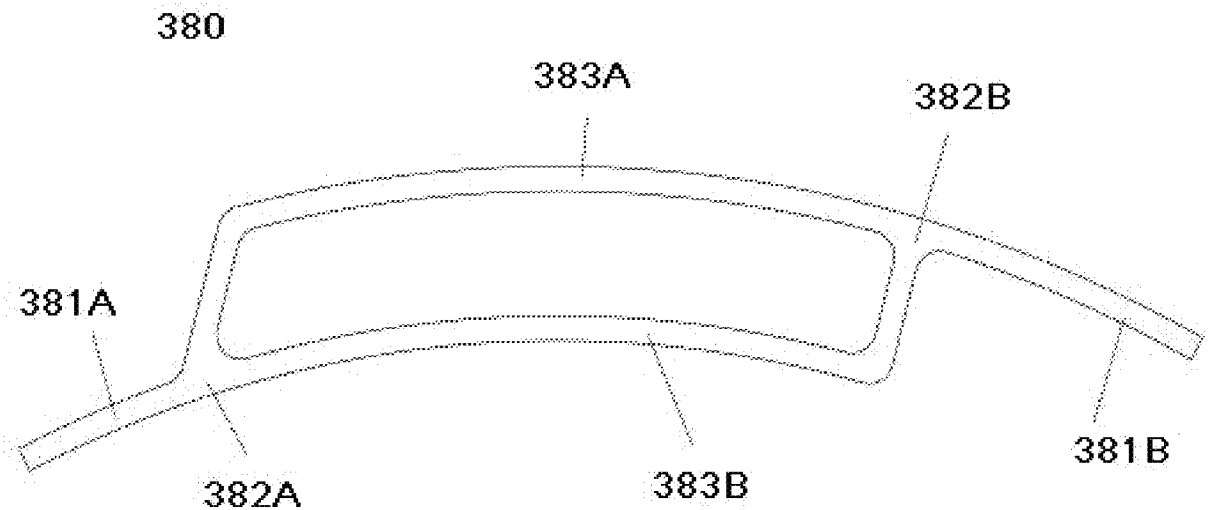
FIG. 27 shows a multi-strip spiral section arrangement of yet a further embodiment of a hairspring according to the present invention.

Referring to FIGS. 25, 26, and 27, there are shown three further embodiments of a hairspring according to the present invention, having multi-strip spiral section with two side-by-side branches. These embodiments, as will be appreciated by those skilled in the art, may readily be extended to include multi-strip spiral sections with more than two side-by-side branches.

Referring to FIG. 25, there is shown a multi-strip spiral section arrangement 360 of a further embodiment of a hairspring according to the present invention, where both side-by-side branches 363A, 363A abruptly diverge from and then abruptly converge into a single branch of two adjacent single-strip spiral sections 361A, 361B of the hairspring Referring to FIG. 26, there is shown a multi-strip spiral segment 370 of another embodiment of a hairspring according to the present invention. The left primary strip 371A is smoothly connected to one of the side-by-side branches 373A which is in turn smoothly connected to the right primary strip 371B.

The side-by-side branch 373A abruptly diverges from the left primary strip 371A at the point of intersection 372A and abruptly converges into the right primary strip 371B at the point of intersection 372B.

Referring to FIG. 27, there is shown a multi-strip spiral segment 380 of yet a further embodiment of a hairspring according to the present invention. The left primary strip 381A is smoothly connected to one of the side-by-side branches 383B.

The side-by-side branch 383A abruptly diverge from the left primary strip 381A at the point of intersection 382A and is smoothly connected to the right primary strip 381B. The side-by-side branch 383B abruptly converges into the right primary strip 381B at the point of intersection 382B.

Figure 28:
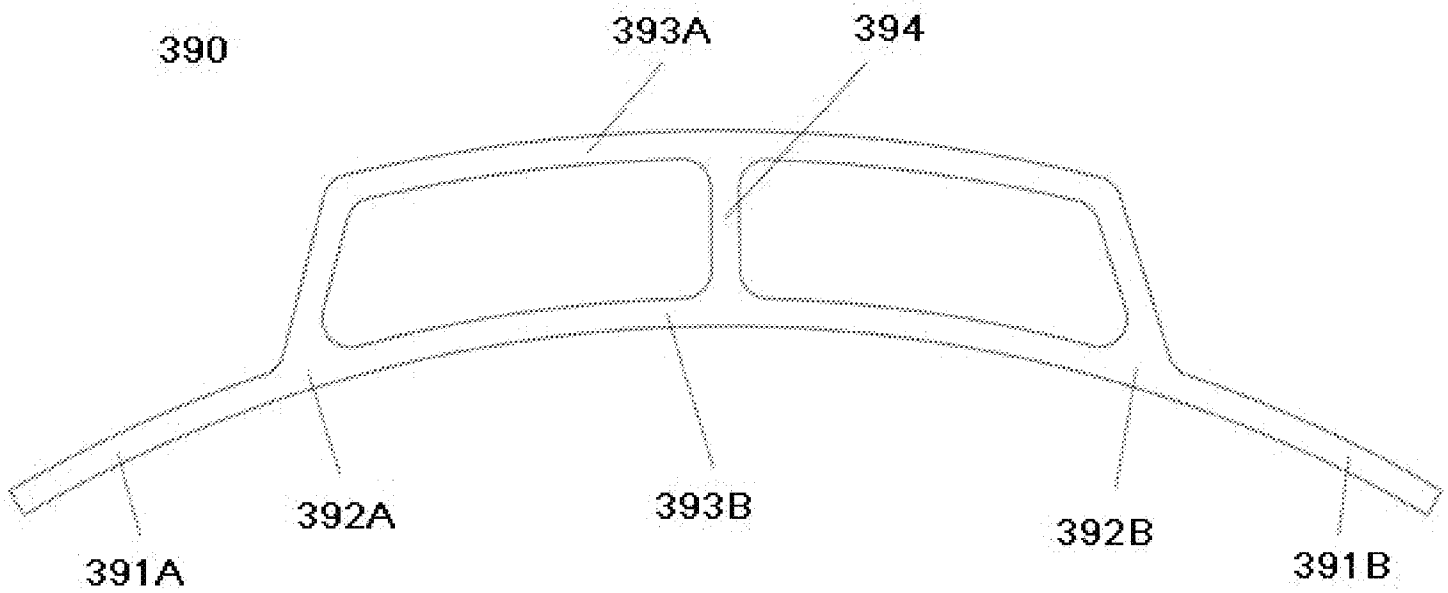
FIG. 28 shows a multi-strip spiral section arrangement of yet another embodiment of a hairspring according to the present invention.

Referring to FIG. 28, there is shown a layout of a multi-strip spiral section 390 of yet another embodiment of the present invention, including a support strut 394.

The side-by-side branches 393A, 393B are connected the primary strips 391A, 391B to the left and right via the points of intersection 392A, 392B, respectively.

As the entire multi-strip spiral section 390 bends, the side-by-side branches 393A and 393B may bend with slightly different radii of curvature. Depending on the hairspring geometry and the magnitude of the bending, the side-by-side branches 393A and 393B may be urged towards each other, and may come into contact. The support strut 394 prevents this from happening and has minimal impact in the statics of the multi-strip spiral section 390 if the width of the strut 394 is much smaller than the length of the spiral section 390.

As will be appreciated, more than one strut 394 may be utilised, depending upon the geometry, shape, size and application of the hairspring.

Figure 29:
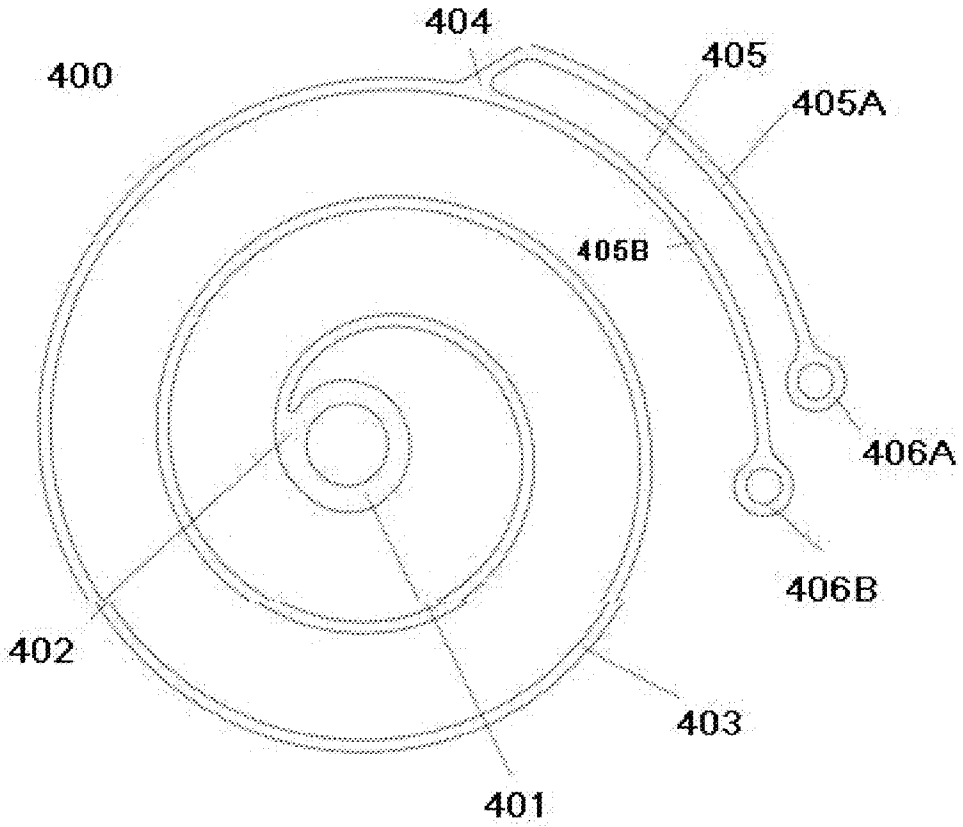
FIG. 29 shows an alternate embodiment of a hairspring according to the present invention.

Referring to FIG. 29, there is shown an alternate embodiment of a hairspring 400 according to the present invention.

The hairspring design has a collet 401 at its centre. The primary strip 403 has an inner terminal 402 connected to the collet 401 and spirals outward until it reaches the multi-strip spiral section 405 at the point of intersection 404. The primary strip 403 then splits into two side-by-side branches 405A and 405B, each of which independently terminates in a fixed and clamped outer terminal 406A, 406B, respectively, by contrast to the embodiment as depicted in FIG. 24 whereby the side-by-side branches 455A, 455B re-converge at the outer terminal.

Those skilled in the art will appreciate that the present embodiment will also achieve increased stiffening near the outer terminal in accordance with the invention, although the two side-by-side branches 405A and 405B do not re-converge.

In order to describe the manner in which features of the present invention behave, an explanation utilizing solid mechanics theory, in particular utilizing the statics of a cantilever beam using the Euler-Bernoulli beam formula is provided with reference to FIGS. 30-33*b*.

Although this formula and accompanying theory is strictly-speaking based on a straight cantilever beam model, the formula also provides reasonably accurate results for spiral-shaped hairspring with slender strips because the vast majority of a typical hairspring's restoring torque comes from the bending of its strip.

For this reason, the Euler-Bernoulli beam formula is widely used in the watch industry to estimate the hairspring bending stiffness.

Figure 30:
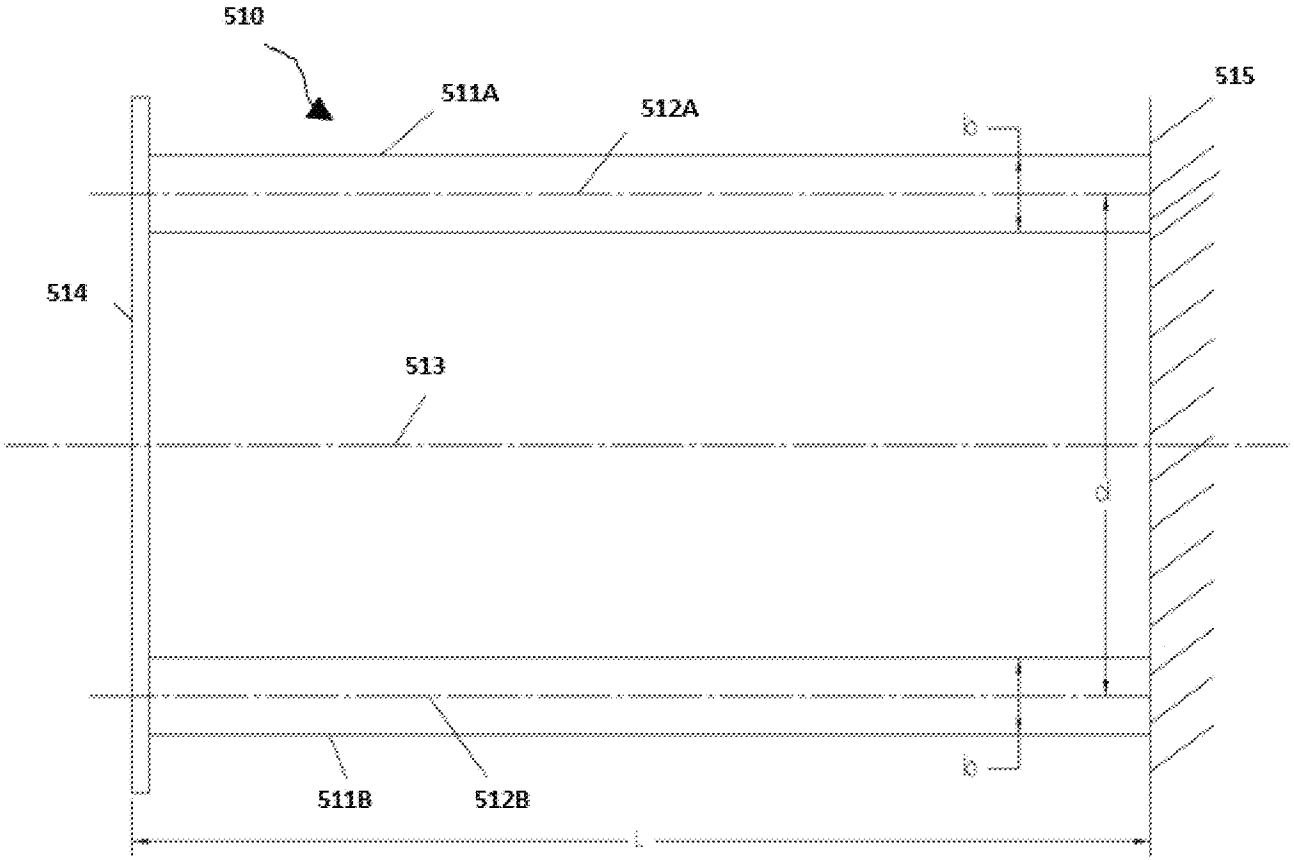
FIG. 30 shows a cantilever structure having two beams connected in a side-by-side configuration.

Referring to FIG. 30, there is shown a cantilever structure 510 comprised of two beams 511A, 511B connected side-by-side in parallel. It must be emphasized that the term "parallel" is utilized throughout the specification, this term is understood to extend to elements of a structure connected in a side-by-side layout, which is not necessarily parallel in the strict geometric definition. An analysis of this cantilever structure 510 demonstrates its effect on the structure's bending stiffness, defined as the ratio between the applied moment and a beam's resultant deflection.

The right end of the cantilever structure 510 has a clamped boundary condition 515, resisting displacement and rotation. The left end of the cantilever structure 510 is free but has a plate 514 affixed to both beams 511A, 511B to ensure that they bend together and cannot translate or rotate with respect to each other. The two beams 511A, 511B each have a length of L, width of b, and height of h. The two beams 511A, 511B are also separated by a constant distance of d when measured from their centerlines 512A, 512B. The cantilever structure 510 also has a neutral axis 513, which in this case is equidistant between the beam centerlines 512A, 512B.

The cantilever structure 510 has a higher bending stiffness when compared to a single cantilever beam of the same length and cross-section as each of the beams 511A, 511B due to the two following reasons:

(i) the cantilever structure 510 has a larger cross-section area than a single beam; and (ii) the two beams 512A, 512B of the cantilever structure 510 are located further away from the neutral axis 513, thereby increasing the second moment of area and hence providing a greater bending stillness.

The bending stiffness $k_1$ of a single beam 511A, 511B can be computed using the Euler-Bernoulli beam formula as follows with the Young's modulus denoted by E.

$$k_1 = \frac{Ehb^3}{12L} \tag{1}$$

The distance d is redefined to be nb where n is the ratio d:b for simplification of equation. In contrast, the bending stiffness $k_2$ of the cantilever structure 510 can be computed by further using the parallel axis theorem as follows:

$$k_2 = \frac{Ehb^3}{2L}\left(\frac{1}{3} + n^2\right) \tag{2}$$

Assuming the cantilever structure 510 is planar, the value of n must be greater than 1 or the two beams 511A, 511B will overlap.

As will be appreciated by those skilled in the art, the minimum feasible value of $k_2$ always greater than $k_1$ for a planar cantilever structure 510. In fact, the minimum feasible value of $k_2$, defined as $k_{2,min}$, is eight times the value of $k_1$.

In accordance with the present invention, it will be understood by those skilled in the art that it is possible to set $k_1<k_2<k_{2,min}$ by adjusting the strip length L which may be implemented using existing micro-fabrication technology.

Equations (1) and (2) show the effectiveness of increasing the cantilever structure's 510 bending stiffness by arranging two beams 511A, 511B in a side-by-side arrangement.

The parallel axis theorem may also be applied to a cantilever structure 510 having more than two beams 511A, 511B in a side-by-side layout and yield the same conclusion.

The same conclusion can also be drawn from cantilever structure 510 with side-by-side beams 511A, 511B even when the beam distance d is not constant, although the derivation of the structure's 510 bending stiffness will be more complex and require techniques such as calculus for computation.

To illustrate the merit of the side-by-side strip design in thermo-compensation, the effect on the Young's modulus of a silicon dioxide coating on a silicon beam is described and illustrated with reference to FIGS. 31*a* and 31*b*. This illustrational analysis only takes into consideration of the sensitivity of the Young's modulus to temperature variations and does not include the effect of thermal expansion. As the effect of temperature on Young's Modulus is a few orders of magnitude greater than that of the thermal expansion effects, utilising only thermal effects on Young's modulus is considered to yield this reasonably robust and substantially the same results.

Figure 31A:
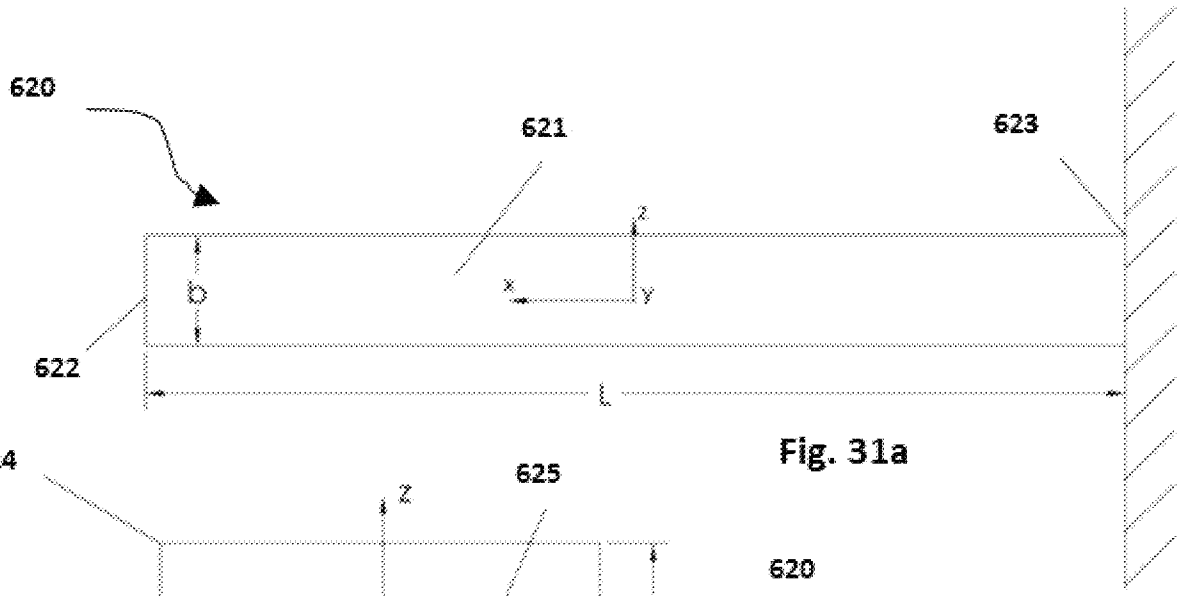
FIG. 31*a* shows a cantilever structure having a single beam having a uniform cross-section.
Figure 31B:
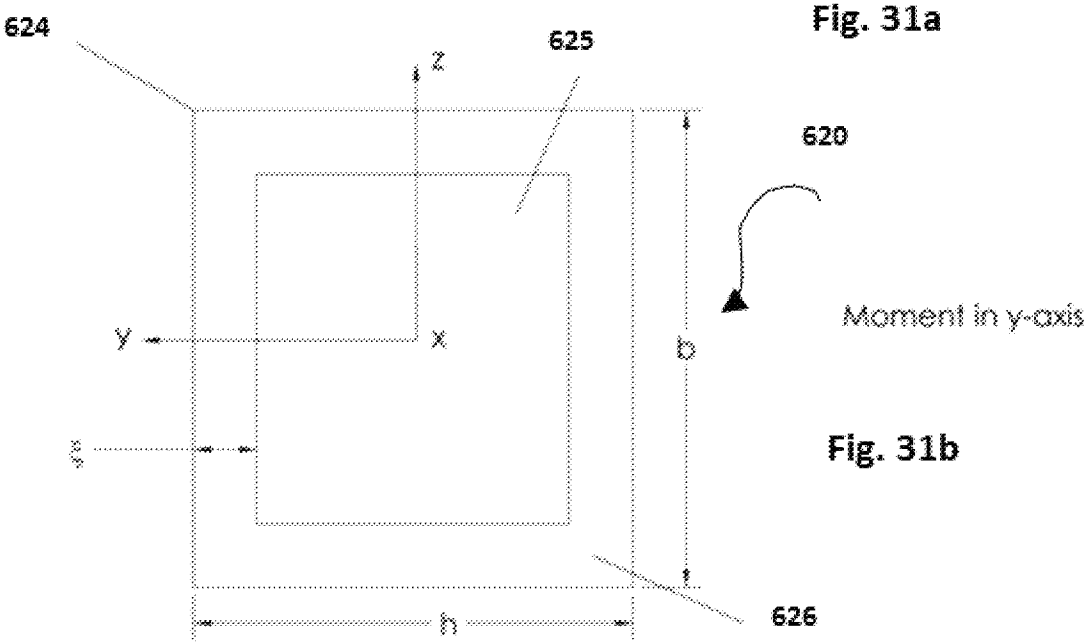
FIG. 31*b* shows a cross-sectional view of the cantilever structure as depicted in FIG. 31*a;*

Referring to FIGS. 31*a* and 31*b*, there is shown a cantilever structure 620 having a single beam 621 of uniform cross-section with all reference coordinates based on the right-hand rule of solid mechanics. The beam 621 has a width of b, height of h, and length of L. The left end 622 is free, and the right end 623 is clamped. The cross-section 624 of the beam 621 shows a silicon core 625 with a silicon dioxide coating 626 of thickness ζ.

The Young's moduli of silicon and silicon dioxide can be approximated by a linear function with respect to temperature change given as follows:

$$E_{Si}(\Delta T)=E_{Si,0}(1+e_{Si}\Delta T) \tag{3}$$

$$E_{SiO_2}(\Delta T)=E_{SiO_2,0}(1+e_{SiO2_2}\Delta T) \tag{4}$$

In Equations (3) and (4), $E_{Si,0}$, $E_{SiO2,0}$, $e_{Si}$, and $e_{SiO2}$ are all constants, and ΔT is the temperature change. The constants $E_{Si,0}$, $E_{SiO2,0}$, $e_{Si}$, and $e_{SiO2}$ have a numerical value of approximately 148 GPa, 72.4 GPa, −60 ppm/K, and 215 ppm/K at room temperature, respectively.

The constants $e_{Si}$ and $e_{SiO2}$ have the opposite sign, and this indicates that the Young's modulus of silicon decreases with temperature rise while that of silicon dioxide increases.

Assuming the cantilever structure 620 in FIGS. 31*a* and 31*b* is subjected to a moment in the y-axis, the equivalent Young's modulus of the composite beam 621 can be computed as follows:

$$E_{eq}(\Delta T) = [E_{Si}(\Delta T) - E_{SiO_2}(\Delta T)]\left(1 - \frac{2\zeta}{b}\right)^3\left(1 - \frac{2\zeta}{h}\right) + E_{SiO_2}(\Delta T) \tag{5}$$

Differentiating with respect to ΔT and substituting Equations (3) and (4), Equation (5) becomes as follows:

$$\frac{dE_{eq}(\Delta T)}{d\Delta T} = (E_{Si,0}e_{Si} - E_{SiO_2,0}e_{SiO_2})\left(1 - \frac{2\zeta}{b}\right)^3\left(1 - \frac{2\zeta}{h}\right) + E_{SiO_2,0}e_{SiO_2} \tag{6}$$

Equation (6) describes the sensitivity of the $E_{eq}$ with respect to ΔT, and to achieve total thermo-compensation, it needs to be set to zero by varying ζ.

For a wide range of aspect ratio, defined as b:h, the optimal ζ:b ratio is fairly stable at approximately 6% for a cross-section with a silicon core and silicon dioxide coating. The results demonstrate that total thermo-compensation is theoretically feasible for a silicon hairspring of uniform cross-section via a coating of silicon dioxide.

The same conclusion cannot be drawn for a hairspring of variable cross-section. This can be proven by a simple cantilever beam example with two distinct cross-sections.

Figures 32A, 32B, 32C:
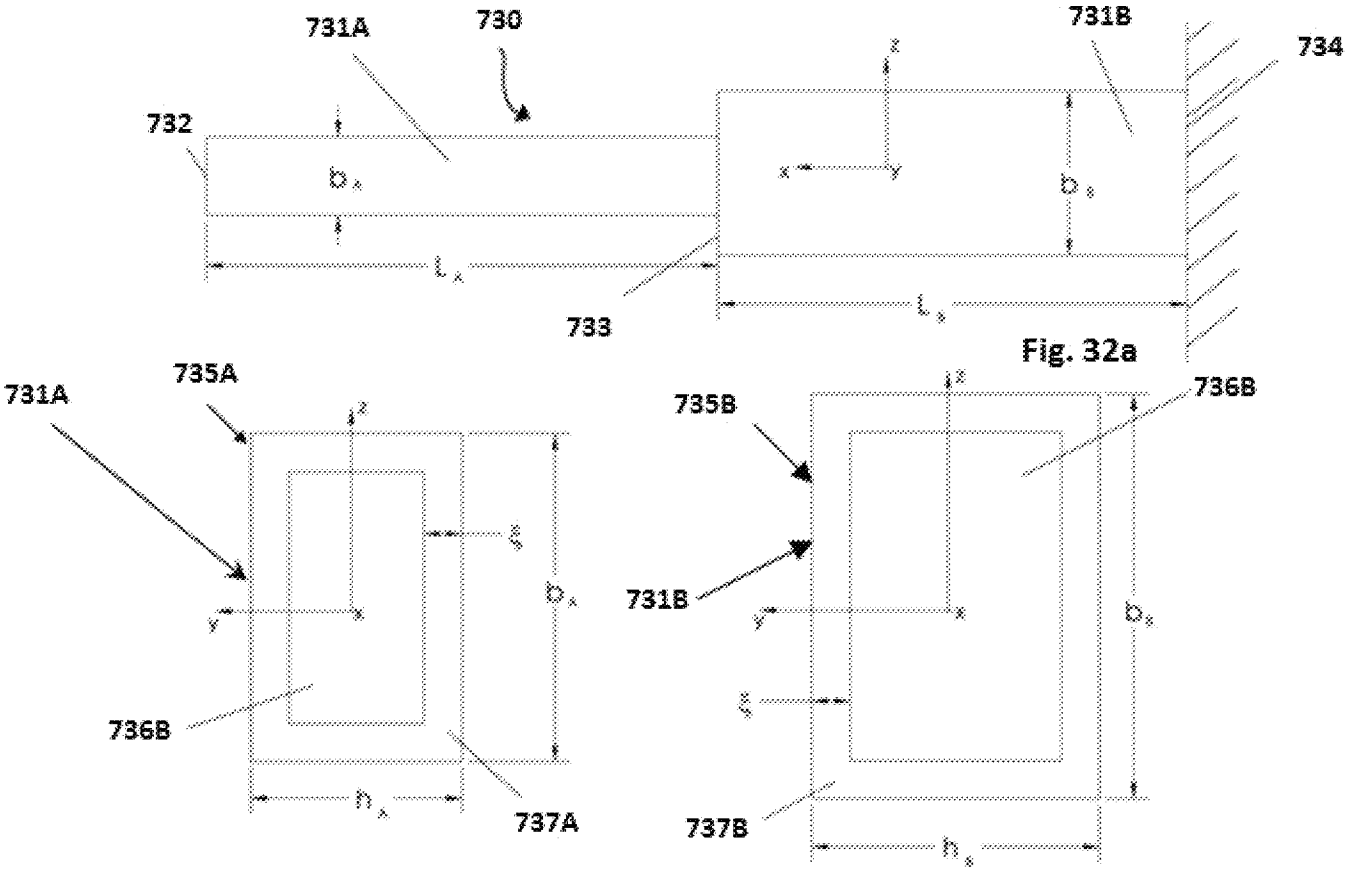
FIG. 32*a* shows a cantilever structure having two beams of different cross-section connected in a series arrangement.
FIG. 32*b* shows a cross-sectional view of the cantilever structure as depicted in FIG. 31*a* through the first of the two beams.
FIG. 32*c* shows a cross-sectional view of the cantilever structure as depicted in FIG. 31*a* through the second of the two beams.

Referring to FIG. 32*a*-32*b*, there is shown a cantilever structure 730 having two beams 731A, 731B of different cross-sections 734A, 734B, in series. All reference coordinates are based on the right-hand rule according to established solid mechanics.

The beam 731A has a free end 732 at its left end and is engaged with a beam 731B at its right end 733. The beam 731B is attached to beam 731A at its left end 733 and has a clamped boundary condition 734 at its right end. The beam 731A has a width of $b_A$, a height of $h_A$, and a length of $L_A$, and the beam 731B has a width of $b_B$, a height of $h_B$, and a length of $L_B$.

The cross-section 735A of the beam 731A shows a silicon core 736A with a silicon dioxide coating 737A of thickness ζ, and the cross-section 735B of the beam 731B shows a silicon core 736B with a silicon dioxide coating 737B also of thickness ζ. Both cross-sections 735A, 735B have the same silicon dioxide coating thickness as current micro-fabrication technology cannot achieve variable coating thickness on the same component.

Assuming the cantilever structure 730 is subjected to a moment in the y-axis, the equivalent Young's modulus of each of the beams 731A, 731B can be computed as follows.

$$E_{eq,A}(\Delta T)=E_{A,0}(\zeta)[1+e_A(\zeta)\Delta T] \tag{7}$$

$$E_{eq,B}(\Delta T)=E_{B,0}(\zeta)[1+e_B(\zeta)\Delta T] \tag{8}$$

It is noted that $E_{eq,A}(\Delta T)$ and $E_{eq,B}(\Delta T)$ corresponds to the equivalent Young's moduli for beams 31A and 31B, respectively. The terms $E_{A,0}(\zeta)$, $E_{B,0}(\zeta)$, $e_A(\zeta)$, and $e_B(\zeta)$ can be expanded according to Equation (3), (4), and (5) as follows:

$$E_{A,0}(\zeta)=\left(1-\frac{2\zeta}{b_A}\right)^3\left(1-\frac{2\zeta}{h_A}\right)(E_{Si,0}-E_{SiO_2,0})+E_{SiO_2,0} \tag{9}$$

$$E_{B,0}(\zeta)=\left(1-\frac{2\zeta}{b_B}\right)^3\left(1-\frac{2\zeta}{h_B}\right)(E_{Si,0}-E_{SiO_2,0})+E_{SiO_2,0} \tag{10}$$

$$e_A(\zeta)=\frac{\left(1-\frac{2\zeta}{b_A}\right)^3\left(1-\frac{2\zeta}{h_A}\right)(E_{Si,0}e_{Si}-E_{SiO_2,0}e_{SiO_2})+E_{SiO_2,0}e_{SiO_2}}{\left(1-\frac{2\zeta}{b_A}\right)^3\left(1-\frac{2\zeta}{h_A}\right)(E_{Si,0}-E_{SiO_2,0})+E_{SiO_2,0}} \tag{11}$$

$$e_B(\zeta)=\frac{\left(1-\frac{2\zeta}{b_B}\right)^3\left(1-\frac{2\zeta}{h_B}\right)(E_{Si,0}e_{Si}-E_{SiO_2,0}e_{SiO_2})+E_{SiO_2,0}e_{SiO_2}}{\left(1-\frac{2\zeta}{b_B}\right)^3\left(1-\frac{2\zeta}{h_B}\right)(E_{Si,0}-E_{SiO_2,0})+E_{SiO_2,0}} \tag{12}$$

The bending stiffness of each of the beams 731A, 731B can be computed using the Euler-Bernoulli beam formula as follows:

$$K_A(\Delta T)=K_{A,0}(\zeta)[1+e_A(\zeta)\Delta T] \tag{13}$$

$$K_B(\Delta T)=K_{B,0}(\zeta)[1+e_B(\zeta)\Delta T] \tag{14}$$

Note that $K_A(\Delta T)$ and $K_B(\Delta T)$ are the bending stiffness of the beams 31A and 31B, respectively. The terms $K_{A,0}(\zeta)$, $K_{B,0}(\zeta)$, $k_A(\zeta)$, and $k_B(\zeta)$ can be expanded as follows:

$$K_{A,0}(\zeta)=\frac{E_{A,0}(\zeta)b_A^3h_A}{12L_A} \tag{15}$$

$$K_{B,0}(\zeta)=\frac{E_{B,0}(\zeta)b_B^3h_B}{12L_B} \tag{16}$$

As the two beams 731A, 731B are connected in series, their equivalent stiffness may be computed as follows:

$$K_{eq}(\Delta T)=\frac{K_A(\Delta T)K_B(\Delta T)}{K_A(\Delta T)+K_B(\Delta T)}=\frac{K_{A,0}(\zeta)K_{B,0}(\zeta)[1+e_A(\zeta)\Delta T][1+e_B(\zeta)\Delta T]}{K_{A,0}(\zeta)[1+e_A(\zeta)\Delta T]+K_{B,0}(\zeta)[1+e_B(\zeta)\Delta T]} \tag{17}$$

Differentiating with respect to ΔT and substituting Equations (13) and (14), Equation (17) becomes as follows"

$$\frac{dK_{eq}(\Delta T)}{d\Delta T}=\frac{N_2(\zeta)\Delta T^2+N_1(\zeta)\Delta T+N_0(\zeta)}{D_2(\zeta)\Delta T^2+D_1(\zeta)\Delta T+D_0(\zeta)} \tag{18}$$

Equation (18) describes the sensitivity of the $K_{eq}$ with respect to ΔT, and the coefficients $N_2$, $N_1$, $N_0$, $D_2$, $D_1$, and $D_0$ are defined as follows.

$$N_2(\zeta)=K_{A,0}K_{B,0}e_A(\zeta)e_B(\zeta)[K_{A,0}e_A(\zeta)+K_{B,0}e_B(\zeta)] \tag{19}$$

$$N_1(\zeta)=2K_{A,0}K_{B,0}e_A(\zeta)e_B(\zeta)(K_{A,0}+K_{B,0}) \tag{20}$$

$$N_0(\zeta)=K_{A,0}K_{B,0}\,[K_{A,0}e_B(\zeta)+K_{B,0}e_A(\zeta)] \tag{21}$$

$$D_2(\zeta)=[K_{A,0}e_A(\zeta)+K_{B,0}e_B(\zeta)]^2 \tag{22}$$

$$D_1(\zeta)=2\{K_{A,0}^2e_A(\zeta)+K_{A,0}K_{B,0}\,[e_A(\zeta)+e_B(\zeta)]+K_{B,0}^2e_B(\zeta)\} \tag{23}$$

$$D_0(\zeta)=(K_{A,0}+K_{B,0})^2 \tag{24}$$

To achieve total thermo-compensation, the silicon dioxide coating thickness must be set such that Equation (18) becomes zero for all values of ΔT. Assuming the denominator of Equation (18) is non-zero, it becomes only necessary to set the numerator of Equation (18) to zero for all values of ΔT.

However, the numerator of Equation (18) is a quadratic function of ΔT, meaning the numerator can equal to zero for only two values of ΔT. Equation (18) proves that total thermo-compensation is impossible for a cantilever structure 730 with two beams 731A, 731B of different cross-section, in series.

A similar analysis performed on a cantilever structure with discretely or continuously variable cross-section will yield the same conclusion, proving that total thermo-compensation is theoretically impossible for a silicon hairspring of variable cross-section.

In contrast, total thermo-compensation is theoretically feasible for a hairspring with side-by-side strips.

Figures 33A, 33B:
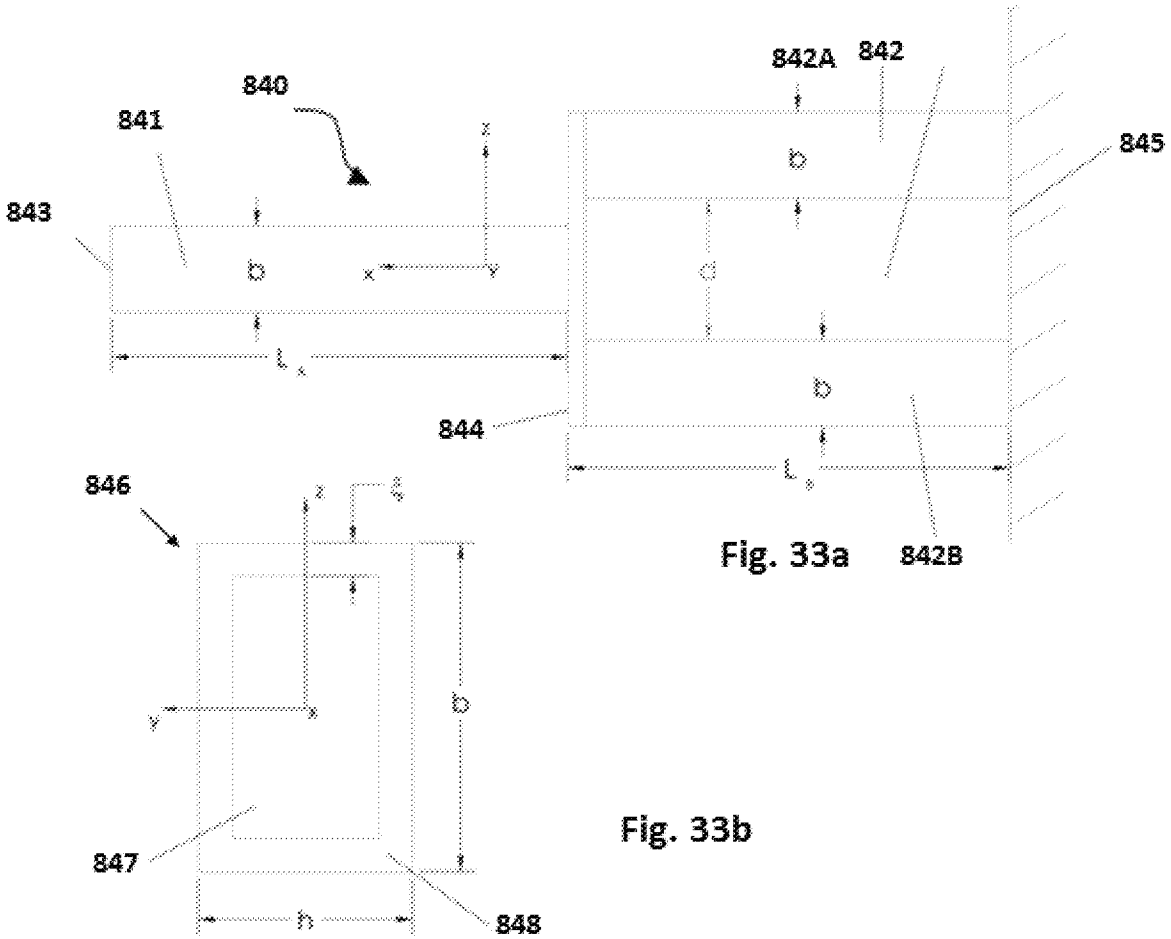
FIG. 33*a* shows a cantilever structure having two beam sections connected in series whereby one section consists of two beams connected in a side-by-side layout and the other section consists of a single beam.
FIG. 33*b* shows a cross-sectional view of the cantilever structure as depicted in FIG. 33*a* through any of the beams.

Referring to FIGS. 33*a*-33*c*, there is shown a cantilever structure 840 having two beam sections 841, 842, in series. Beam section 842 has two beams 842A, 842B connected in a side-by-side layout. All reference coordinates are based on the right-hand rule.

The beam 841 has a free end 843 at its left end and is attached to beam section 842 at its right end 844. The beam section 842 has two beams 842A, 842B connected in a side-by-side layout, and the entire beam section 842 is attached to beam 841 at its left end and has a clamped boundary condition 845 at its right end. All the beams 841, 842A, 842B have the same cross-section 846 with a width of b, height of h, and a silicon dioxide coating of thickness ζ. Beam 841 has length of $L_A$, and beams 842A, 842B have a length of $L_B$.

The beam section 842 has a higher bending stiffness than beam 841 due to the side-by-side arrangement. By adjusting the beam section 841, 842 lengths $L_A$ and $L_B$ and the distance d between the beams 842A and 842B, it is possible to design the cantilever structure 40 such that it has the same equivalent bending stiffness as the cantilever structure 830 in FIGS. 32*a*-32*c*.

However, as each beam 841, 842A, 842B has the same cross-section geometry, the silicon dioxide coating thickness to beam width ratio ζ:b is the same for all the beams 841, 842A, 842B. Total thermo-compensation for any one beam section 841, 842 means the same for the other beam section. This proves that total thermo-compensation for a silicon hairspring accordingly to the present invention with side-by-side strips, is theoretically feasible Referring to FIG. 34, there is shown a first embodiment of a hairspring 950 according to the present invention having a multi-strip spiral section 955 side-by-side branches 955A, 955B of a rectangular section, with a single outer terminal 957 connected to a stud 958.

The hairspring 950 consists of a collet 951 at the centre. The inner primary strip 953 spirals outward from the inner terminal 952 attached to the collet 951 until hairspring section 955 where it splits into two side-by-side branches 955A, 955B at point 954A.

The two branches 955A, 955B re-converge at point 954B into a single outer primary strip 956 until it reaches the outer terminal 957 which is fixed and clamped. The hairspring section 955 with the side-by-side branches 955A, 955B has a larger bending stiffness than the inner primary strip 953 and the outer primary strip 956. An automatic design optimization algorithm such as gradient method can maximize the hairspring 950 concentricity by using the length and placement of section 55 and the distance between branches 955A and 955B as its search space.

To further provide for variance of design parameters, the distance between the branches 955A and 955B may be varied along the length of section 955. The branches 955A, 955B may, for example, diverge and converge, it being understood that the available space may be constrained to permit the spiral spring to contract and expand without adjacent turnings touching each other, and without the spring contacting other elements of the escapement.

It will be understood that therefore, the hairspring 955 of the present embodiment, can be of any size and shape and placed anywhere with sufficient clearance depending on the initial hairspring geometry.

However, side-by-side branches 955A, 955B having a substantially constant separation distance are generally preferable so as to provide ease of calculation and optimization of spring characteristics.

Figure 35:
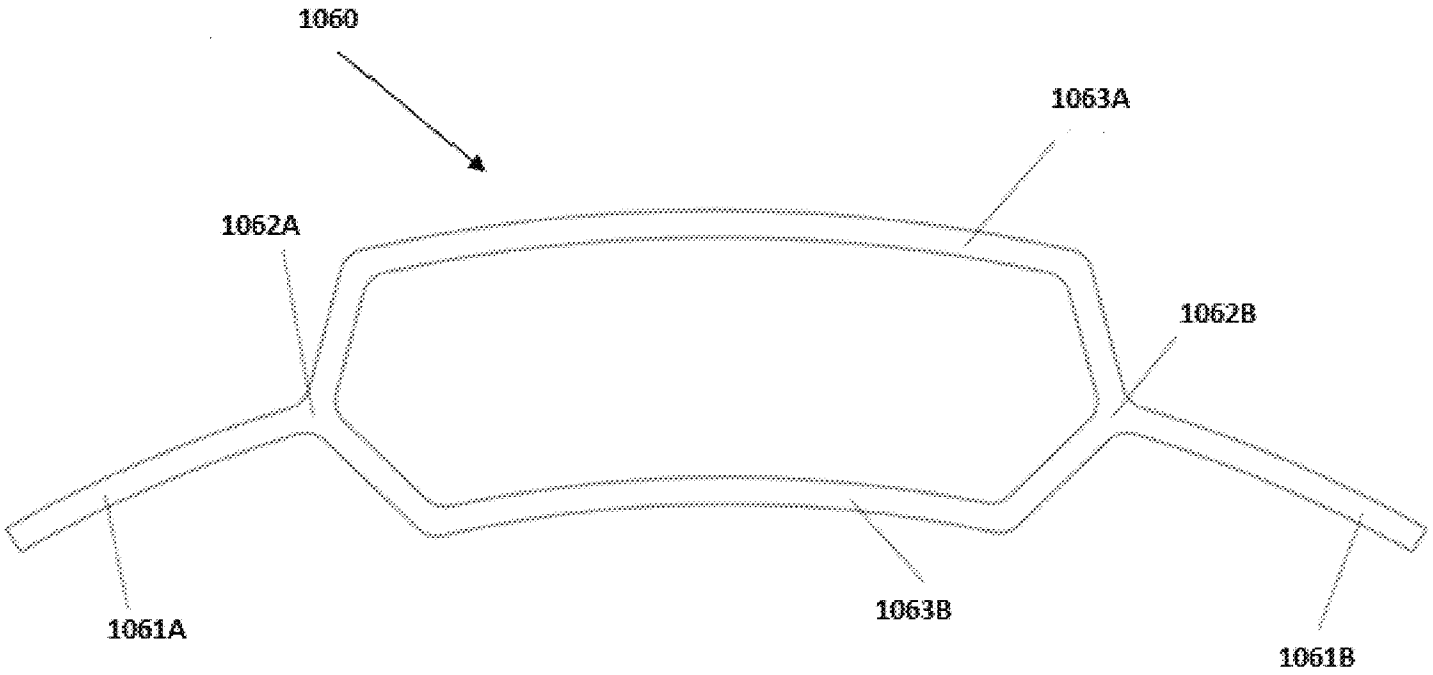
FIG. 35 shows a multi-strip spiral section arrangement of a further embodiment of a hairspring according to the present invention.
Figure 36:
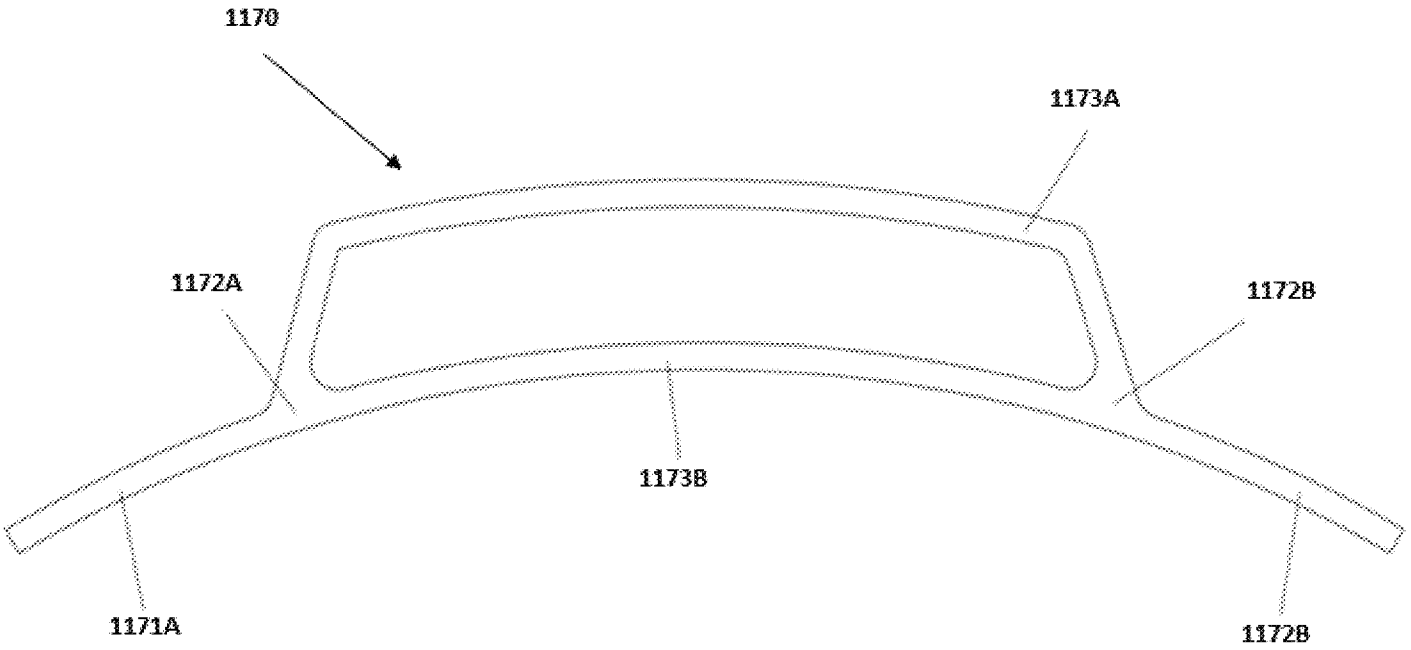
FIG. 36 shows a multi-strip spiral section arrangement of another embodiment of a hairspring according to the present invention.
Figure 37:
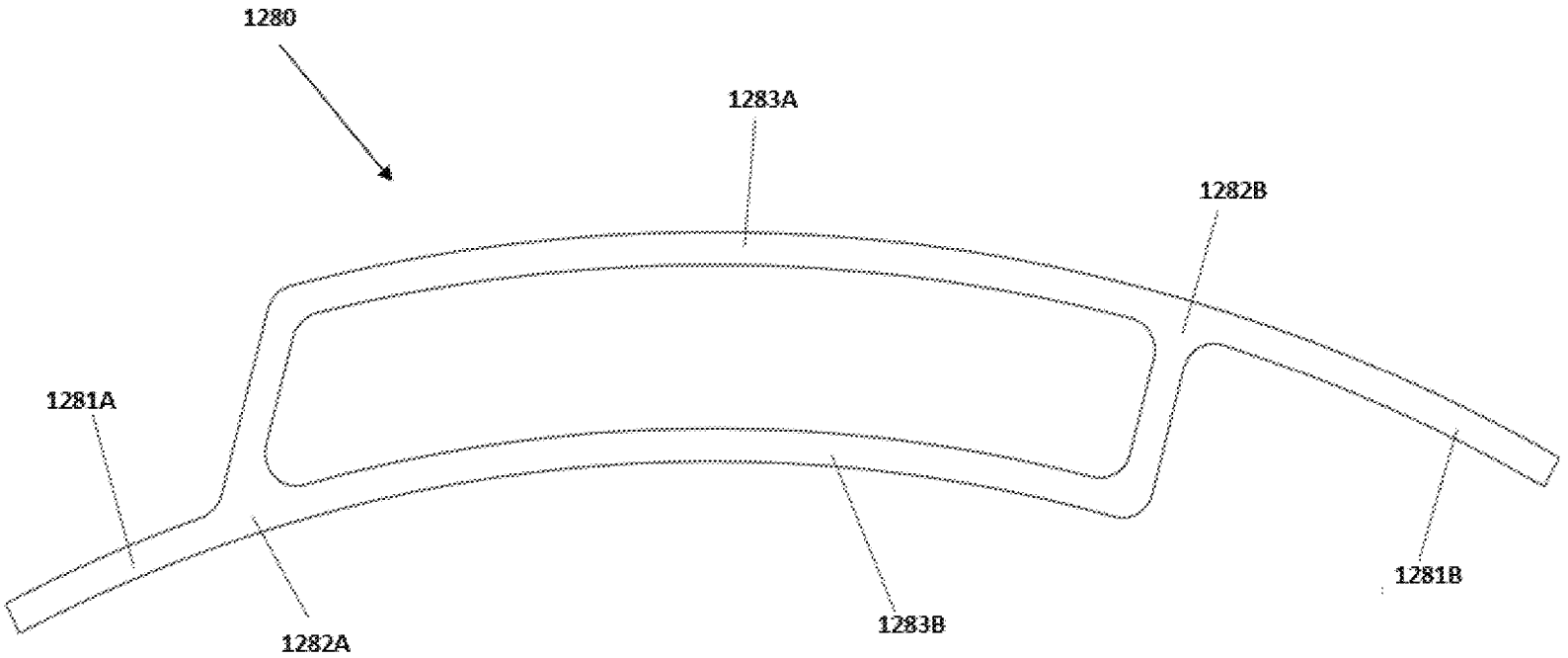
FIG. 37 shows a multi-strip spiral section arrangement of yet a further embodiment of a hairspring according to the present invention.

Referring to FIGS. 35, 36, and 37, there are shown three further embodiments of a hairspring according to the present invention, having multi-strip spiral section with two side-by-side branches. These embodiments, as will be appreciated by those skilled in the art, may readily be extended to include multi-strip spiral sections with more than two side-by-side branches.

Referring to FIG. 35, there is shown a multi-strip spiral section arrangement 1060 of a further embodiment of a hairspring according to the present invention, where both side-by-side branches 1063A, 1063B abruptly diverge from and then abruptly converge into a single branch of two adjacent single-strip spiral sections 1061A, 1061B of the hairspring Referring to FIG. 36, there is shown a multi-strip spiral segment 1170 of another embodiment of a hairspring according to the present invention. The left primary strip 1171A is smoothly connected to one of the side-by-side branches 1173A which is in turn smoothly connected to the right primary strip 1171B.

The side-by-side branch 1173A abruptly diverges from the left primary strip 1171A at the point of intersection 1172A and abruptly converges into the right primary strip 1171B at the point of intersection 1172B.

Referring to FIG. 37, there is shown a multi-strip spiral segment 1280 of yet a further embodiment of a hairspring according to the present invention. The left primary strip 1281A is smoothly connected to one of the side-by-side branches 1283B.

The side-by-side branch 1283A abruptly diverge from the left primary strip 1281A at the point of intersection 1282A and is smoothly connected to the right primary strip 1281B. The side-by-side branch 1283B abruptly converges into the right primary strip 1281B at the point of intersection 1282B.

Figure 38:
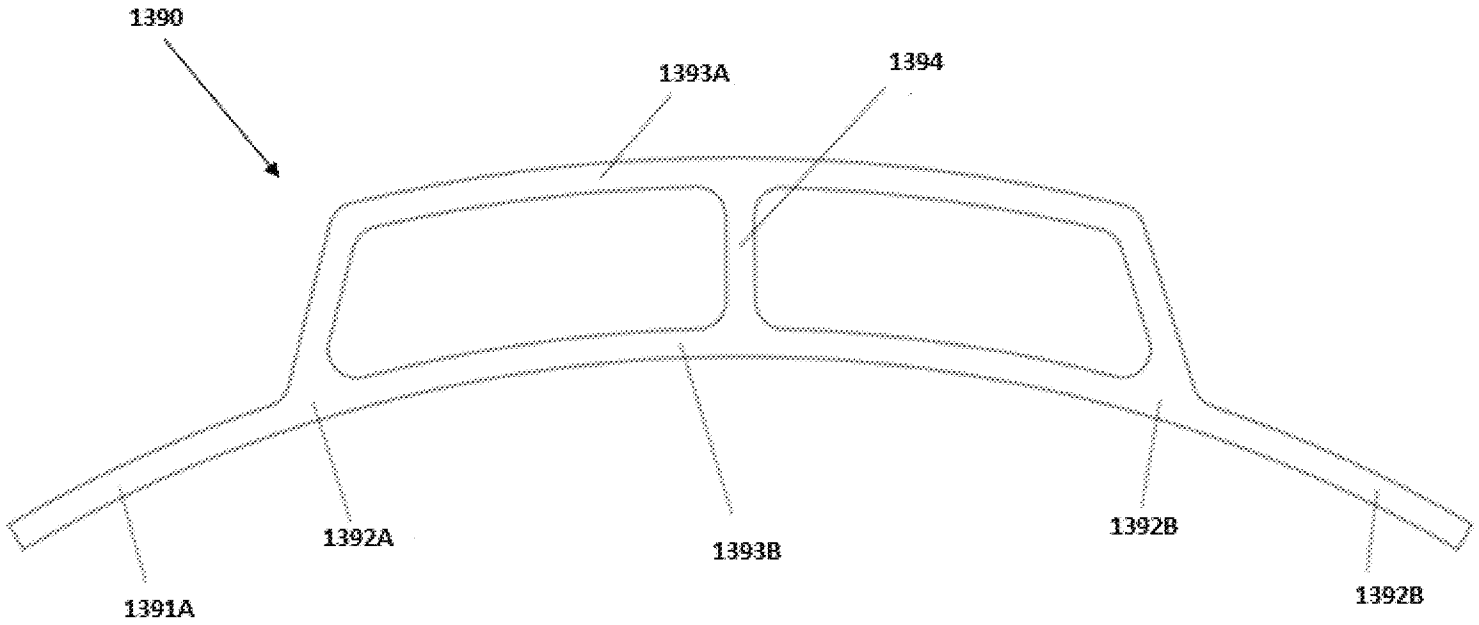
FIG. 38 shows a multi-strip spiral section arrangement of yet another embodiment of a hairspring according to the present invention.

Referring to FIG. 38, there is shown a layout of a multi-strip spiral section 1390 of yet another embodiment of the present invention, including a support strut 1394.

The side-by-side branches 1393A, 1393B are connected the primary strips 1391A, 1391B to the left and right via the points of intersection 1392A,1392B, respectively.

As the entire multi-strip spiral section 1390 bends, the side-by-side branches 1393A and 1393B may bend with slightly different radii of curvature. Depending on the hairspring geometry and the magnitude of the bending, the side-by-side branches 1393A and 1393B may be urged towards each other, and may come into contact. The support strut 1394 prevents this from happening and has minimal impact in the statics of the multi-strip spiral section 1390 if the width of the strut 1394 is much smaller than the length of the spiral section 1390.

As will be appreciated, more than one strut 1394 may be utilised, depending upon the geometry, shape, size and application of the hairspring.

Figure 39:
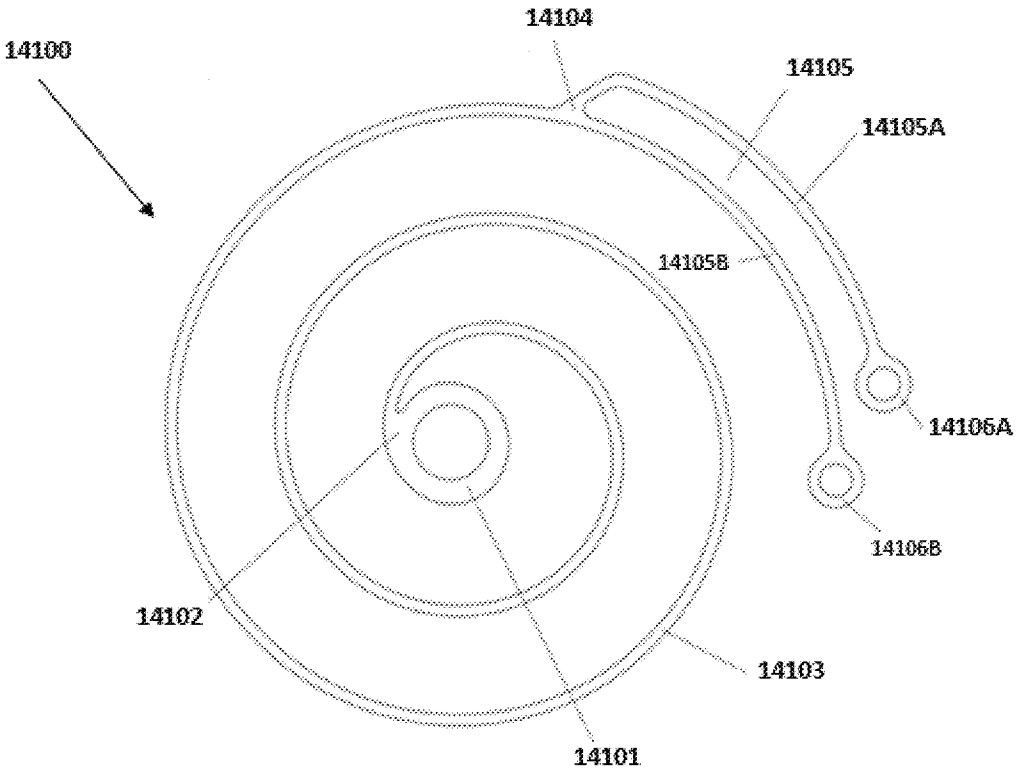
FIG. 39 shows an alternate embodiment of a hairspring according to the present invention.

Referring to FIG. 39, there is shown an alternate embodiment of a hairspring 14100 according to the present invention.

Figure 34:
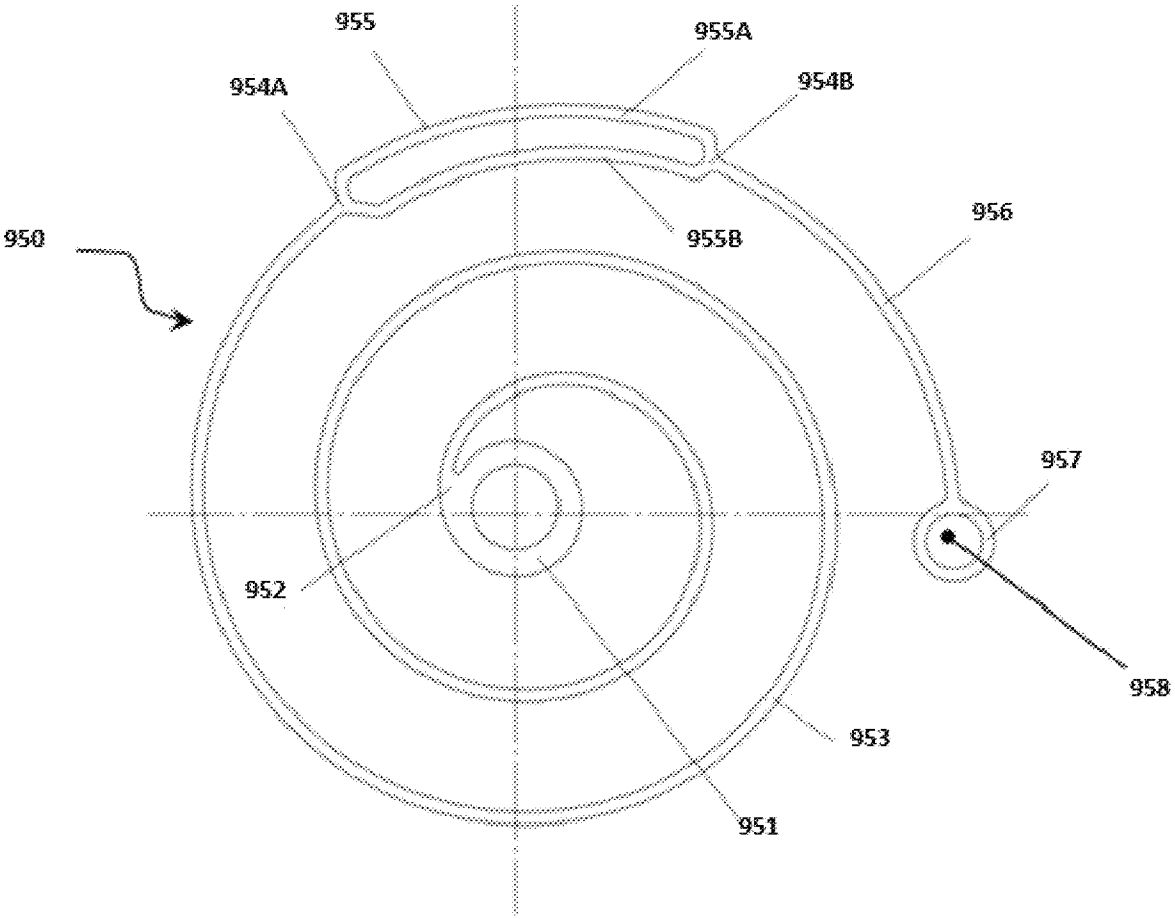
FIG. 34 shows a first embodiment of a hairspring according to the present invention.

The hairspring design has a collet 14101 at its centre. The primary strip 14103 has an inner terminal 14102 connected to the collet 14101 and spirals outward until it reaches the multi-strip spiral section 14105 at the point of intersection 14104. The primary strip 14103 then splits into two side-by-side branches 14105A and 14105B, each of which independently terminates in a fixed and clamped outer terminal 14106A, 14106B, respectively, by contrast to the embodiment as depicted in FIG. 34 whereby the side-by-side branches 955A, 955B re-converge at the outer terminal.

Figure 40:
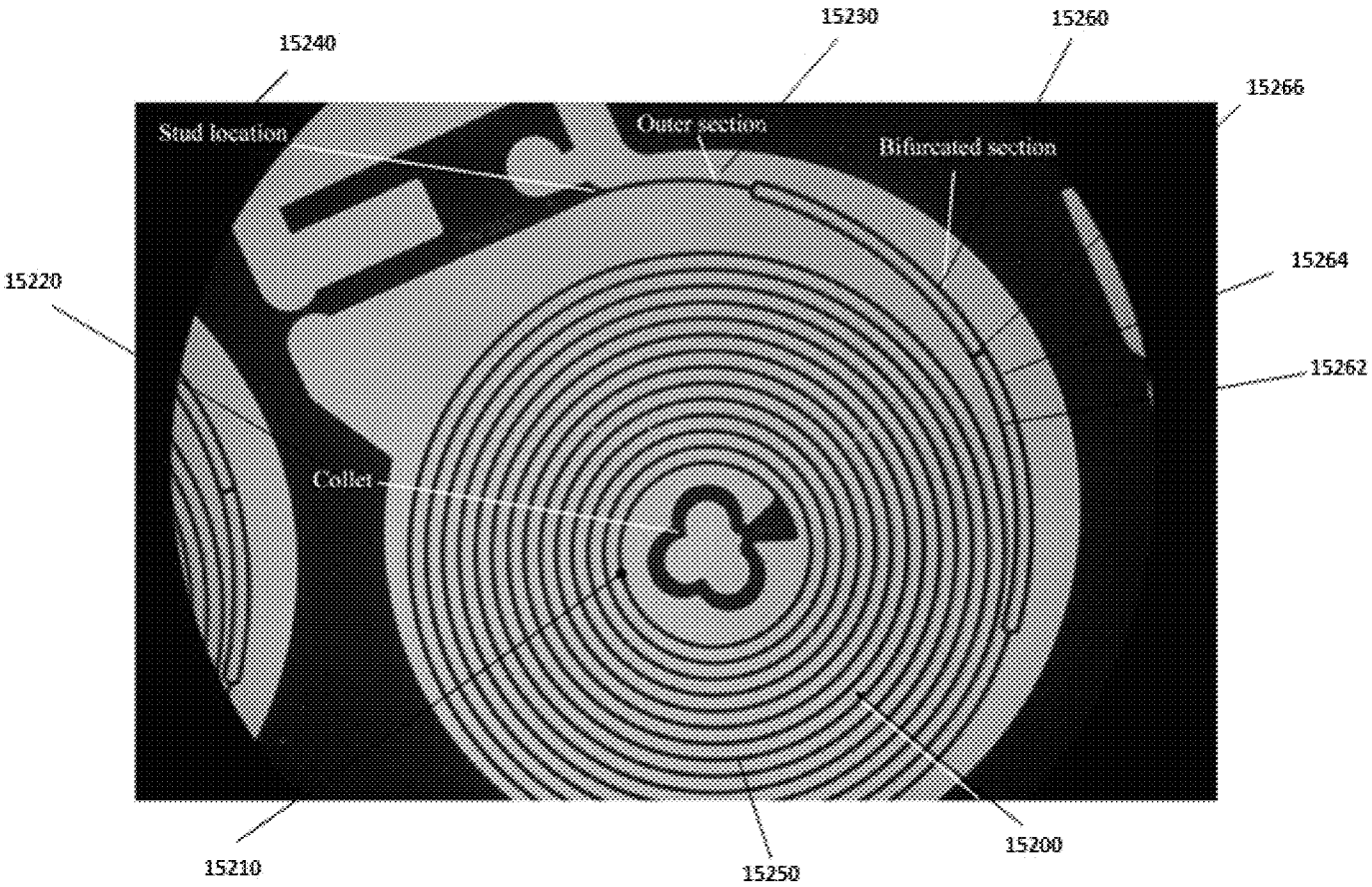
FIG. 40 shows an exemplary embodiment of a hairspring according to the present invention.

Referring to FIG. 40, there is shown a photographic representation of an embodiment of a hairspring 15200 according to the present invention.

The hairspring 15200 includes an inner terminal portion 15210 for engagement with a collet 15220 and an outer terminal portion 15230 for engagement with a start 15240, a first limb portion 15250 extending from the inner terminal end portion 15210 towards the outer terminal portion 15230, and a stiffening portion 15260 positioned at the outer turn of the hairspring 15200. In this embodiment, the stiffening portion is a bifurcated section including an inner limb 15262 and outer limb 15264, and a strut extending therebetween 266.

The stiffening portion 15260 is stiffened by increasing the $2^{nd}$ moment of area by utilizing the spaced apart to bifurcated limbs 15262, 15264, which collectively increase the $2^{nd}$ moment of area in this portion of the spring.

As will be appreciated and understood by those skilled in the art, the $2^{nd}$ moment of area of the bifurcated section, by way of the two limbs 15262 and 15264 being spaced apart, increases the bending stiffness accordingly.

As will be noted, the cross-sectional dimensions of the first limb portion and the stiffening portion are both the same, and as such, the first limb portion and each of the two limbs of the stiffening portion, 15262 and 15264, each have the same cross-sectional area. As such, as the first limb portion and the stiffening portion are formed from the same material and have the same cross-sectional area, and in view of the Young's Modulus being constant due to the hairspring being formed from a single piece of material, the temperature effect on various portions of the hairspring is the same in respect of alteration of Young's Modulus as a function of change in temperature.

The hairspring 15200 in the present embodiment is formed by micro-fabrication techniques, which allow for high dimensional accuracy in the production of such items or articles.

The micro-fabrication technique in respect of the present embodiment allows for temperature desensitization, by using a first material having a first Young's Modulus for the formation of the hairspring and a second material as a coating material having a second Young's Modulus, the first and second Young's Moduli having opposite temperature dependencies and as such, the outer coating layer may be suitably sized and have a thickness such that elastic properties of the hairspring are desensitized to temperature variation.

Suitable materials for forming the hairspring according to the present embodiment are silicon, with a silicon dioxide layer.

In order to increase concentricity, and reduce changes in mass effect during expansion and contraction of the hairspring, the stiffening portion is included in the hairspring.

Furthermore, the dimensions of the stiffening portion may be optimized according to the method of the present invention, so as to provide a suitable stiffness such that deformation of the spring is minimized during rotation, wandering mass is reduced. This may be achieved by utilizing a minimization of a cost function as described above in relation to the present invention.

It can be shown that given certain conditions, the 2nd moment of area of the bifurcated section can be designed to be equivalent to that of a stiffened section with increased width.

For example, a hairspring whose nominal width and height are b0 and h, respectively. Compare two hairspring sections. One section has a single strip of increased width n times that of the b0. The other section has two bifurcated strips, each of the same width as the nominal value b0 and separated by a distance d as measured from the centerline of each strip. Assuming d remains constant for the entirety of the bifurcated section, it is possible to use parallel-axis theorem to set d such that the 2nd moment of area with respected to z-axis for both widened and bifurcated sections are identical. The resultant d is computed as follows:

$$d = b_0\sqrt{\frac{n^3-2}{6}} \tag{25}$$

The optimization algorithm can be easily adapted for both the widened and bifurcated sections. In case of the former, the section width is used as one of the design parameters to be varied in the optimization algorithm. In case of the later, the bifurcated strip distance is used as one of the design parameters to be varied. Note that the two methods can be used interchangeably by using Eq. (12).

Note that if n equals to 2, the bifurcated strips come into contact and becomes a widened strip.

Those skilled in the art will appreciate that the present embodiment will also achieve increased stiffening near the outer terminal in accordance with the invention, although the two side-by-side branches 15105A and 15105B do not re-converge. The present invention provides a hairspring for a timepiece which may be produced with high dimensional and mechanical accuracy, by use of micro-fabrication techniques.

A deficiency of the prior art with respect to silicon hairsprings constructed by micro-fabrication technology is that the greater freedom in design to improve concentricity and the prospect of total thermo-compensation cannot be implemented simultaneously.

Micro-fabrication technology is generally limited to the manufacture of planar components. While it can theoretically produce hairsprings with Breguet-style over-coil which multiple overlapping layers, such manufacturing capability is not currently reliable and, at the very least, demands significant additional complexity to the manufacturing process.

The hairspring according to the present invention provides increased concentricity by providing a stiffening position which reduces wandering of the mass of the cess hairspring about the axis of rotation during use, such reduction in wandering reduces radial inertial effects of the hairspring due to acceleration and motion, thus reducing radial forces at the central bearing.

Furthermore, being temperature desensitized, the hairspring according to the present invention provides increased isochronousity.

This has the effect of increasing the isochronousity of the hairspring and oscillator mechanism, thus providing a hairspring of greater position for timekeeping purposes.

Furthermore, reduction in radial forces also reduces friction on the bearing located at the centre of the oscillator assembly, which also increases isochronousity as frictional forces impact upon the motion of the oscillator, as well as reducing wear and damage to the bearing.

This results in a hairspring oscillator mechanism having increased longevity, as well as requiring less servicing and maintenance due to the wear of components. Increasing concentricity during motion results in an increase in isochronousity due to reduction in a non-linear second-order system, as well as reducing the tendency for turnings of a hairspring to engage with each other during compression and expansion of the hairspring, engagement of intermediate turns with adjacent turns of the hairspring and collision alters the mechanical properties of the hairspring, which has significant adverse effect on the isochronousity.

Furthermore, collision and impact of adjacent intermediate turnings may result in damage and potential failure to the hairspring, again reducing reliability of the hairspring as well as increasing costs due to maintenance and repair.

While the present invention has been explained by reference to the examples or preferred embodiments described above, it will be appreciated that those are examples to assist understanding of the present invention and are not meant to be restrictive. Variations or modifications which are obvious or trivial to persons skilled in the art, as well as improvements made thereon, should be considered as equivalents of this invention.

The invention claimed is:

1. A method of increasing concentricity in use of a spiral hairspring mechanical timepiece; the hairspring having an inner terminal end portion for engagement with a collet and an outer terminal end portion for engagement with a stud, a first limb portion extending from the inner terminal end portion towards the outer terminal end portion, an outer turn, and a stiffening portion positioned at the outer turn of the hairspring and having a cross-sectional second moment of area different to that of the first limb portion; such that the bending stiffness of the stiffening portion has a greater bending stiffness than that of the first limb portion; said method including:

receiving, as inputs, design parameters indicative of the cross sectional second moment of area of the first limb portion and of the cross sectional second moment of area of the stiffening portion;

modifying, using the design parameters, the cross-sectional second moments of area of the first limb portion and of the stiffening portion by way of minimization of a cost function throughout the amplitude of the rotation of the hairspring in use, wherein the cost function is correlated to the net concentricity of the hairspring; and forming a spiral hairspring mechanical timepiece in accordance with the modified cross-sectional second moments of area of the first limb portion and of the stiffening portion.

2. A method according to claim 1, wherein said cost function is the integral of the magnitude of the stud reaction force over the entire range of the amplitude of the rotation of hairspring in use.

3. A method according to claim 1, wherein said cost function is the maximum value of the magnitude of the stud reaction force over the entire range of the amplitude of the rotation of hairspring in use.

4. A method according to claim 1, wherein the cost function is the integral of the magnitude of the hairspring's center of mass location, relative to the hairspring's center of mass location when the balance wheel angle is zero, over the entire range of the amplitude of the rotation of hairspring in use.

5. A method according to claim 1, wherein the cost function is the maximum value of the magnitude of the hairspring's center of mass location, relative to the hairspring center of mass location when the amplitude of rotation is zero, over the entire range of the amplitude of the rotation of hairspring in use.

6. A method according to claim 1, wherein the cross-section second moments of area for a modified first portion and stiffening portion of the hairspring are based on the position location along the hairspring strip, the arc length of the modified portions of the hairspring, and a function that determines the cross-section second moment of area variation along the modified portions of the hairspring.

7. A method according to claim 6, wherein the cross-section second moment of area variation is substantially constant.

8. A method according to claim 6, wherein the cross-section second moment of area variation is based on a polynomial function.

9. A method according to claim 6, wherein the cross-section second moment of area variation is based on a trigonometric function.

10. A method according to claim 6, wherein the cross-section second moment of area variation is based on a discontinuous function of two or more piecewise continuous functions.

11. A method according to claim 1, wherein an optimization algorithm used is based on the gradient descent method and requires the computation of the gradient of the cost function with respect to the design parameters.

12. A spiral hairspring for mechanical timepiece having an inner terminal end portion for engagement with a collet and an outer terminal end portion for engagement with a stud, a first limb portion extending from the inner terminal end portion towards the outer terminal end portion, and a stiffening portion positioned at the outer turn of the hairspring and having a cross-sectional second moment of area different to that of the first limb portion; wherein the cross-sectional second moments of area of the first portion and the stiffening portion is determined by the method of claim 1.

13. A hairspring according to claim 12, wherein the first limb portion and the two or more spaced apart limb portions of the stiffening portion are of rectangular cross-section, and have the same width as each other and the same height as each other.

* * * * *